US006419321B1

(12) United States Patent
Sack

(10) Patent No.: US 6,419,321 B1
(45) Date of Patent: Jul. 16, 2002

(54) ADJUSTABLE HEAD SUPPORT FOR CONNECTION TO A WHEELCHAIR

(75) Inventor: James A. Sack, Elverson, PA (US)

(73) Assignee: Wonderland Nursery Goods, Co., Ltd., Taipei (TW)

( * ) Notice: Subject to any disclaimer, the term of this patent is extended or adjusted under 35 U.S.C. 154(b) by 0 days.

(21) Appl. No.: 09/517,284

(22) Filed: Mar. 2, 2000

Related U.S. Application Data

(60) Provisional application No. 60/122,396, filed on Mar. 2, 1999.

(51) Int. Cl.[7] ..... A47C 7/36
(52) U.S. Cl. ..... 297/405
(58) Field of Search ..... 297/391, 405, 297/406, 408, 410, DIG. 4; 248/118

(56) References Cited

U.S. PATENT DOCUMENTS

| | | | | |
|---|---|---|---|---|
| 169,383 | A | | 11/1875 | Starr |
| 259,957 | A | | 6/1882 | White |
| 313,781 | A | | 3/1885 | Starr et al. |
| 333,019 | A | | 12/1885 | Merrick |
| 398,893 | A | | 3/1889 | Gould |
| 438,238 | A | | 10/1890 | Jefferies et al. |
| 461,928 | A | | 10/1891 | White |
| 546,631 | A | | 9/1895 | White |
| 974,188 | A | * | 11/1910 | Ritter |
| 1,274,214 | A | | 7/1918 | Tizley |
| 1,821,560 | A | * | 9/1931 | May |
| 1,885,507 | A | | 11/1932 | Browne |
| 2,549,573 | A | | 4/1951 | Clark ..... 287/99 |
| 2,630,342 | A | | 3/1953 | Gilmont ..... 287/54 |
| 2,652,221 | A | | 9/1953 | Kampa ..... 248/278 |
| 3,098,128 | A | | 7/1963 | Audin ..... 179/146 |
| 3,188,079 | A | | 6/1965 | Boetcker et al. ..... 269/328 |
| 3,376,064 | A | * | 4/1968 | Jackson |
| 3,497,259 | A | | 2/1970 | Sherfey ..... 297/391 |
| 3,675,646 | A | * | 7/1972 | Corcoran |
| 3,730,589 | A | | 5/1973 | Lane ..... 297/391 |
| 3,761,126 | A | | 9/1973 | Mulholland ..... 297/384 |
| 4,273,116 | A | | 6/1981 | Chiquet ..... 128/92 A |
| 4,617,919 | A | | 10/1986 | Suhre ..... 128/78 |
| 4,732,423 | A | | 3/1988 | Condon ..... 297/284 |
| 4,989,836 | A | | 2/1991 | Hudson, III et al. ..... 297/391 |
| 5,090,073 | A | | 2/1992 | Nordan et al. ..... 5/64 |
| 5,110,150 | A | | 5/1992 | Chen ..... 280/642 |
| 5,308,028 | A | | 5/1994 | Kornberg ..... 248/118 |
| 5,332,287 | A | * | 7/1994 | Whitmyer |
| 5,393,161 | A | | 2/1995 | Mata et al. ..... 403/133 |
| 5,605,409 | A | | 2/1997 | Haut et al. ..... 403/102 |
| 5,803,642 | A | | 9/1998 | Sassmannshausen ..... 403/90 |
| 5,967,613 | A | * | 10/1999 | McKeever |

FOREIGN PATENT DOCUMENTS

| | | |
|---|---|---|
| GB | 2886 | of 1894 |

* cited by examiner

*Primary Examiner*—Milton Nelson, Jr.
(74) *Attorney, Agent, or Firm*—Hogan & Hartson LLP; Matthew T. Bailey, Esq.

(57) ABSTRACT

A head array for a wheelchair includes a temple support, an occipital support, a sub-occipital support, and a support structure for adjustably mounting the temple support, the occipital support and the sub-occipital support. Also shown is a support structure for a wheelchair head array including a horizontal channel adapted to receive a first component of a wheelchair head array and a vertical channel adapted to receive a second component of a wheelchair head array, the vertical channel being attached to the horizontal component.

10 Claims, 67 Drawing Sheets

ADJUSTABLE HEAD SUPPORT FOR CONNECTION TO A WHEELCHAIR

CROSS-REFERENCE TO RELATED APPLICATIONS

This application claims priority to provisional application Ser. No. 60/122,396, filed on Mar. 2, 1999, the disclosure of which is incorporated by reference in its entirety herein.

FIELD OF THE INVENTION

The present invention relates to a head support, and more particularly to a head support for connection to a wheelchair.

BACKGROUND OF THE INVENTION

It is known in the conventional art to use structure to support a head of a user of a wheelchair. Often, the user of the wheelchair is unable to adequately support their head during the use and operation of the wheelchair. Since all types of people use wheelchairs, it is desirable to allow the head support structure to be positioned in a variety of configurations. While, it is known to use adjustable head support structures, existing head support structures do not offer enough adjustability to accommodate a wide variance of body types. Accordingly, existing wheel chairs often must be customized for a particular user, thus greatly increasing their cost.

Moreover, existing head support structures often suffer from the disadvantage that they are difficult to adjust.

SUMMARY OF THE INVENTION

In view of the above-discussed disadvantages of conventional wheelchair head supports, it is an object of the invention to provide a head support for a user of a wheel chair that is easily adjustable to a sufficient variety of positions to accommodate most body types.

To achieve the foregoing and other objectives, and in accordance with the purposes of the invention, a head array for a wheelchair is provided that includes multiple pads for contact with different portions of a user's head. Each pad is capable of independent adjustment in three axes as well as being supported on an assembly that allows the pads to be adjusted in position relative to each other. Pads for contact with sides of the head or temple region can be swiveled about three axes to accommodate different shaped heads, as well as being adjustable towards and away from separate pads for contact with back portions of the head. Similarly, a pad for contact with the center back or upper back of the head can be swiveled about three axes to accommodate different shaped heads as well as being adjustable towards and away from separate pads for contact with the lower back of the head, or occipital region.

In one embodiment the head array can include a temple support, an occipital support, a sub-occipital support, and a support structure for adjustably mounting the temple support, the occipital support and the sub-occipital support.

The embodiment of the invention can further include a support structure for the wheelchair head array including a horizontal channel adapted to receive a first component of the wheelchair head array, and a vertical channel adapted to receive a second component of the wheelchair head array, the vertical channel being attached to the horizontal component. The temple support and occipital support can be adjustably connected to the second component, and the sub-occipital support can be adjustably connected to the first component. The vertical channel allows for adjustments to change the vertical distance between the first and second components, and thus the temple support and occipital support can be displaced in a vertical direction relative to the sub-occipital support.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Figure 1:
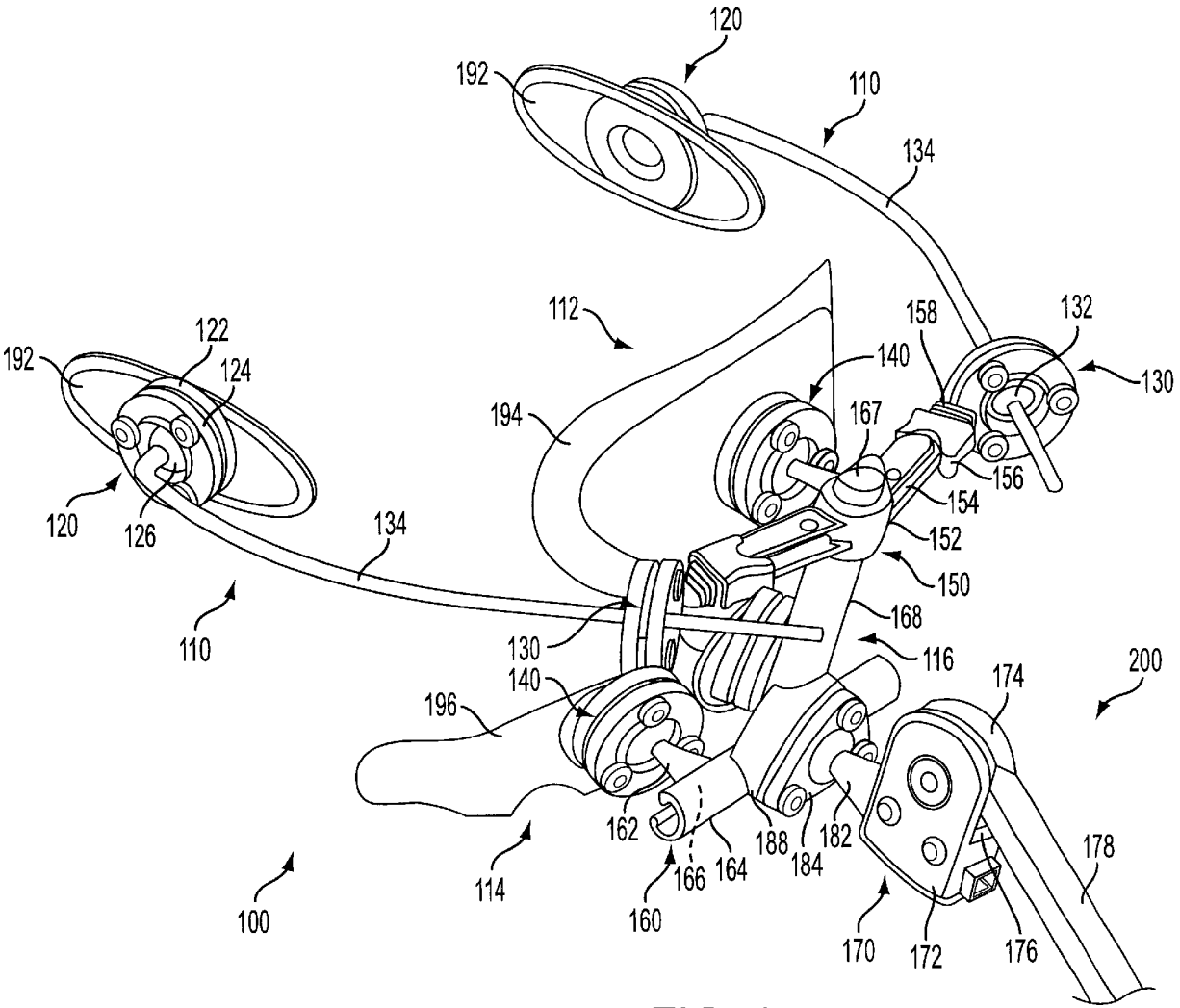
FIG. 1 is an isometric view of the head support assembly of the present invention.
Figure 2:
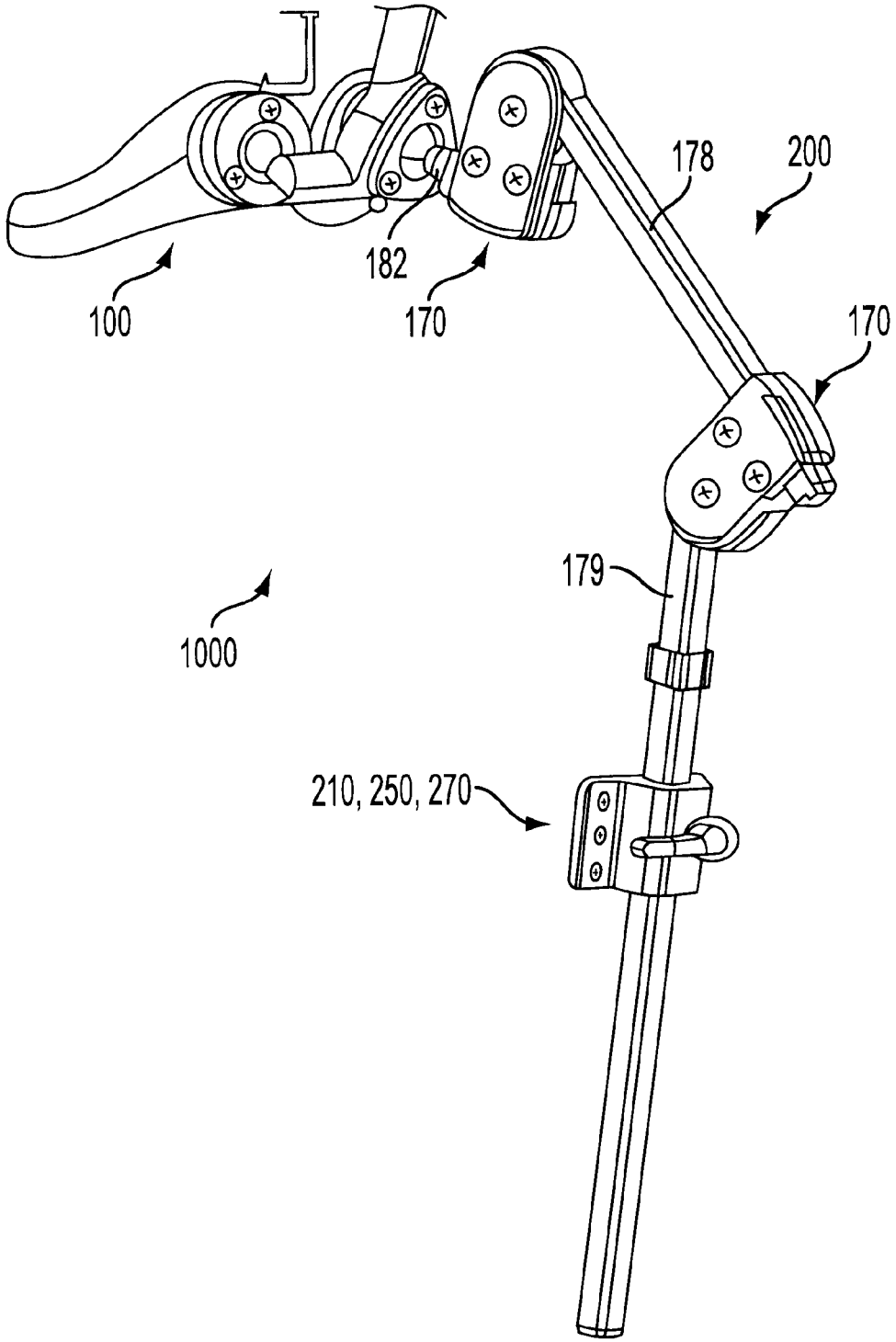
FIG. 2 is an isometric view of the connecting assembly of the present invention.

Referring to the drawing figures, FIG. 1 is an isometric view of a head support assembly of the present invention. FIG. 2 is an isometric view of a connecting assembly of the present invention for connecting the head support assembly to a wheel chair. The head support assembly 1000 includes a head array assembly, and a connecting assembly.

Head Array Assembly-First Embodiment

The first embodiment of the head array assembly is the head array 100. The head array 100 includes first and second temple support assemblies 110, an occipital support assembly 112, a sub-occipital support assembly 114, and a support structure assembly 116.

First and Second Temple Support Assemblies

Figure 37A:
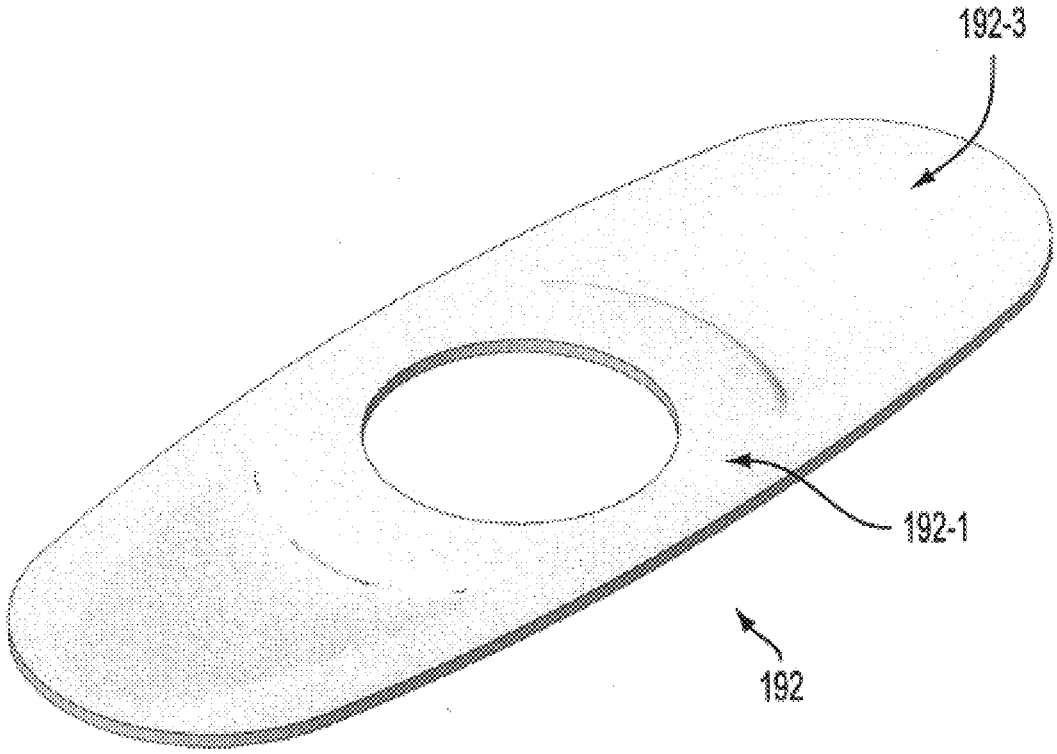
FIGS. 37A and 37B are isometric views of the temple plate of the present invention.
Figure 37B:
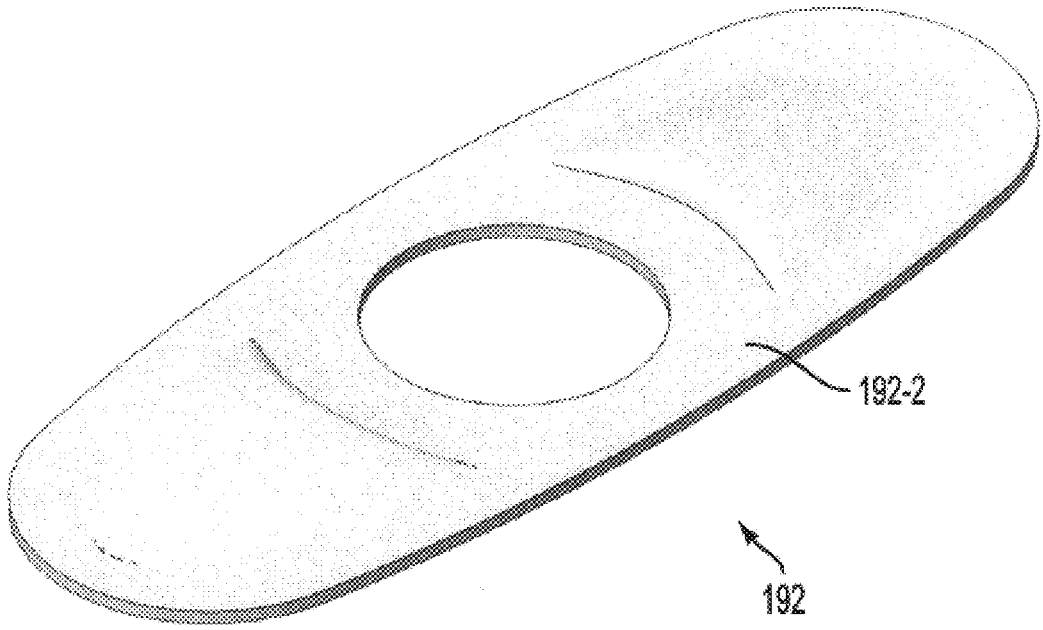

The first and second temple support assemblies 110 include a temple plate 192 connected to a temple arm 134. FIGS. 37A and 37B are isometric views of the temple plate of the present invention. The temple plate 192 includes a first contact surface 192-1 and a second contact surface 192-2. The first contact surface 192-1 can include a concave portion 192-3. The second contact surface 192-2 can include a convex portion 192-3. The temple plate 192 can be adapted to provide support for a temple of the head of a user of a wheelchair. Alternately, or in conjunction with providing support, the temple plate can be adapted to control one or more of a variety of functions of the wheelchair (e.g. directional control, summon assistance, etc.). Preferably, the first contact surface 192-1 including the concave portion 192-3 is oriented proximate the temple of the head of the user of the wheelchair. By this arrangement, it is believed that the temple plate 192 can better support the head of the user and permit control of the wheelchair. The temple plate 192 used in the first and second temple support assemblies 110 can be any suitable commercial part.

Figure 10A:
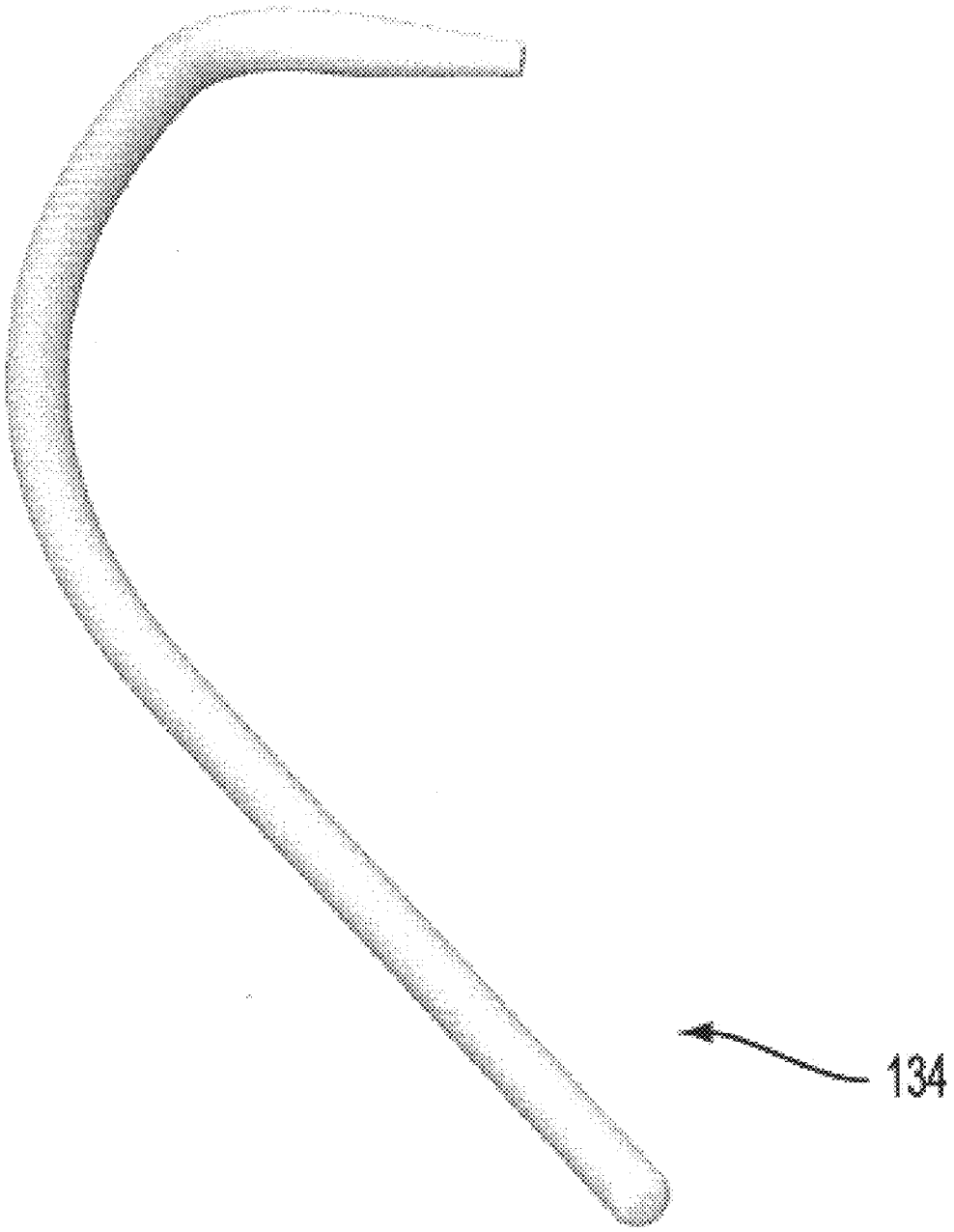
FIGS. 10A and 10B are isometric views of the temple arm of the present invention.
Figure 10B:
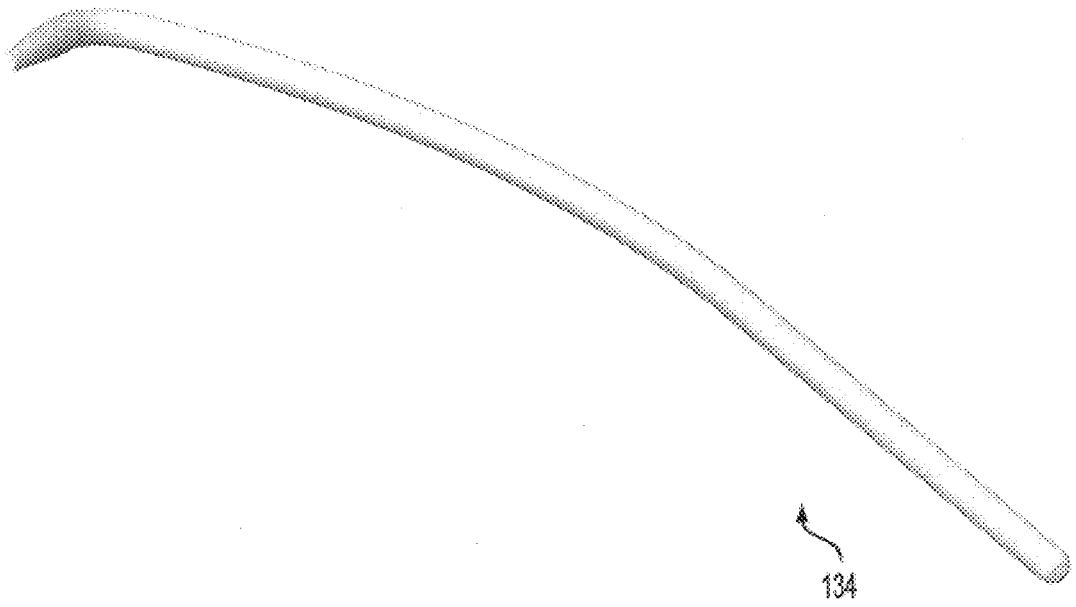

FIGS. 10A and 10B are isometric views of the temple arm of the present invention. The temple arm 134 can have a variety of shapes. The temple arm 134 can be substantially V-shaped. The temple arm 134 can also include a first end having a tapered section and a second end having an un-tapered section.

The temple plate 192 can be connected to the temple arm 134 by a variety of fastening techniques. The fastening techniques include fixed or swivel techniques.

Figure 4A:
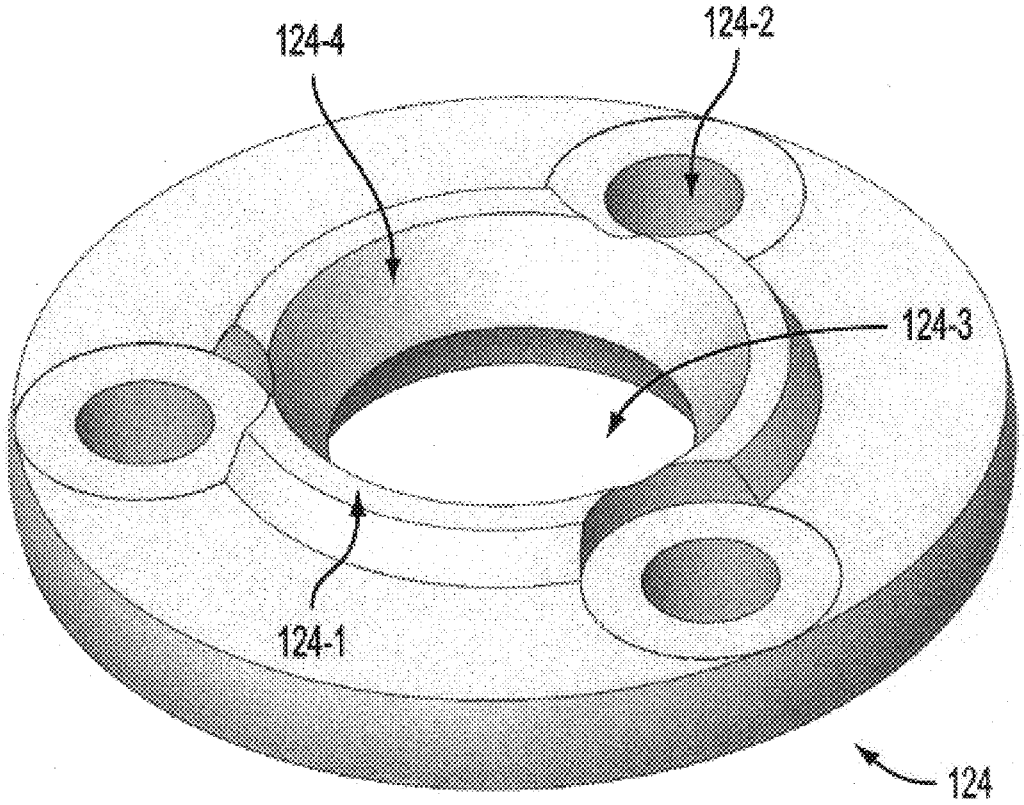
FIGS. 4A and 4B are isometric views of the first swivel ring of the present invention.
Figure 4B:
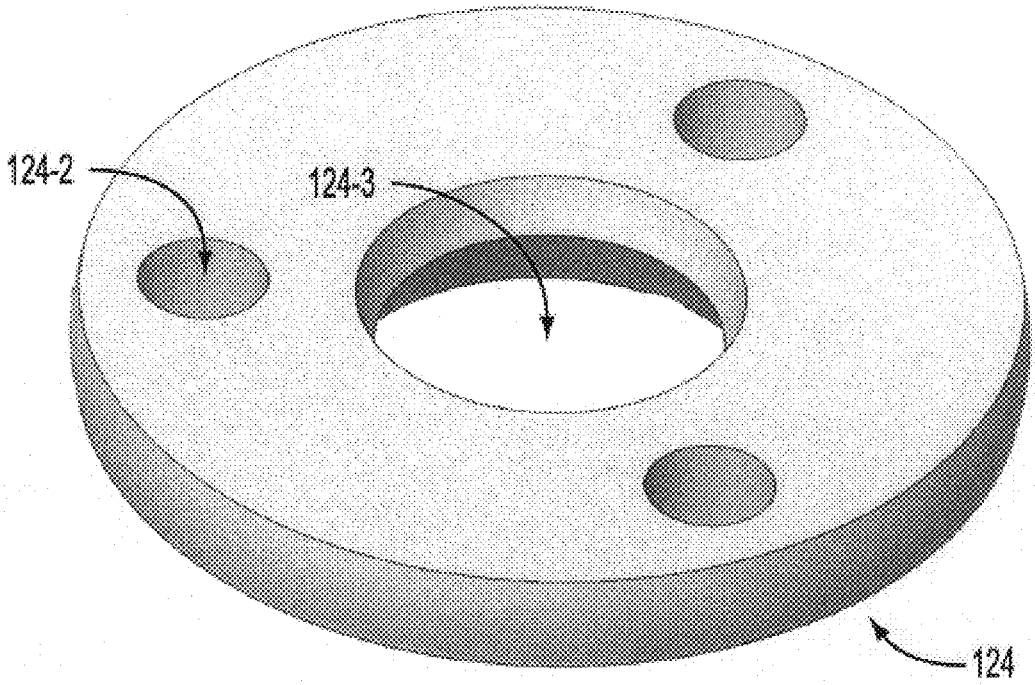
Figure 5A:
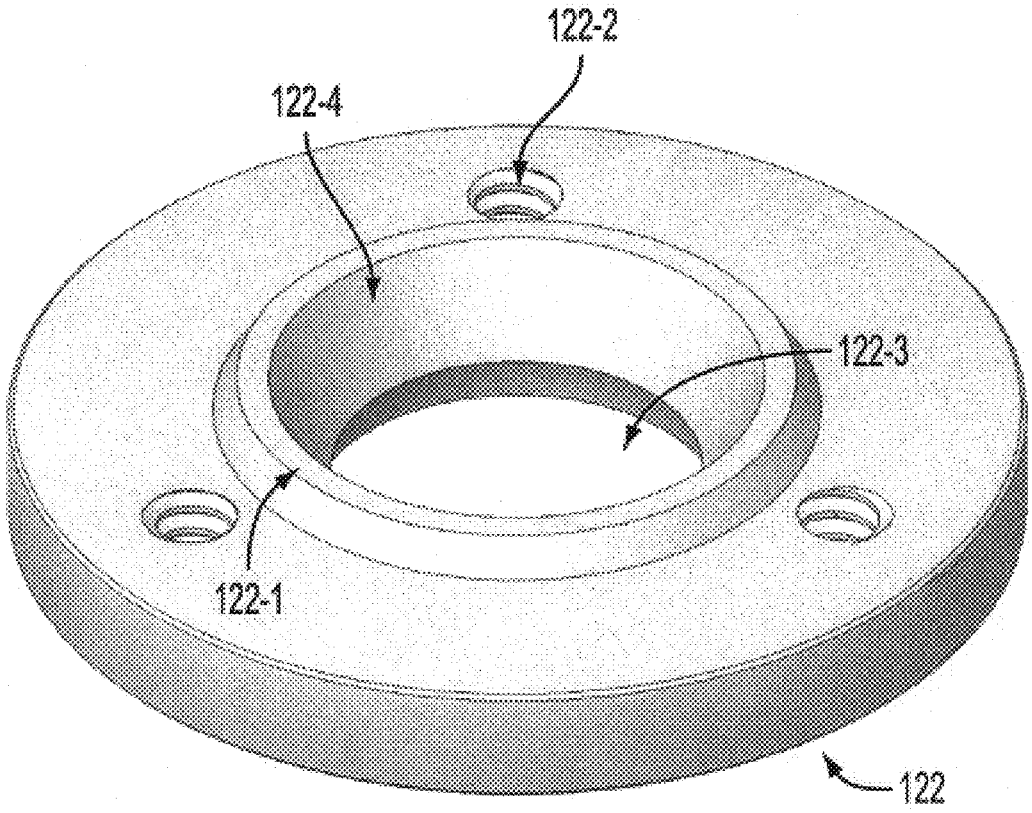
FIGS. 5A and 5B are isometric views of the second swivel ring of the present invention.
Figure 5B:
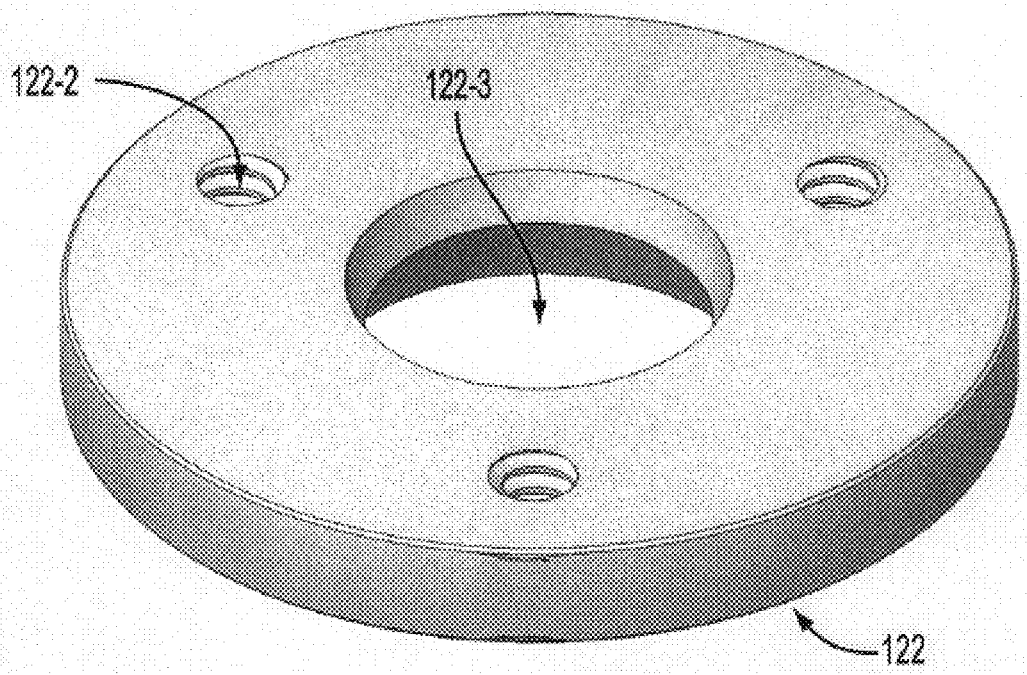
Figure 6:
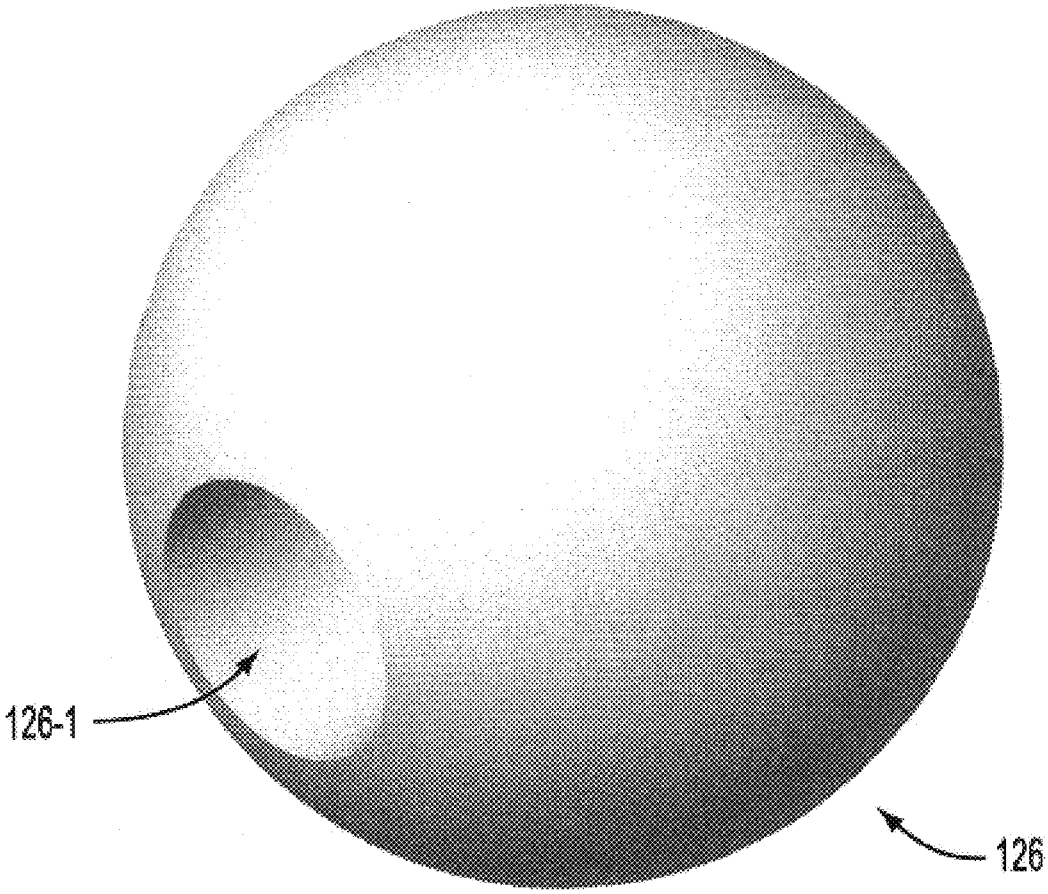
FIG. 6 is an isometric view of the swivel ball of the present invention.
Figure 7:
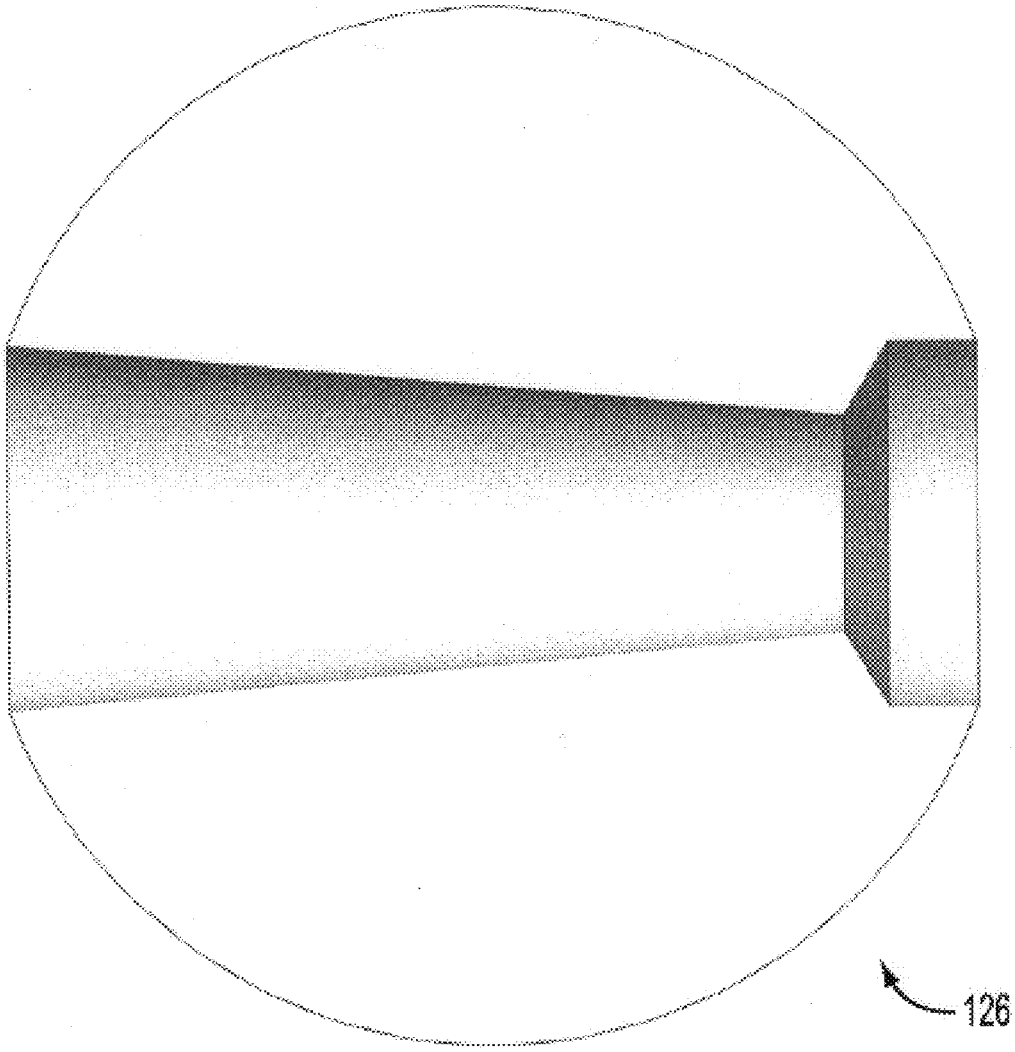
FIG. 7 is a cross-sectional view of the swivel ball of FIG. 6.
Figure 8:
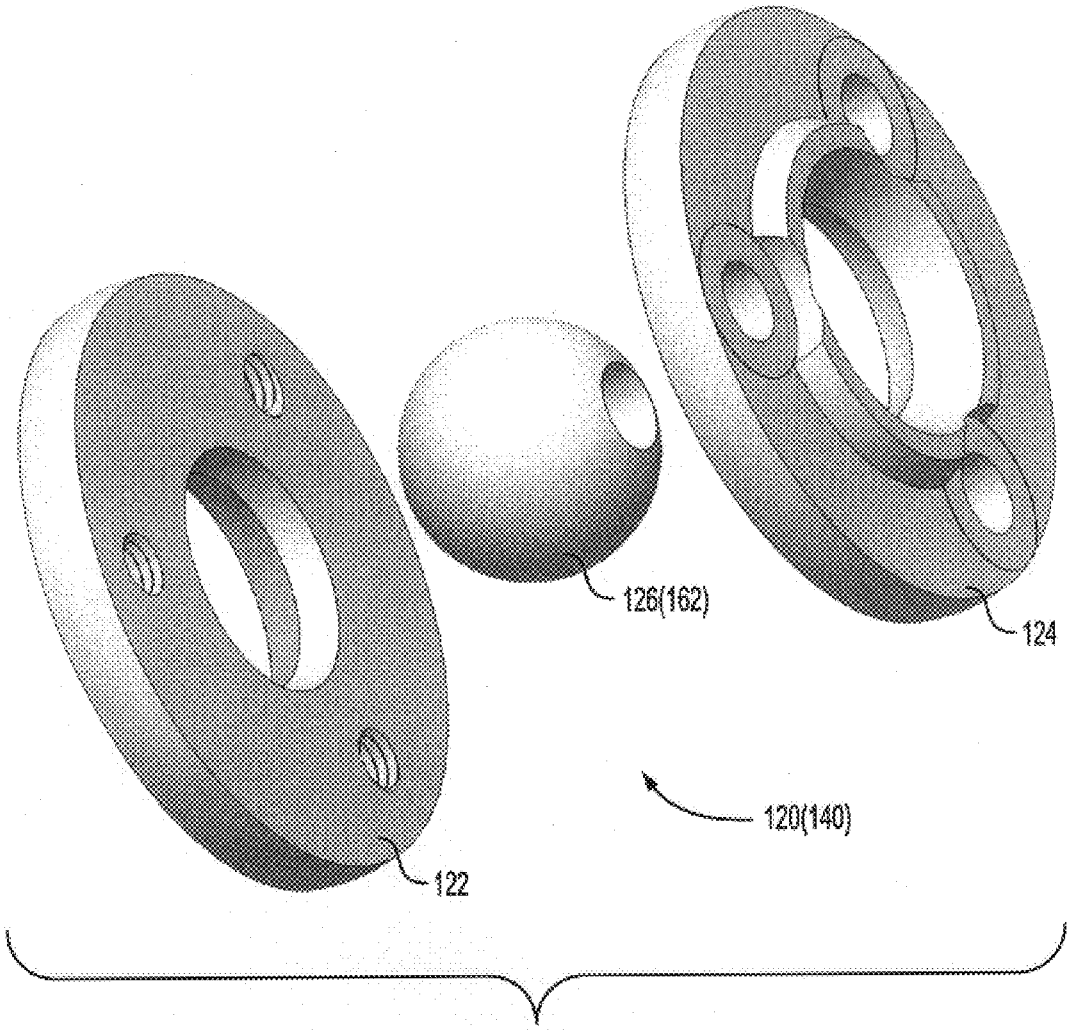
FIG. 8 is an exploded view of the swivel joint of the present invention.

In the case of a swivel technique, the temple plate 192 can be connected to the temple arm by a swivel joint 120. FIGS. 4A and 4B are isometric views of the first swivel ring of the present invention. FIGS. 5A and 5B are isometric views of the second swivel ring of the present invention. FIG. 6 is an isometric view of the swivel ball of the present invention. FIG. 7 is a cross-sectional view of the swivel ball of FIG. 6. FIG. 8 is an exploded view of the swivel joint of the present invention. The swivel joint 120 includes a first swivel ring 124, a second swivel ring 122, and a swivel ball 126.

The first swivel ring 124 includes a first swivel ball channel 124-1, a first swivel ring void 124-2, a first swivel ring ball void 124-3, and a first swivel ring contact surface 124-4. The second swivel ring 122 includes a second swivel ball channel 122-1, a second swivel ring void 122-2, a second swivel ring ball void 122-3, and a second swivel ring contact surface 122-4. The second swivel ring void 122-2 can include internal threads. The swivel ball 126 includes an arm opening 126-1 (to be described in detail later). The swivel ball 126 is disposed between the first swivel ring contact surface 124-4 of the first swivel ring 124 and the second swivel ring contact surface 122-4 of the second swivel ring 122, such that removal of the swivel ball 126 from the swivel joint 120 is substantially prevented by the first swivel ball channel 124-1 and the second swivel ball channel 122-1. At least one fastener (not shown) is inserted through the first swivel ring void 124-2 and the second swivel ring void 122-2 to substantially prevent relative movement between the first swivel ring 124 and the second swivel ring 122. As the distance between the first swivel ring 124 and the second swivel ring 122 is decreased due to tightening of the fastener (not shown), reorientation of the swivel ball 120 is substantially prohibited by interference between the swivel ball 126 and the first and second swivel ring contact surfaces 124-4 and 122-2, respectively.

The first end having a tapered section of the temple arm 134 is secured in the arm opening 126-1 of the swivel ball 126 by one or more of a variety of fastening techniques. An interference fit between the tapered section of the temple arm 134 and the arm opening 126-1 of the swivel ball 126 can be used to substantially prevent undesired un-attachment of the temple plate 192 and the temple arm 134.

It is to be understood that the first and second temple support assemblies 110 can be mirror images or each other, or alternately can be of different configurations from each other. Additionally, each of the first and second temple support assemblies 110 can be adapted for one or more purposes (e.g. the first temple support assembly is configured to support the head of a user of the wheelchair, and the second temple support assembly is configured to control one or more functions of the wheelchair and/or support the head of a user of the wheelchair, etc.).

Occipital Support Assembly

Figure 34A:
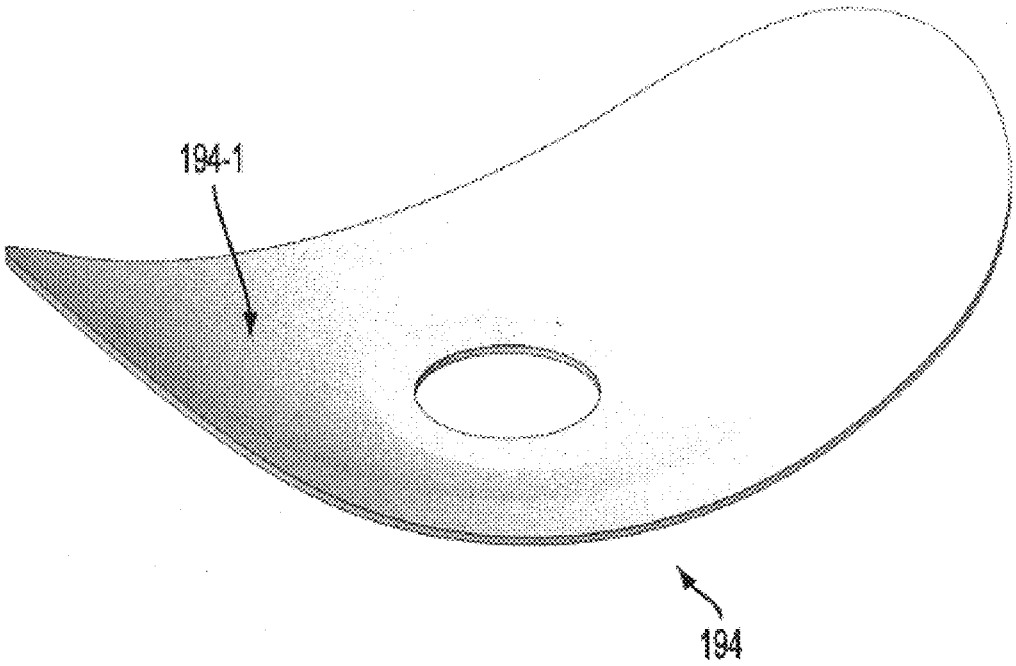
FIGS. 34A and 34B are isometric views of the occipital plates of the present invention.
Figure 34B:
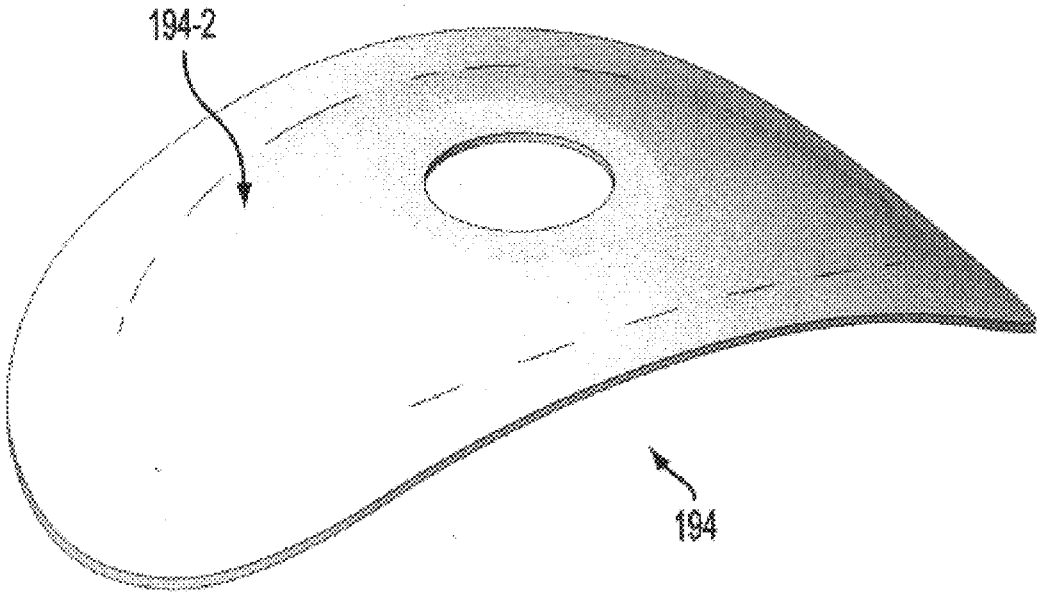

The occipital support assembly 112 includes an occipital plate 194. FIGS. 34A and 34B are isometric views of the occipital plates of the present invention. The occipital plate 194 includes a concave surface 194-1 and a convex surface 194-2. The concave surface 194-1 can be shaped such that the head of the user of the wheelchair is adequately supported. The occipital plate 194 used in the occipital support assembly 112 can be any suitable commercial part.

Sub-occipital Support Assembly

Figure 36A:
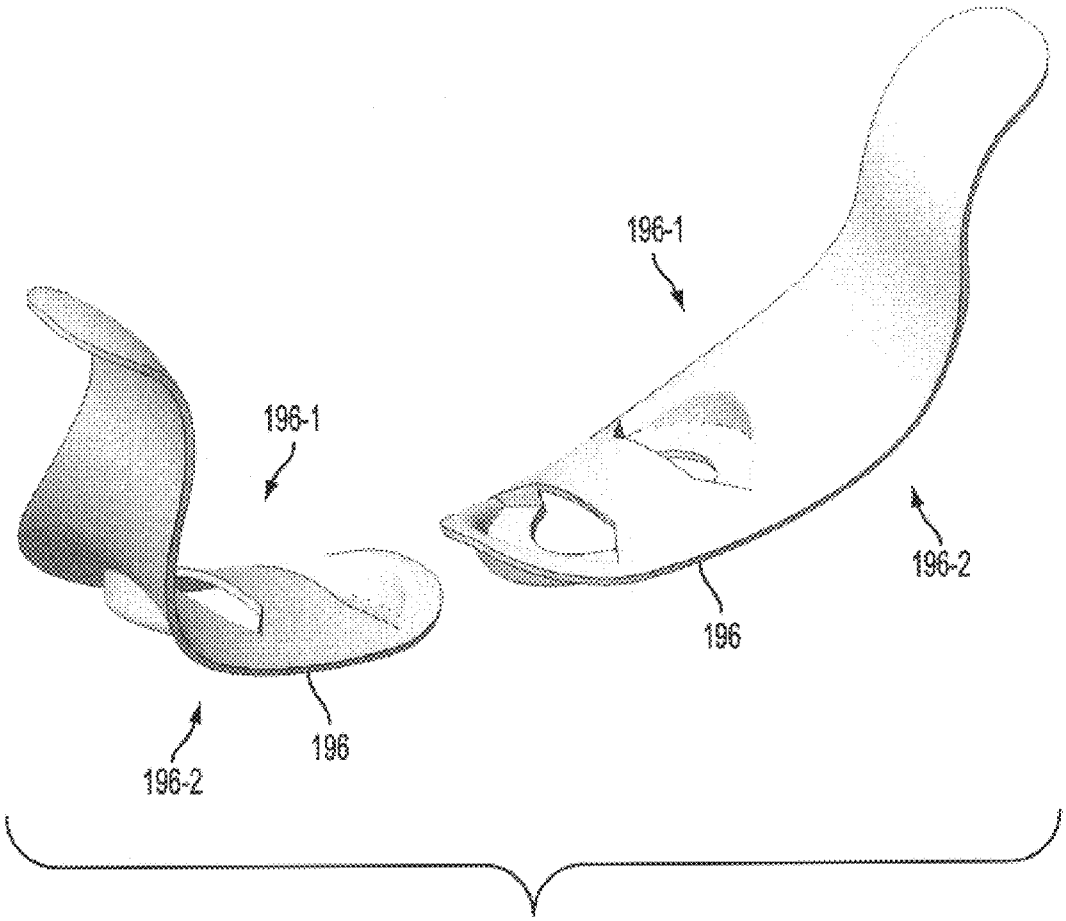
FIGS. 36A and 36B are isometric views of an embodiment of the sub-occipital plates of the present invention.
Figure 36B:
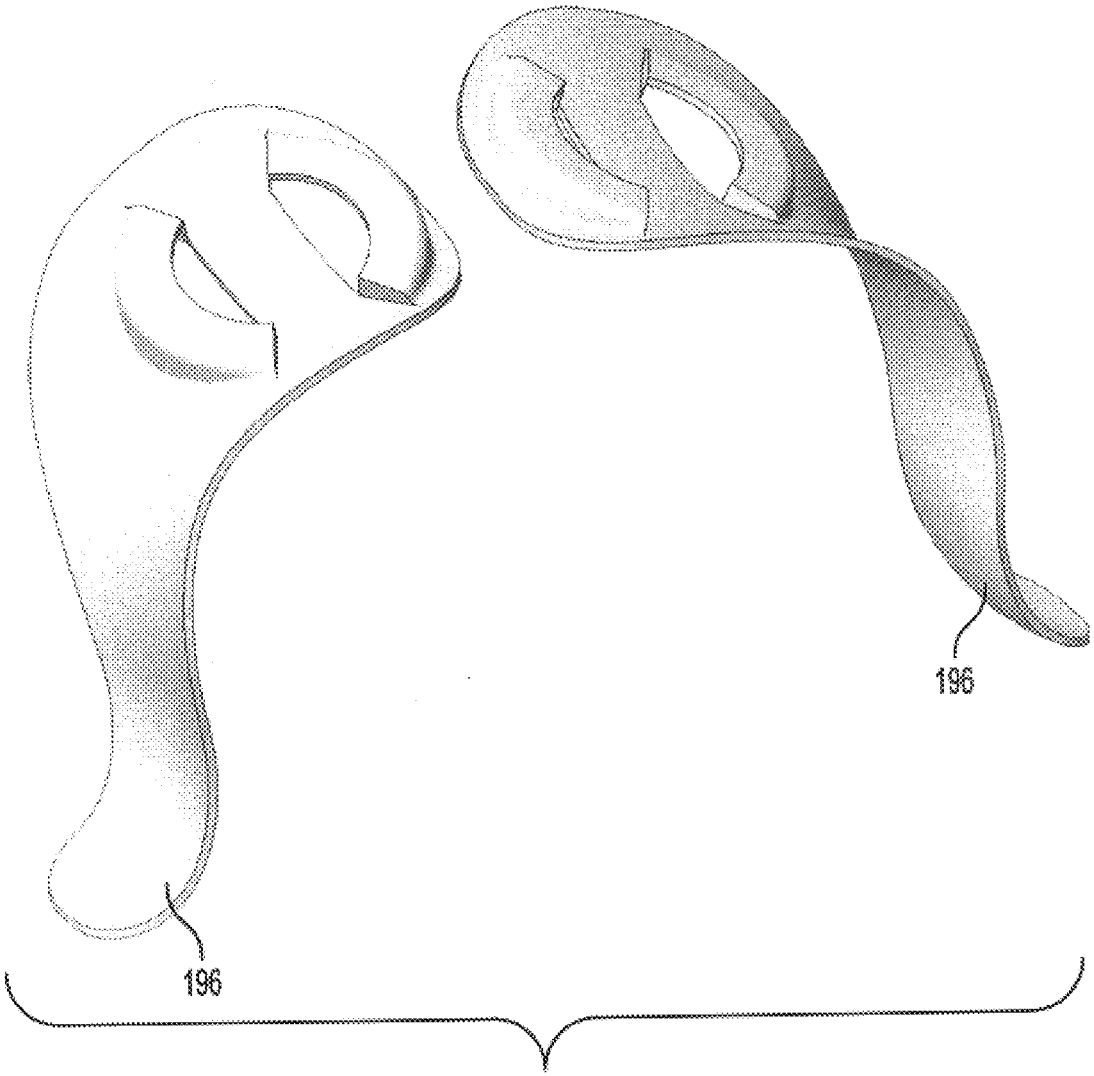

The sub-occipital support assembly 114 includes sub-occipital plates 196. FIGS. 36A and 36B are isometric views of an embodiment of the sub-occipital plates of the present invention.

The sub-occipital plates 196 each include a concave surface 196-1 and a convex surface 196-2. At least one of the concave surfaces 196-1 can be shaped such that the head of the user of the wheelchair is adequately supported. The sub-occipital plates 196 used in the sub-occipital support assembly 114 can be any suitable commercial part.

Support Structure Assembly

Figure 18:
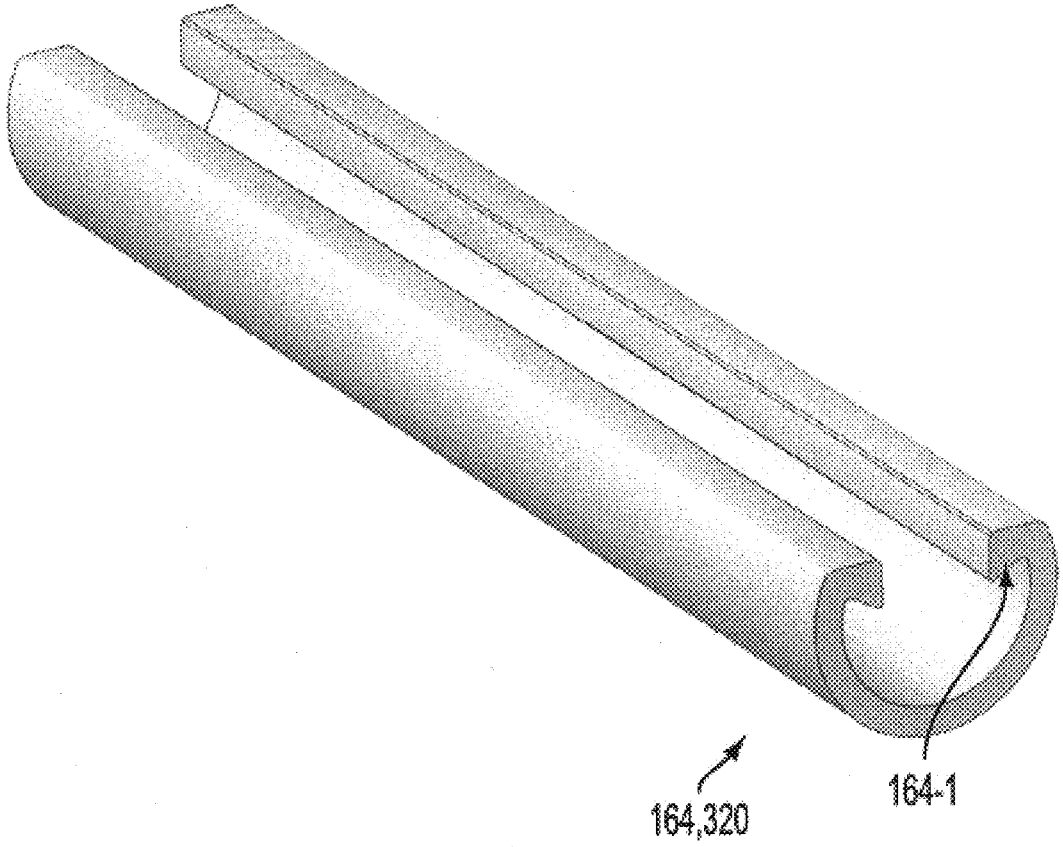
FIG. 18 is an isometric view of the horizontal channel of the present invention.
Figure 19:
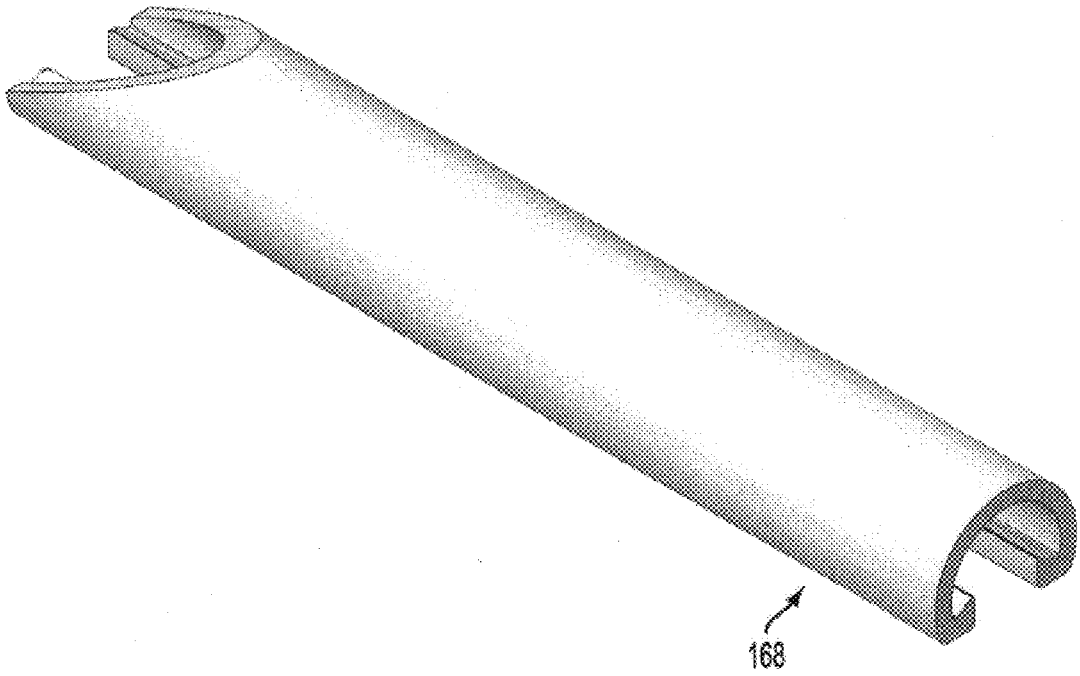
FIG. 19 is an isometric view of the vertical channel of the present invention.

The support structure assembly 116 includes a horizontal channel 164 and a vertical channel 168. FIG. 18 is an isometric view of the horizontal channel of the present invention. FIG. 19 is an isometric view of the vertical channel of the present invention. The horizontal and vertical channels 164 and 168, respectively, can have a substantially C-shaped cross section. The horizontal and vertical channels 164 and 168, respectively, can be substantially the same length or alternately different lengths. The vertical channel 168 can include an angled surface 164-1 to facilitate attachment of the horizontal and vertical channels 164 and 168, respectively. Alternately, the horizontal channel 164 can include an angled surface to facilitate attachment of the horizontal and vertical channels 164 and 168, respectively.

Figure 17:
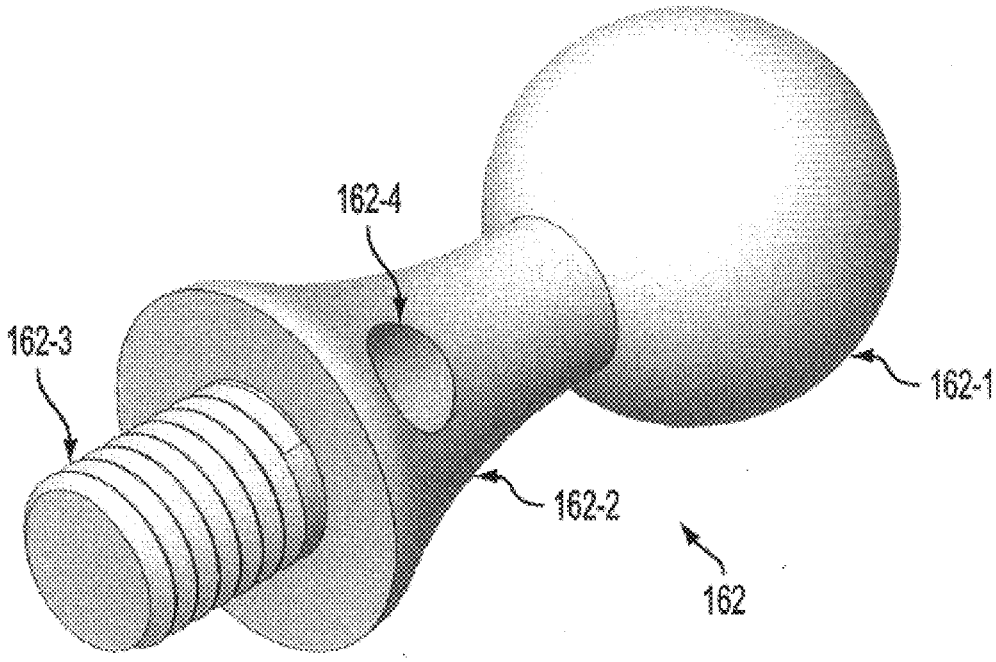
FIG. 17 is an isometric view of the ball post of the present invention.
Figure 20:
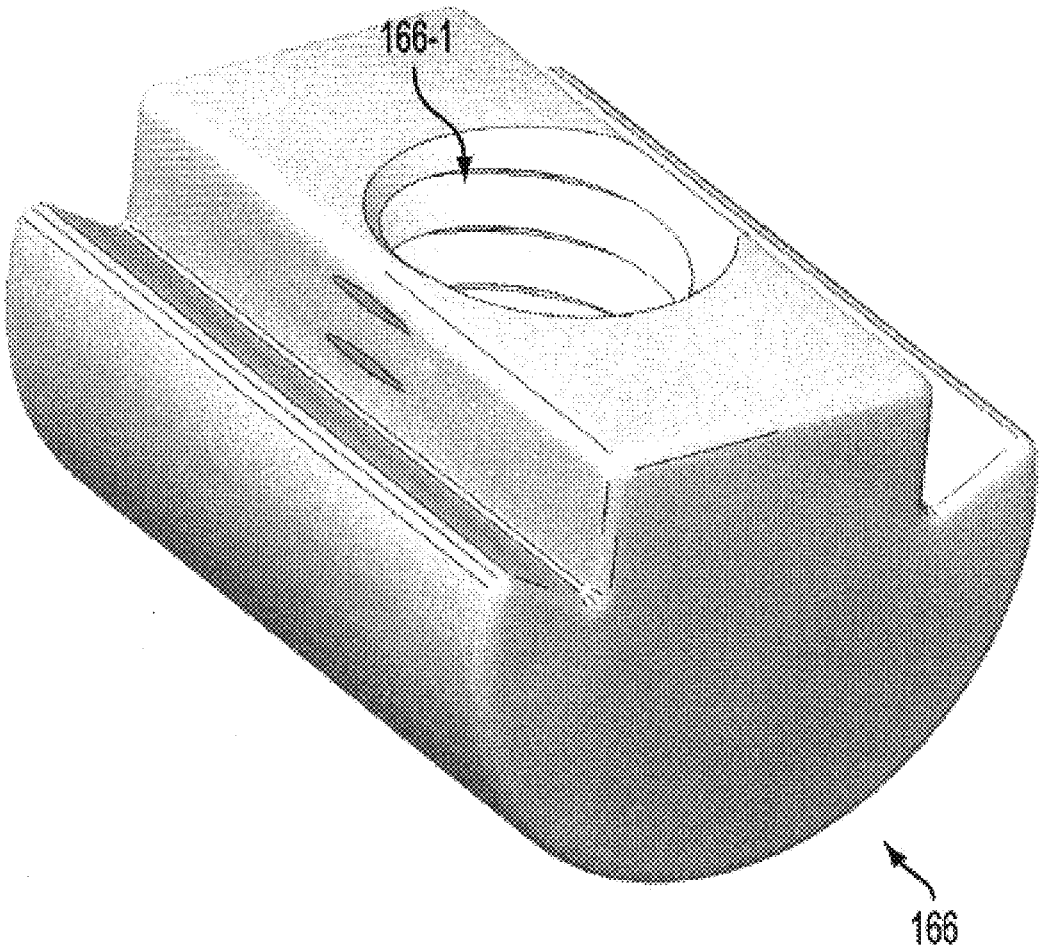
FIG. 20 is an isometric view of the slot nut of the present invention.
Figure 21:
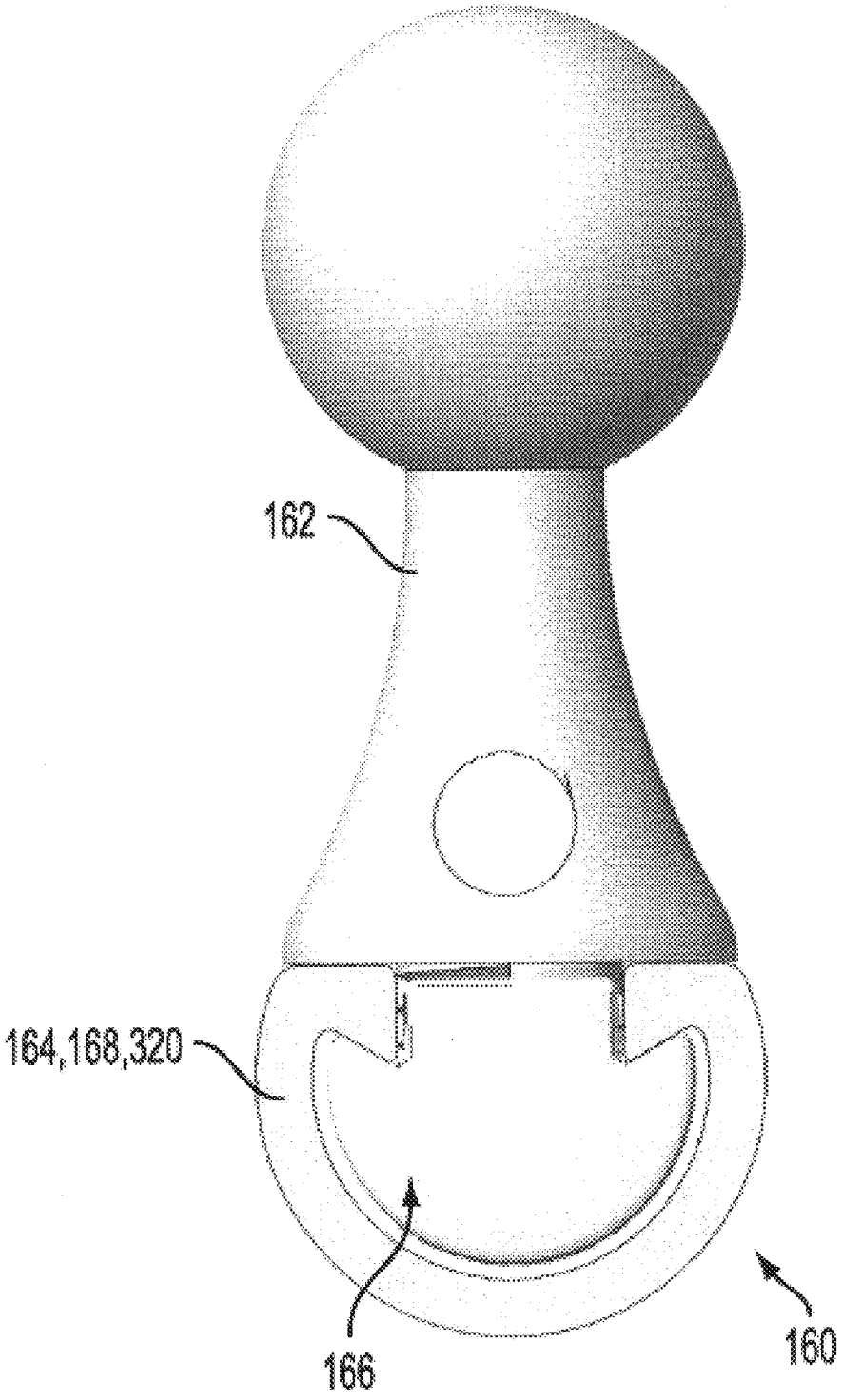
FIG. 21 is an isometric view of the ball post assembly of the present invention.

The support structure assembly 116 further includes a ball post assembly 160. The ball post assembly includes a ball post 162 and a slot nut 168. FIG. 17 is an isometric view of the ball post of the present invention. FIG. 20 is an isometric view of the slot nut of the present invention. FIG. 21 is an isometric view of the ball post assembly of the present invention.

The ball post 162 includes a swivel ball portion 162-1, a support portion 162-2, and a threaded portion 162-3. A void 162-4 is disposed in the support portion 162-2 substantially perpendicular to a centerline axis of the ball post 162.

The slot nut 166 includes an internally threaded void 166-1. The internally threaded void 166-1 is substantially sized and shaped to attachably receive the threaded portion 162-3 of the ball post 162. The slot nut 166 can have substantially the same cross section as the channels 164 and 166.

The ball post assembly 160 can be disposed within the channels 164 or 168. The slot nut 166 can be sized and shaped such that the slot nut 160 is permitted to slidingly and/or without interference move within the openings of the channels 164 or 168. Additionally, the slot nut 166 can be sized and shaped such that the slot nut 160 is permitted to travel along the threaded portion 162-3 of the ball post 162, until the slot nut 160 is substantially interfering with a portion of the channels 164 or 168. A tool (not shown) can be disposed within the void 162-4 of the ball post 162 to facilitate rotation of the ball post around an axis. By this arrangement, the ball post assembly 160 can be positioned at any of an infinite number of positions along the channels 164 or 168.

The support structure assembly 116 further includes a swivel joint 140. The swivel joint 140 includes the first swivel ring 124 and the second swivel ring 122. The swivel ball portion 162-1 of the ball post assembly 160 can be disposed between the first swivel ring contact surface 124-4 of the first swivel ring 124 and the second swivel ring contact surface 122-4 of the second swivel ring 120. The swivel joint 140 is similar to the swivel joint 120 in other respects. Swivel joints 140 can be attached to the occipital and sub-occipital support assemblies 112 and 114, respectively. By this arrangement, the occipital and sub-occipital support assemblies 112 and 114 can be removably and movably attached with the support structure assembly 116.

Figure 29A:
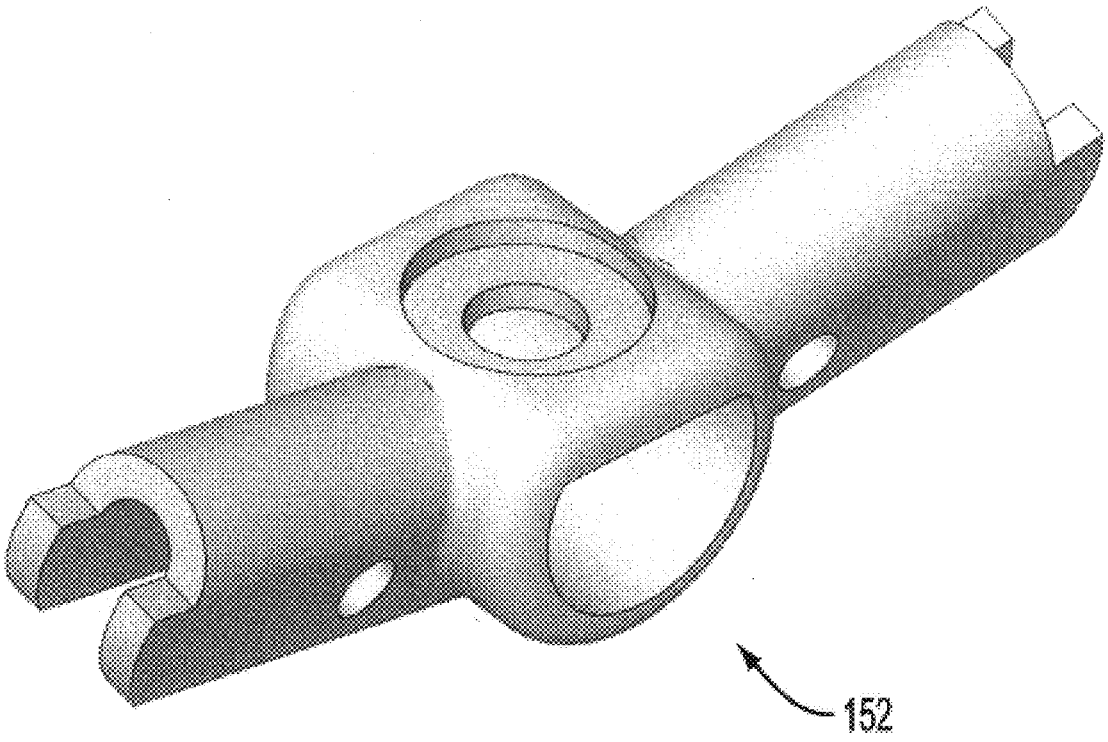
FIGS. 29A and 29B are isometric views of the swing support of the present invention.
Figure 29B:
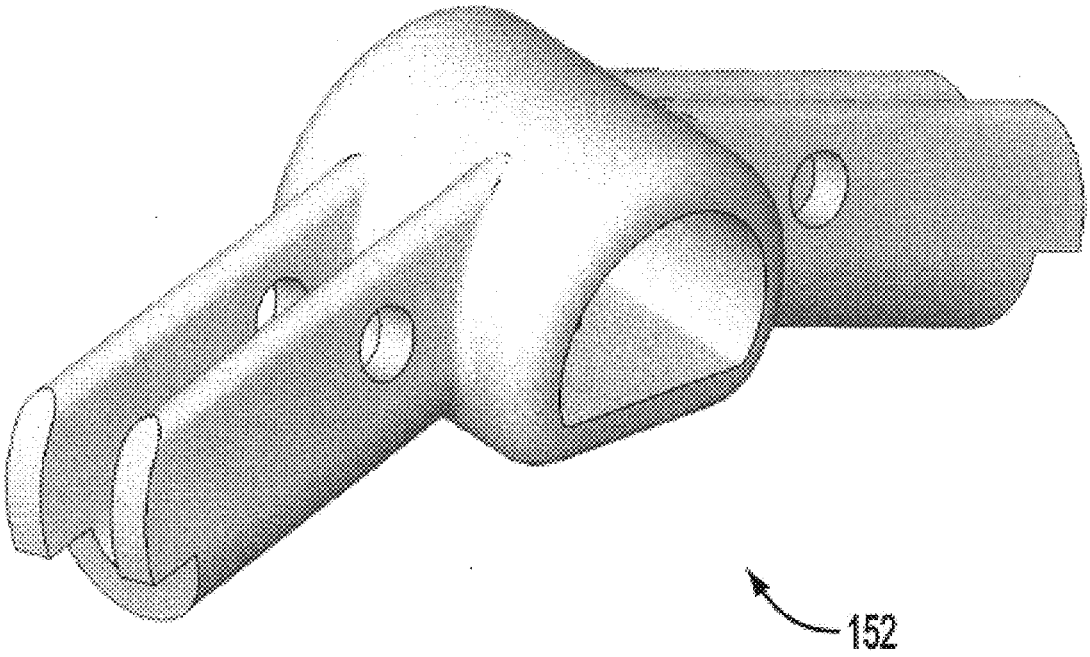
Figure 30:
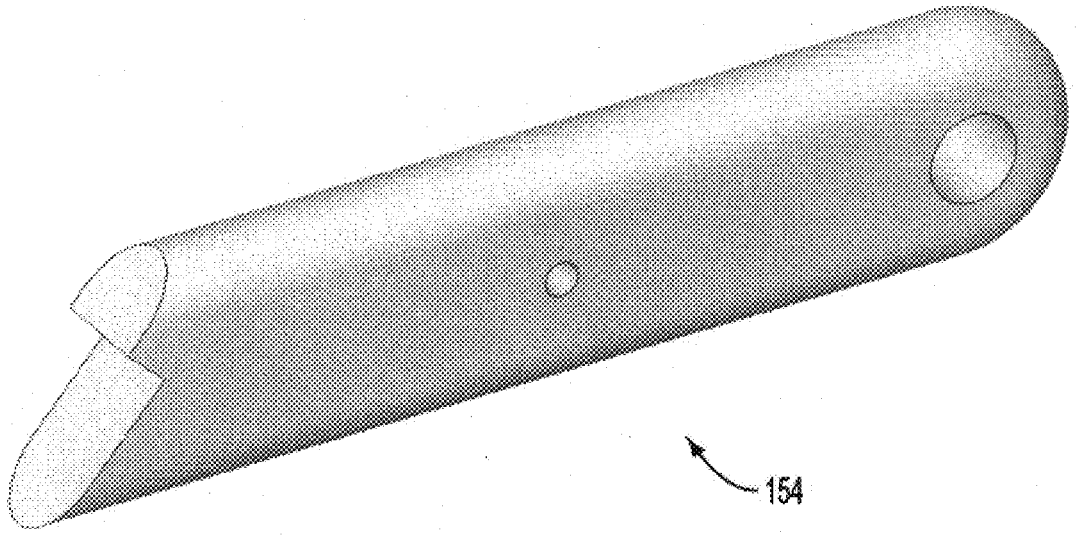
FIG. 30 is an isometric view of the swing arm of the present invention.
Figure 31A:
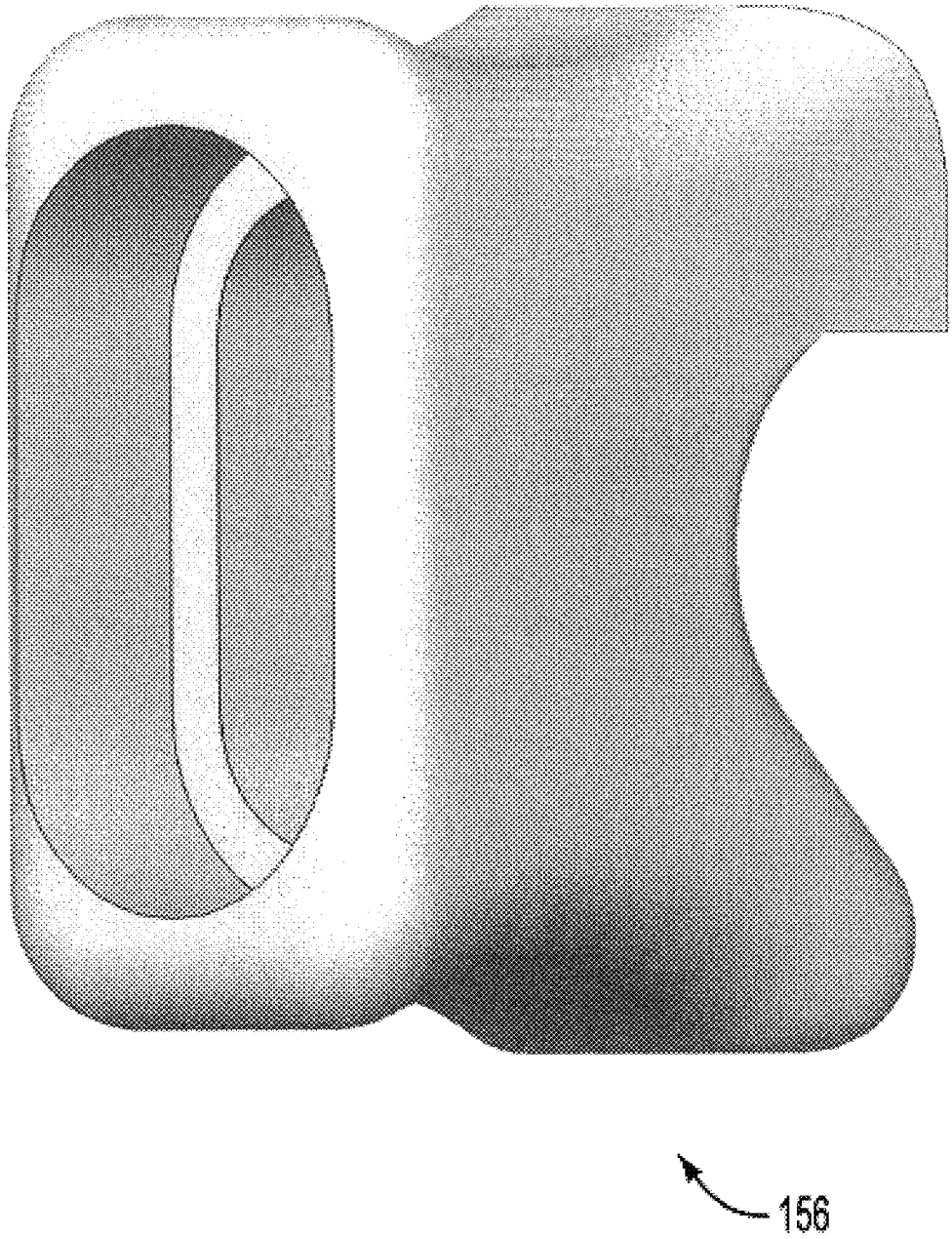
FIGS. 31A and 31B isometric views of the swing lock of the present invention.
Figure 31B:
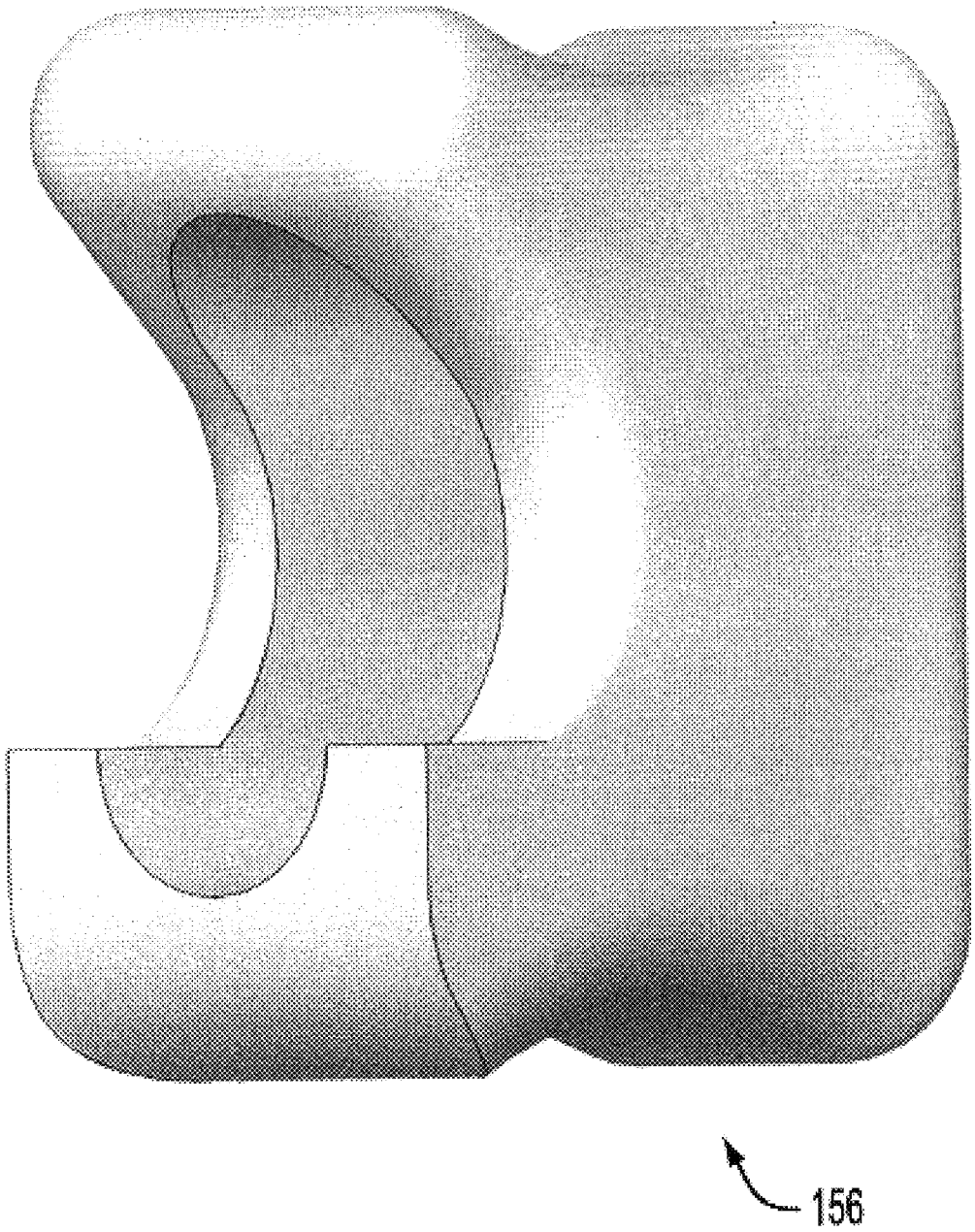
Figure 32:
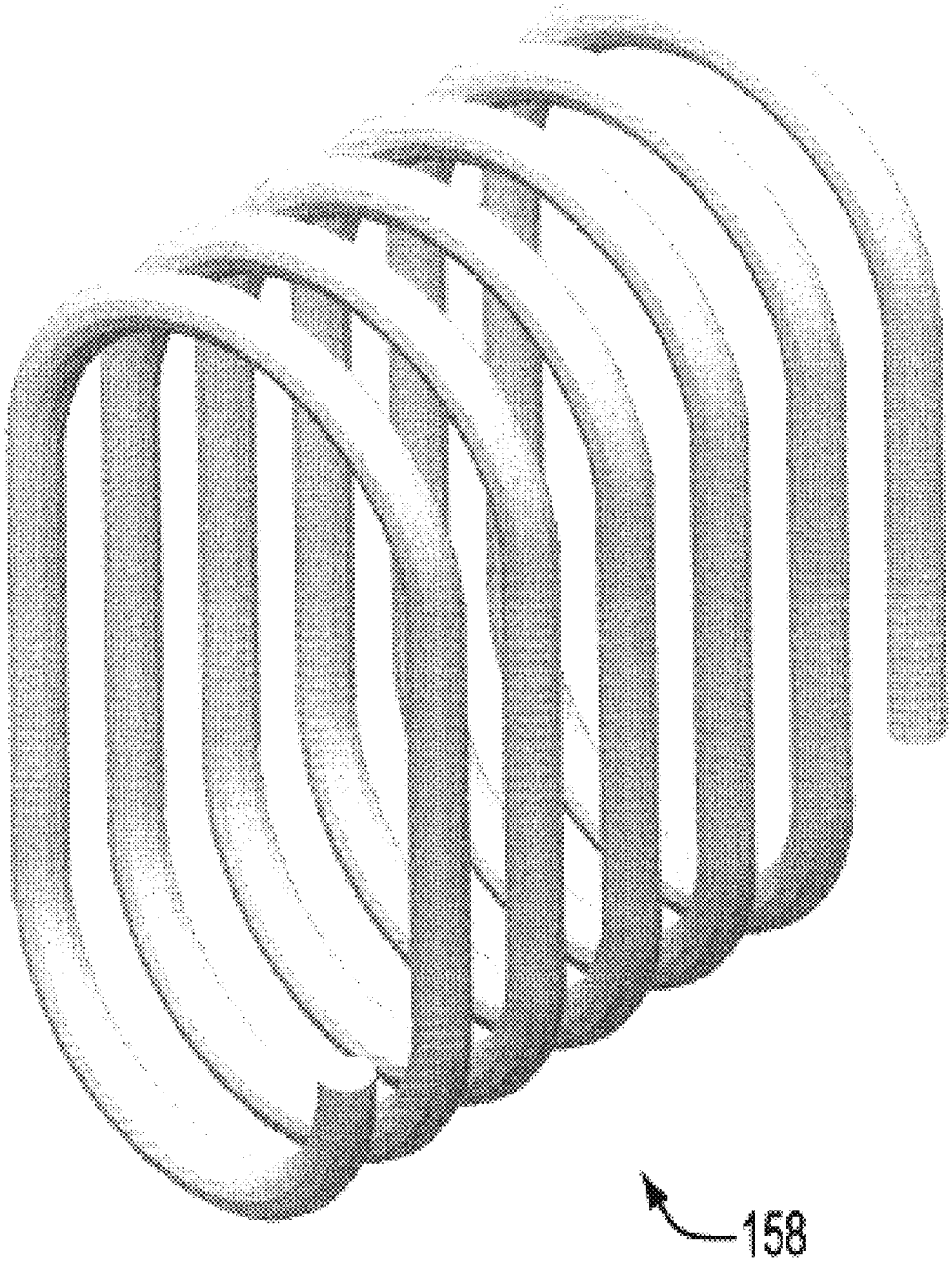
FIG. 32 is an isometric view of the swing lock spring of the present invention.
Figure 33:
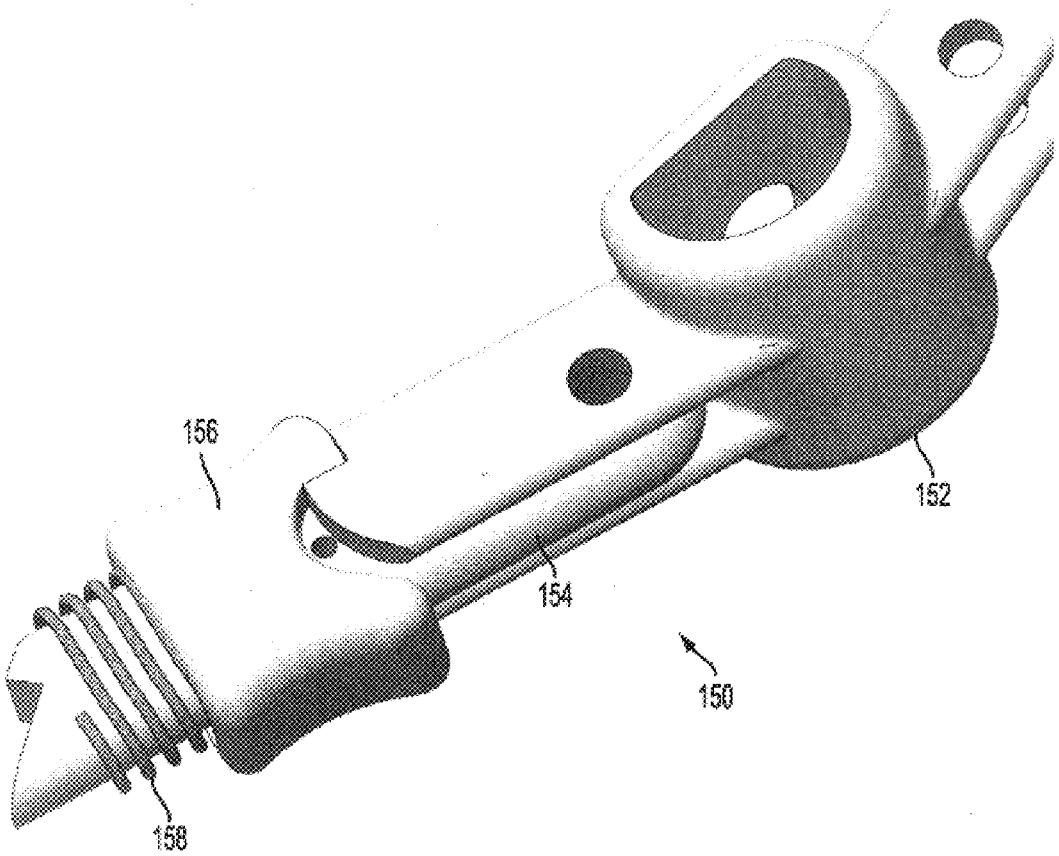
FIG. 33 is an isometric view of the swing arm assembly of the present invention.

The support structure assembly 116 further includes a swing arm assembly 150. FIGS. 29A and 29B are isometric views of the swing support of the present invention. FIG. 30 is an isometric view of the swing arm of the present invention. FIGS. 31A and 31B are isometric views of the swing lock of the present invention. FIG. 32 is an isometric view of the swing lock spring of the present invention. FIG. 33 is an isometric view of the swing arm assembly of the present invention. Swing lock 156 may be used to engage a locking surface of swing support 152 to prevent swing arm 154 from swinging. Preferably, moving swing lock 156 to compress swing lock spring 158 disengages swing lock 156 from swing support 152 and allows swing arm 154 to rotate backwards. When swing arm 154 is rotated forward, a ramp lead-in on swing support 152 may engage a corresponding ramp on swing lock 156 and force swing lock 156 to compress swing lock spring 158 so that swing lock 156 automatically engages its locking surface with the corresponding locking surface on swing support 152. The swing support 152 is disposed on an end of the vertical channel 168.

Figure 9:
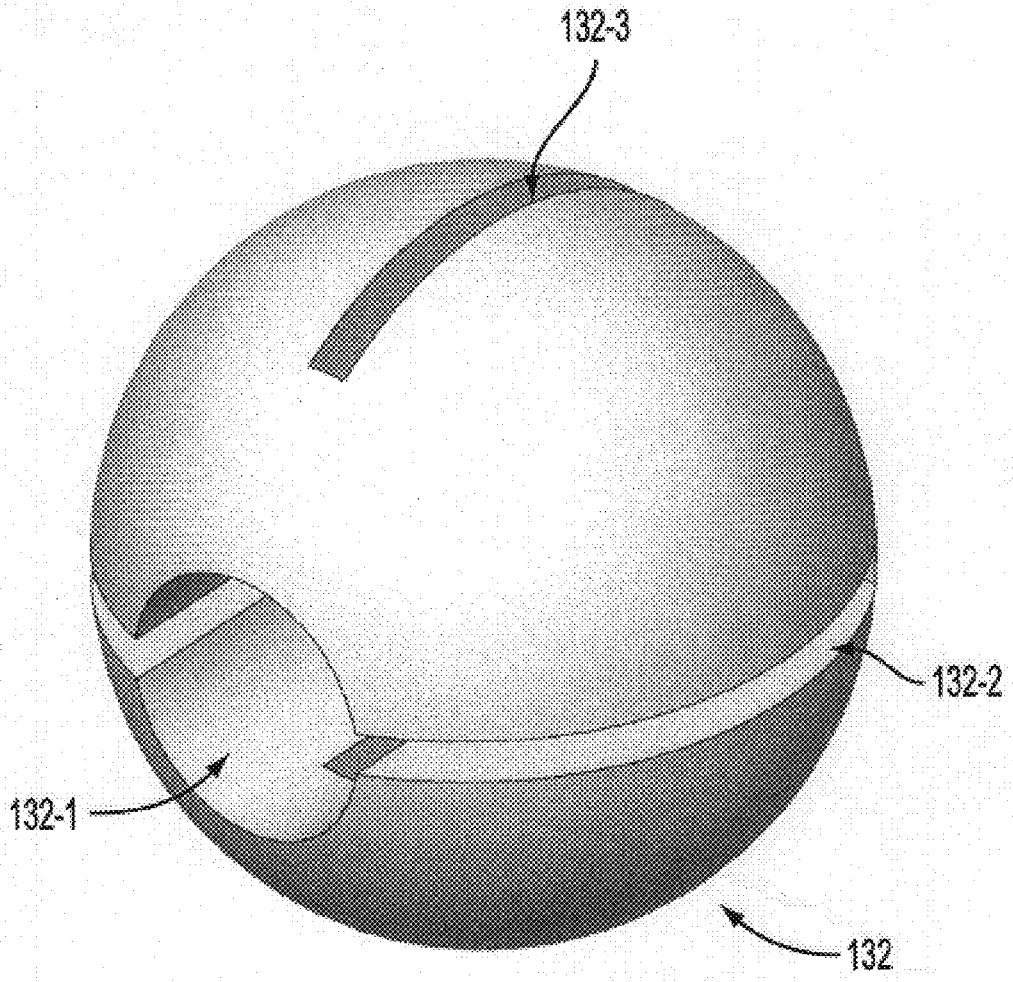
FIG. 9 is an isometric view of another embodiment of the swivel ball of the present invention.
Figure 11:
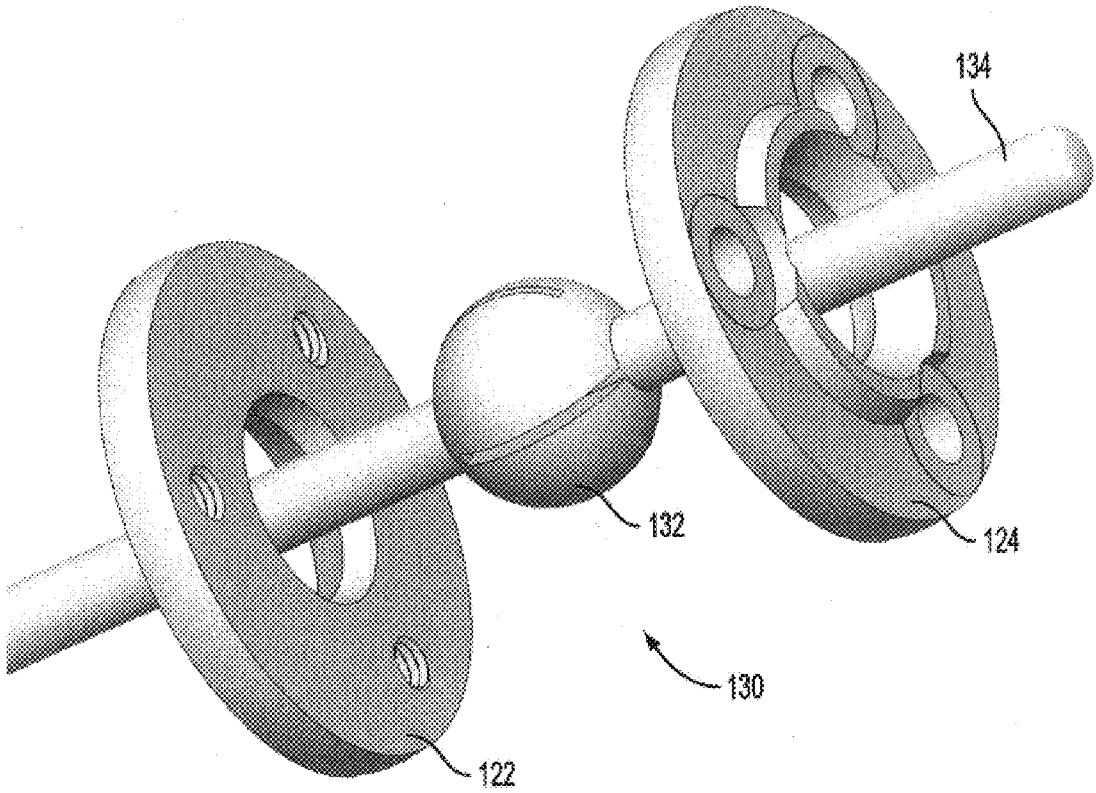
FIG. 11 is an exploded view of an alternate embodiment of the swivel joint of the present invention.

The support structure assembly 116 further includes a swivel joint 130. FIG. 9 is an isometric view of another embodiment of the swivel ball of the present invention. FIG. 11 is an exploded view of an alternate embodiment of the swivel joint of the present invention. The swivel joint 130 includes the first swivel ring 124, the second swivel ring 122, and a swivel ball 132. The swivel ball 132 includes a swivel ball central void 132-1, and first and second voids 132-2 and 132-3, respectively. The central void 132-1 can be sized and shaped to receive the second end of the temple arm 134 (discussed in detail later). Preferably, the central void 132-1 has a substantially constant radius and a centerline about coaxial with the first and second voids 132-2 and 132-3, respectively. The first void 132-2 can be formed through a middle of the swivel ball 132 and extend from a first pole of the swivel ball 132 to a depth of about ⅔ to ¾ of a maximum diameter of the swivel ball 132. The second void 132-3 can be formed through the middle of the swivel ball 132 and extend from a second pole substantially opposite the first pole of the swivel ball 132 to a depth of about ⅔ to ¾ of a maximum diameter of the swivel ball 132, substantially perpendicular to the first void 132-2. The swivel joint 130 is similar to the swivel joint 120 in other respects.

The second end of the temple arm 134 is slidably received in the central void 132-1 of the swivel ball 132. The temple arm 134 can be disposed within the central void 132-1 such that a desired length protrudes from without the swivel ball 130. As the distance between the first swivel ring 124 and the second swivel ring 122 is decreased due to tightening of the fasteners (not shown), reorientation of the swivel ball 130 is substantially prohibited. Additionally, the first and second voids 132-2 and 132-3, respectively, permit structure of the swivel ball 130 to elastically protrude into the central void 132-1. By this arrangement, an interference fit is achieved between the swivel ball 130 and the temple arm 134. The temple arm 134 is substantially prohibited from being removed from the swivel ball 130. By this arrangement, the first and second temple support assemblies 110 can be removably and movably attached with the support structure assembly 116.

Figure 22:
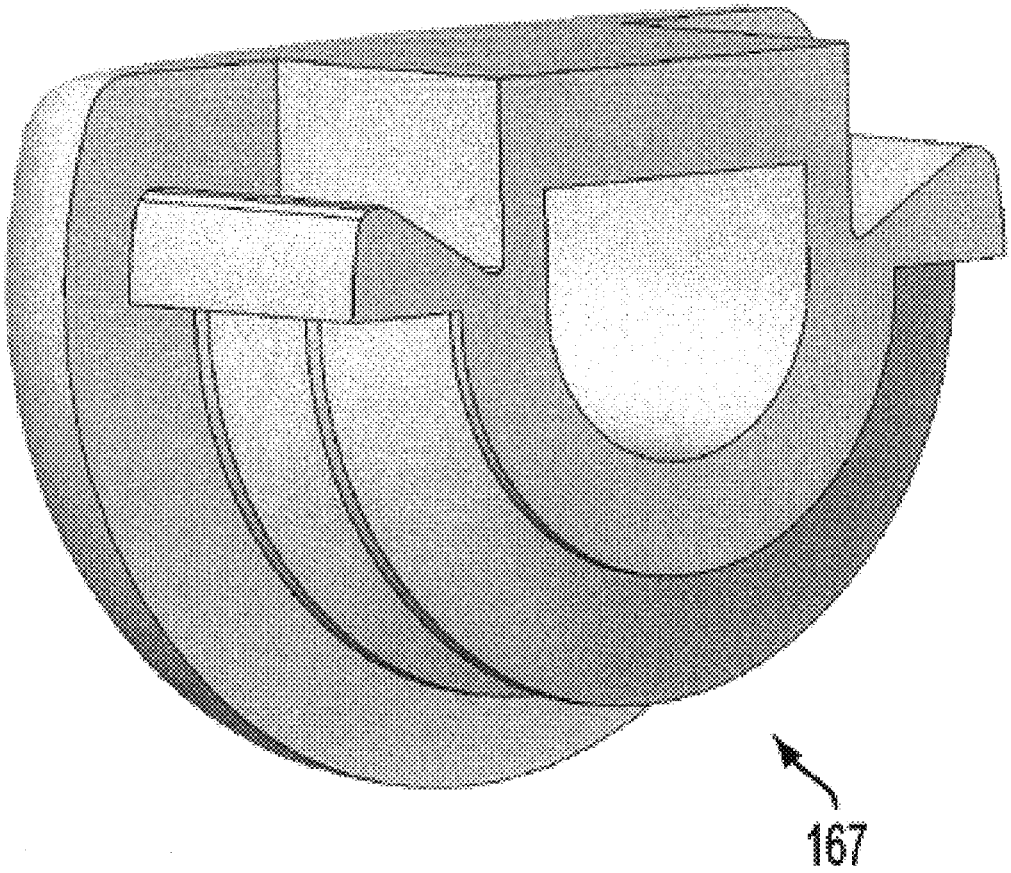
FIG. 22 is an isometric view of the end cap of the present invention.

The support structure assembly 116 can include an end cap 167. FIG. 22 is an isometric view of the end cap of the present invention. The end cap 167 can be used to cap an end of the channels 164 and/or 168.

Head Array Assembly—Second Embodiment

Figure 3:
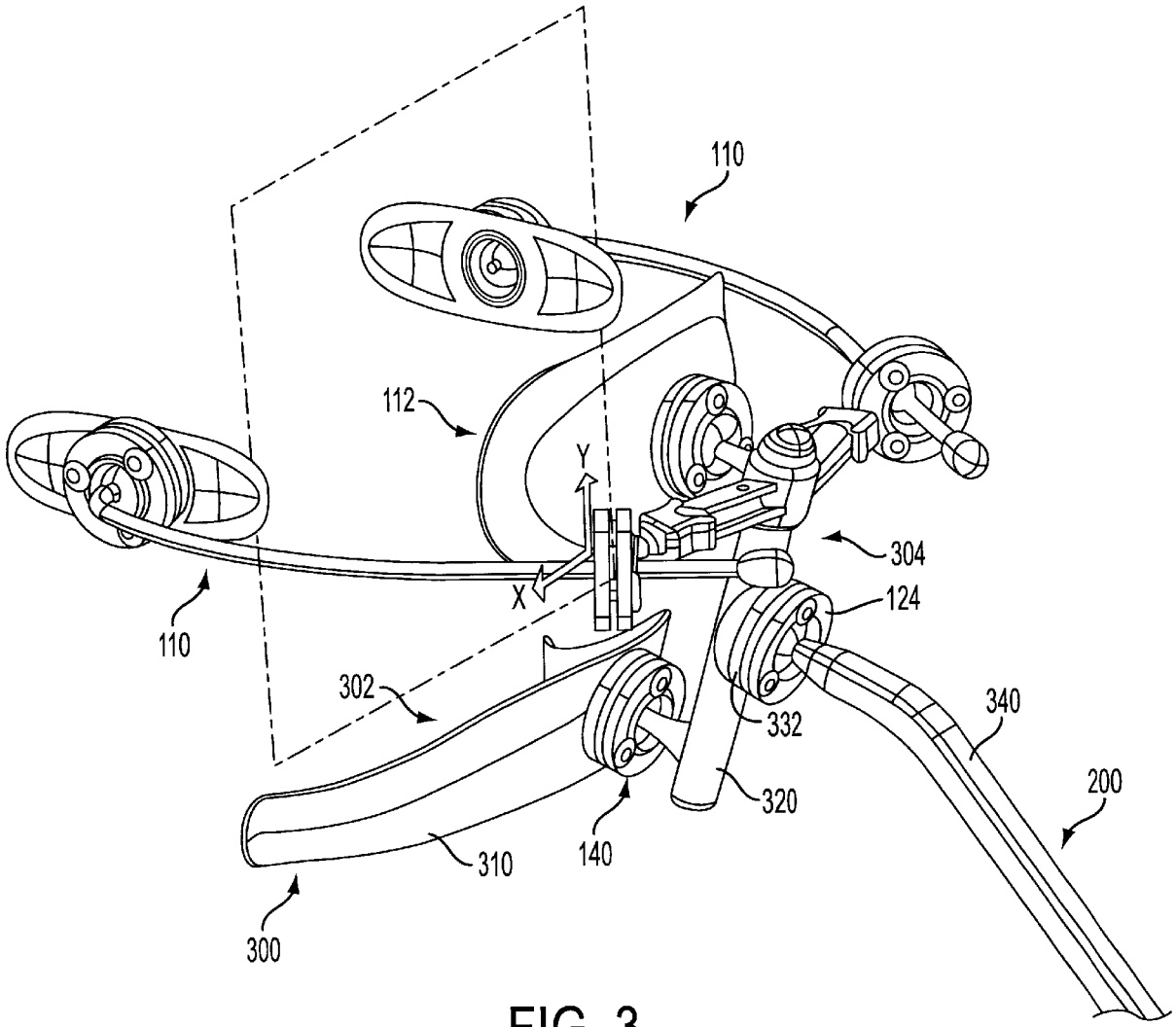
FIG. 3 is an isometric view of an alternate embodiment of the head array of the present invention.

The second embodiment of the head array assembly is the alternate head array 300. The alternate head array 300 includes the first and second temple support assemblies 110, the occipital support assembly 112, an alternate sub-occipital support assembly 302, and an alternate support structure assembly 304. FIG. 3 is an isometric view of an alternate embodiment of the head array of the present invention.

Alternate Sub-occipital Support Assembly

Figure 35A:
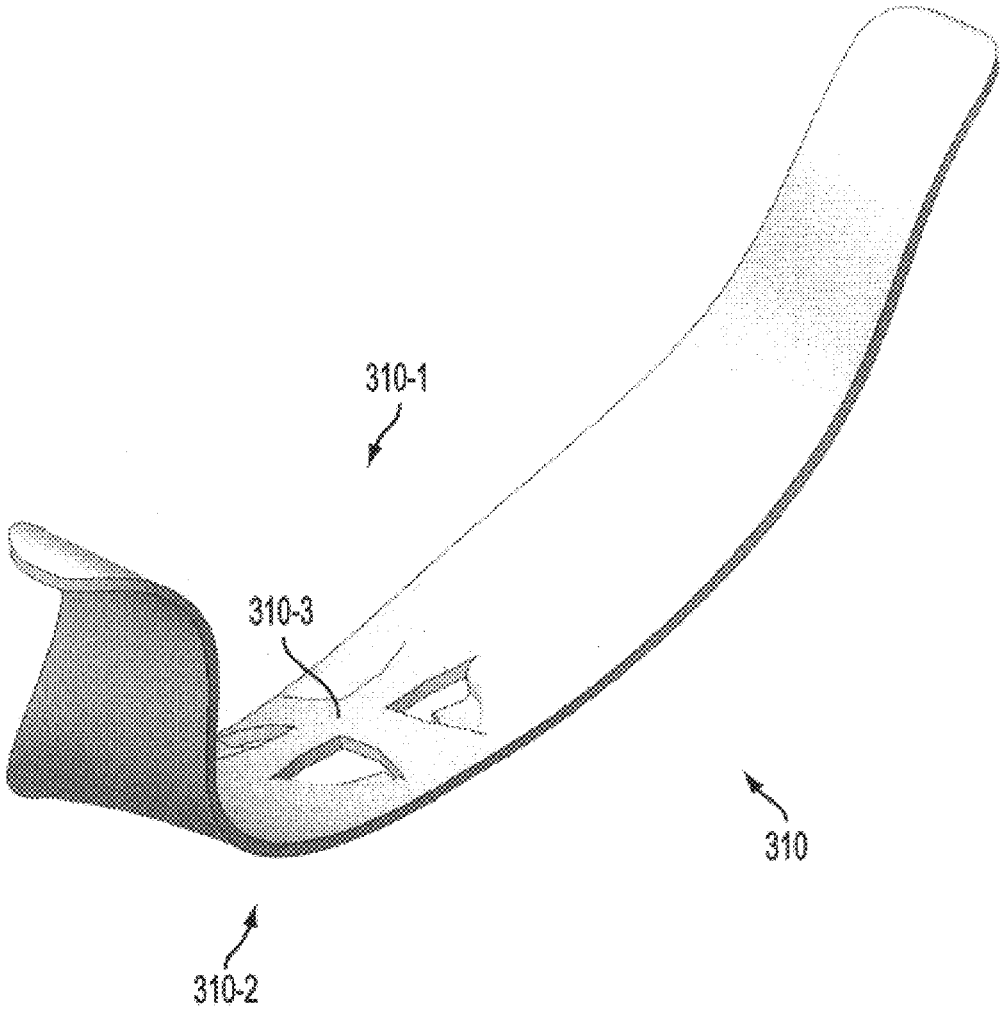
FIGS. 35A and 35B are isometric views of the sub-occipital plates of the present invention.
Figure 35B:
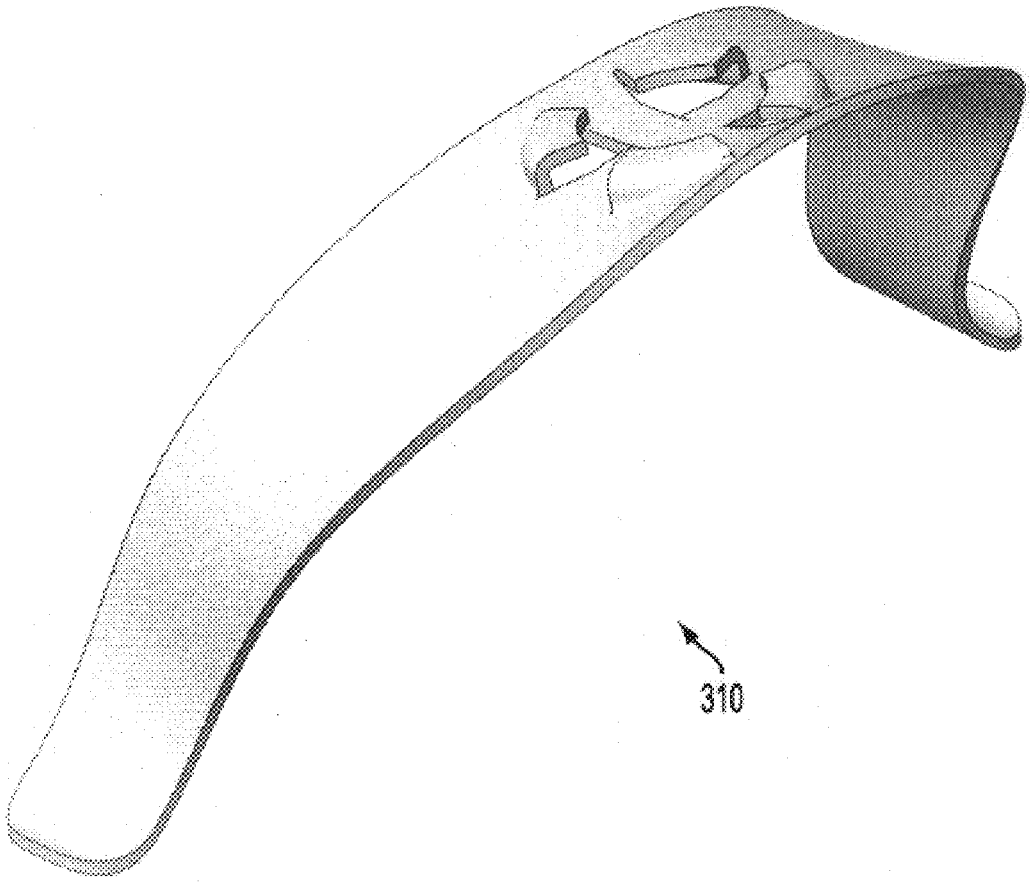

The alternate sub-occipital support assembly 302 can include a single sub-occipital plate 310. FIGS. 35A and 35B are isometric views of the sub-occipital plates of the present invention.

The sub-occipital plate 310 includes a concave surface 310-1, a convex surface 310-2, and flat regions 310-3. The concave surface 302-1 can be shaped such that the head of the user of the wheelchair is adequately supported. The flat regions can be adapted to accommodate plastic deformation, thereby permitting the user of the alternate head array 300 to obtain a desired level of support. The sub-occipital plate 310 used in the sub-occipital support assembly 310 can be any suitable commercial part.

Alternate Support Structure Assembly

The alternate support structure assembly 304 does not need a horizontal channel 164. A single ball post assembly 160 is used to secure the alternate sub-occipital support assembly 302 and the alternate support structure assembly 304.

Connecting Assembly—First Embodiment

A first embodiment of the connecting assembly is connector 200. FIG. 2 is an isometric view of the connecting assembly of the present invention. The connector 200 includes extension rods 178 and 179, an extension joint 170, ball mount 182, first and second half ball mount receivers 188 and 184, respectively, and wheelchair mounts 210, 250, or 270.

Extension Rods

Figure 23:
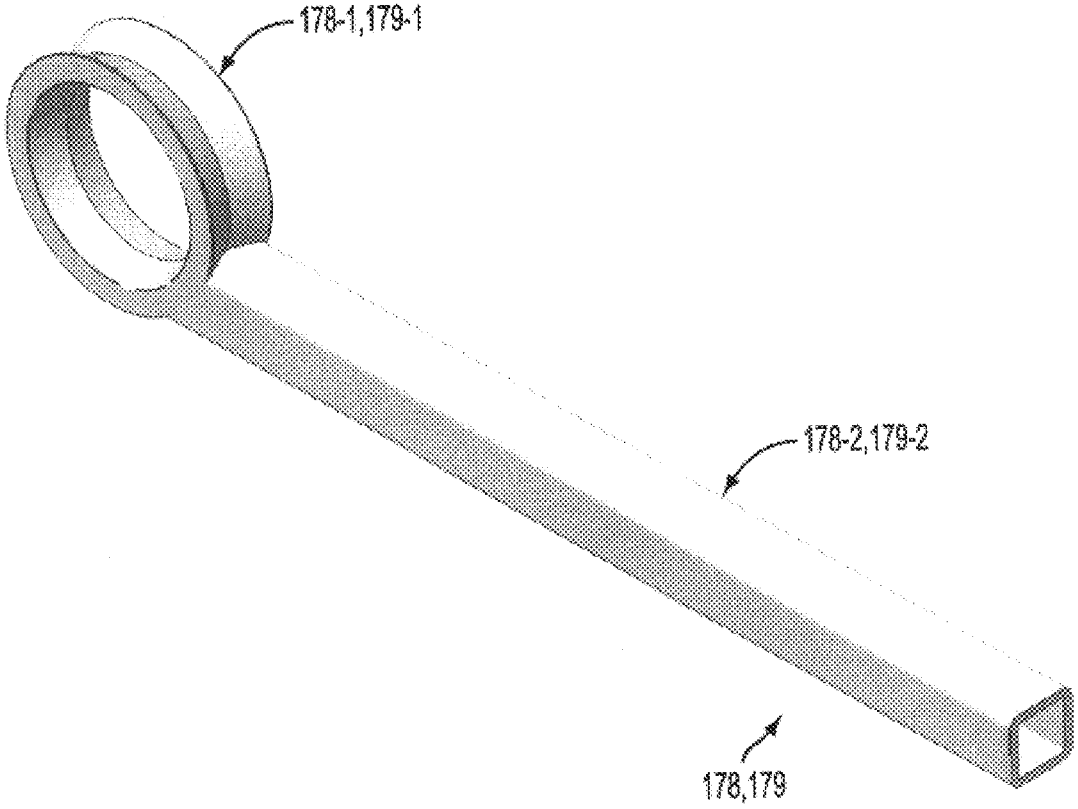
FIG. 23 is an isometric extension rod of the present invention.

The connector 200 includes the extension rods 178 and 179. FIG. 23 is an isometric view of the extension rod of the present invention. Extension rods 178 and 179 include a joint portion 178-1 and 179-1, respectively, and extension portions 178-2 and 179-2, respectively. A length of each of the extension portions 178-2 and 179-2 can differ from one another.

Extension Joint

Figure 24A:
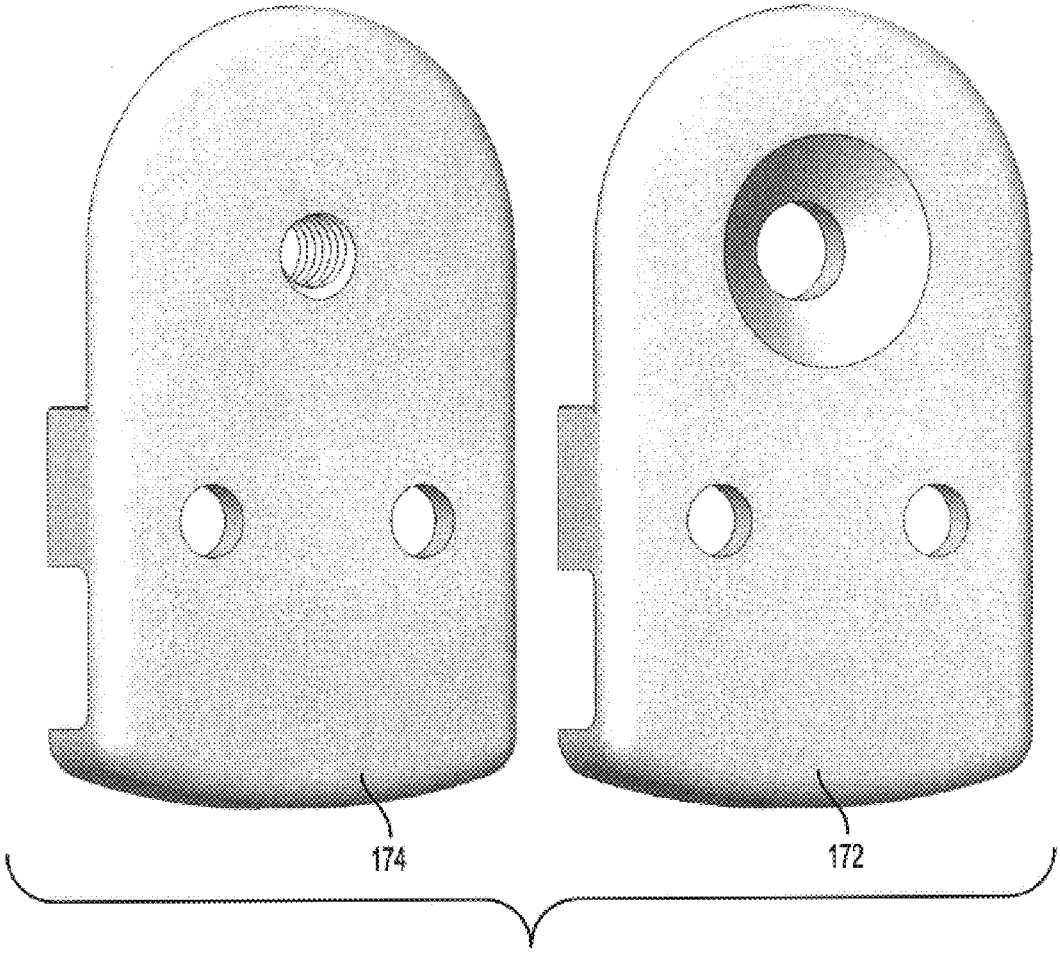
FIGS. 24A and 24B are isometric views of the first and second joint shells of the present invention.
Figure 24B:
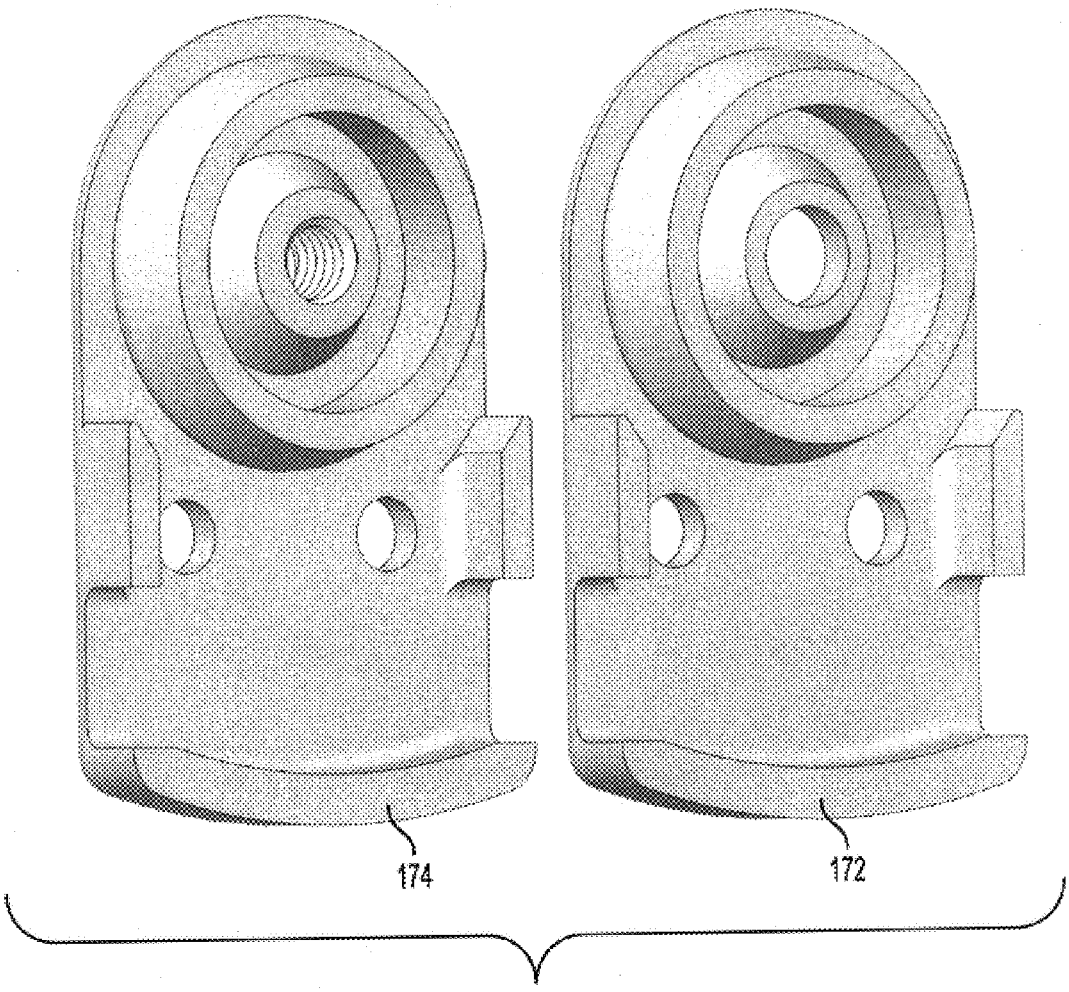
Figure 25:
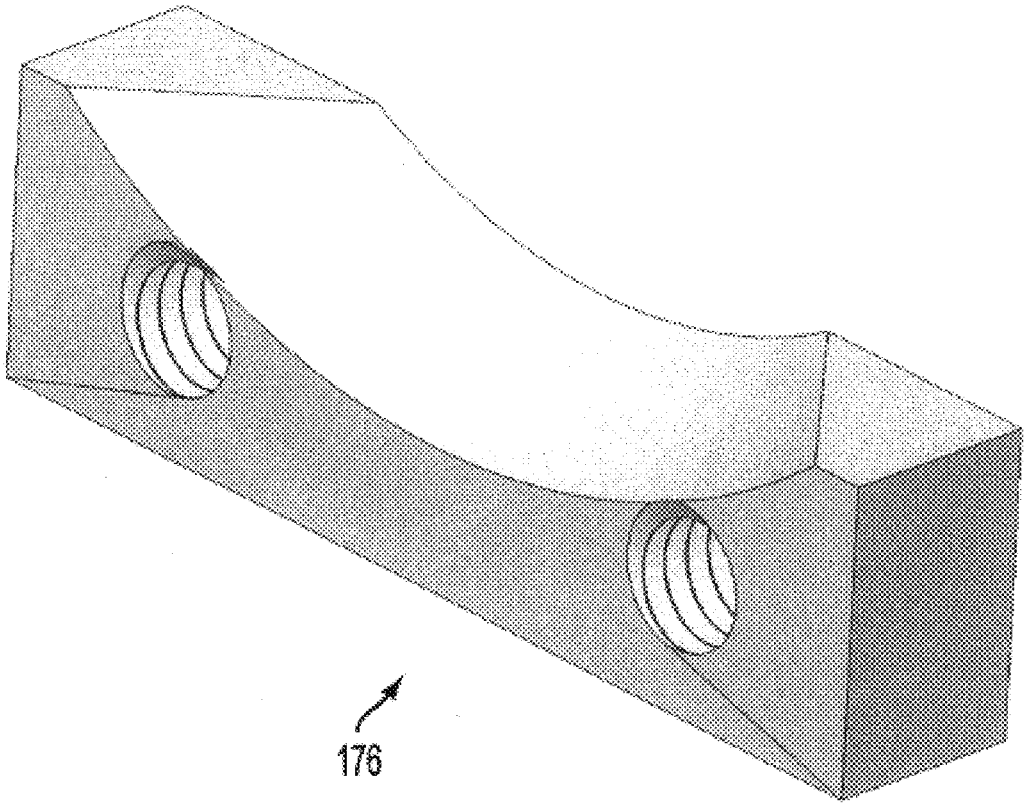
FIG. 25 is an isometric view of the wedge lock of the present invention.
Figure 26:
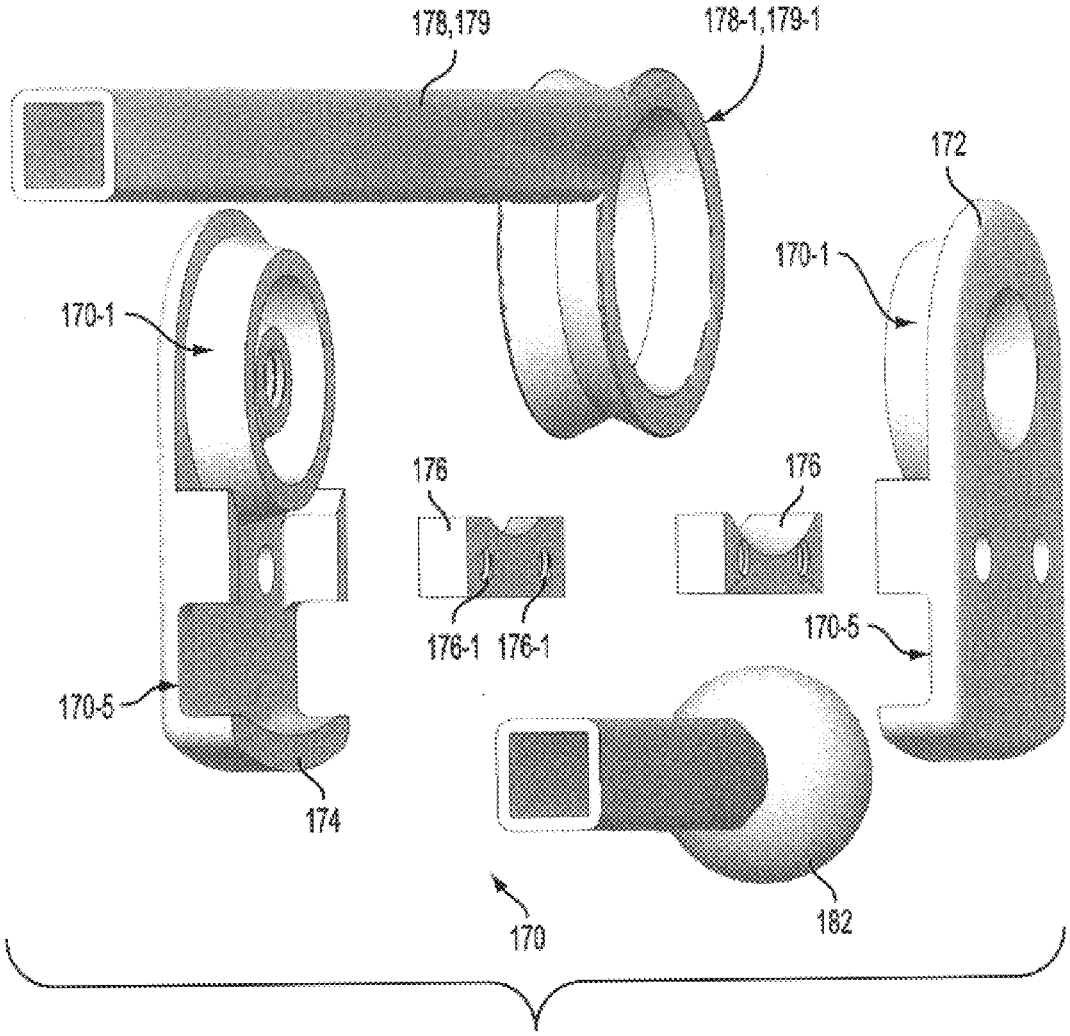
FIG. 26 is an isometric view of the extension joint of the present invention.
Figure 27:
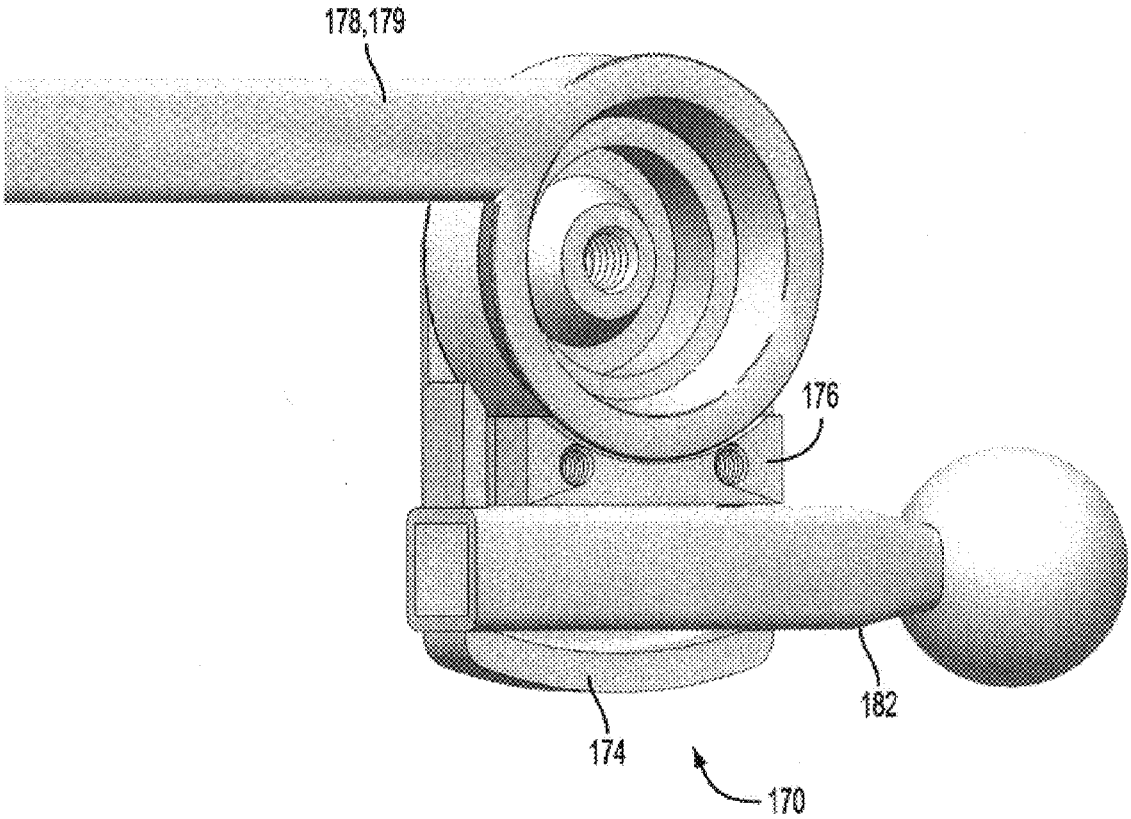
FIG. 27 is another isometric view of the extension joint of the present invention.
Figure 28:
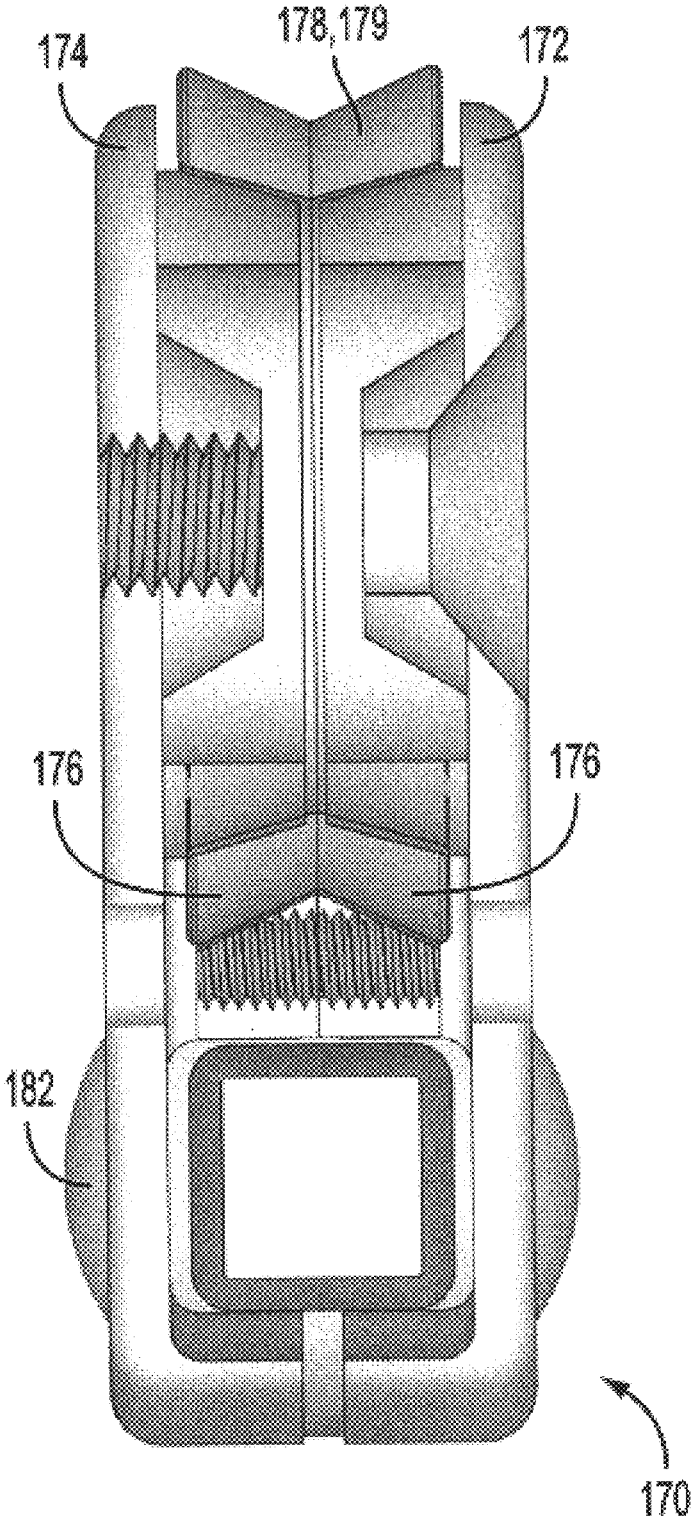
FIG. 28 is a cross-sectional view of the extension joint of the present in invention.

The extension joint 170 includes first and second joint shells 174 and 172, respectively, and a wedge lock 176. FIGS. 24A and 24B are isometric views of the first and second joint shells of the present invention. FIG. 25 is an isometric view of the wedge lock of the present invention. FIG. 26 is an isometric view of the extension joint of the present invention. FIG. 27 is another isometric view of the extension joint of the present invention. FIG. 28 is a cross-sectional view of the extension joint of the present in invention. The extension joint 170 includes first and second joint shells 174, 172 and a wedge lock 176. The first and second joint shells include rotation portions 170-1. The rotation portions 170-1 of the extension joint 170 are adapted to secure the joint portions 178-1 and 179-1 of the extension rods 178 and 179, respectively. The first and second joint shells 174 and 172 further include translation portions 170-5. The translation portions 170-5 of the extension joint 170 are adapted to secure the extension portions 178-2 and 179-2 of the extension rods 178 and 179, respectively and/or ball mount 182 (to be described in detail later).

The wedge lock 176 defines a void 176-1. The void 176-1 can be internally threaded. The first and second joint shells 174 and 172 include a fastener hole. A fastener (not shown) is inserted into the fastener holes of the first and second joint shells 174 and 172, and the void 176-1 of the wedge lock 176. By this arrangement, tightening of the fasteners urges the wedge lock 176 towards either the first or second joint shell 174 and 172, respectively, the wedge lock 176 interfering with the extension portion 178-2 and 179-2 of the extension rod 178 and 179, respectively, or the ball mount 182.

In a preferred arrangement of the connector 200, the extension rod 178 is connected to a first extension joint 170 and a second extension joint 170. The extension rod 179 is also connected to the second extension joint 170.

Ball Mount and First and Second Half Ball Mount Receiver

Figure 12:
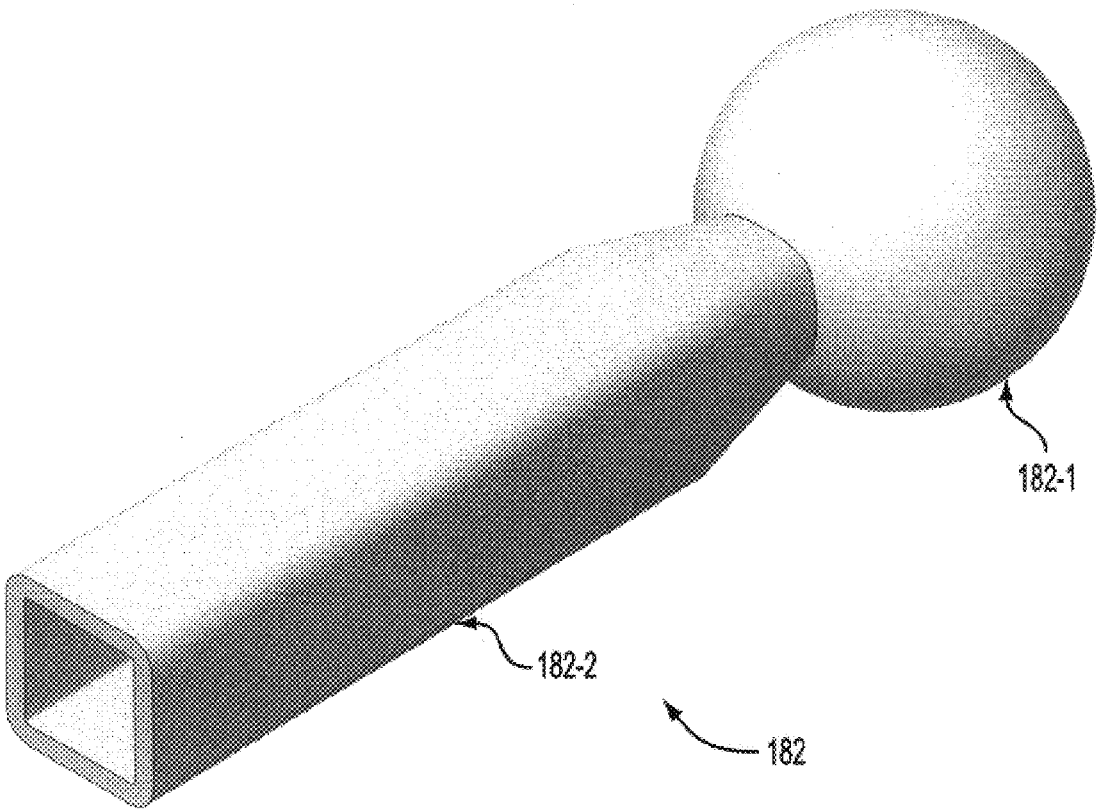
FIG. 12 is an isometric view of the ball mount of the present invention.
Figure 13A:
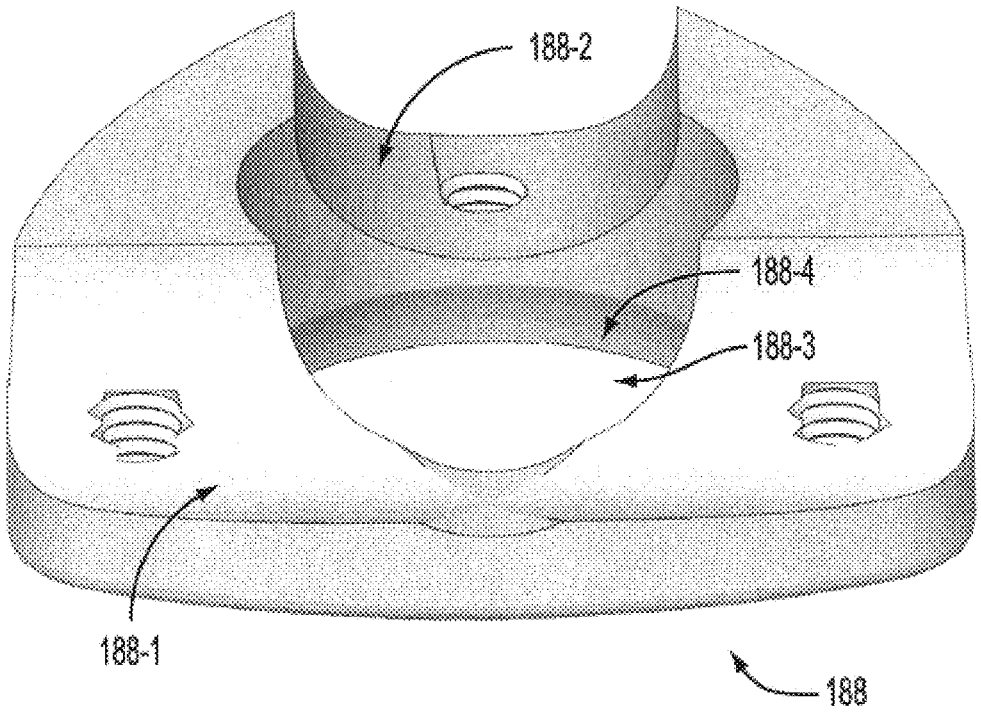
FIGS. 13A and 13B are isometric views of the first half ball mount receiver of the present invention.
Figure 13B:
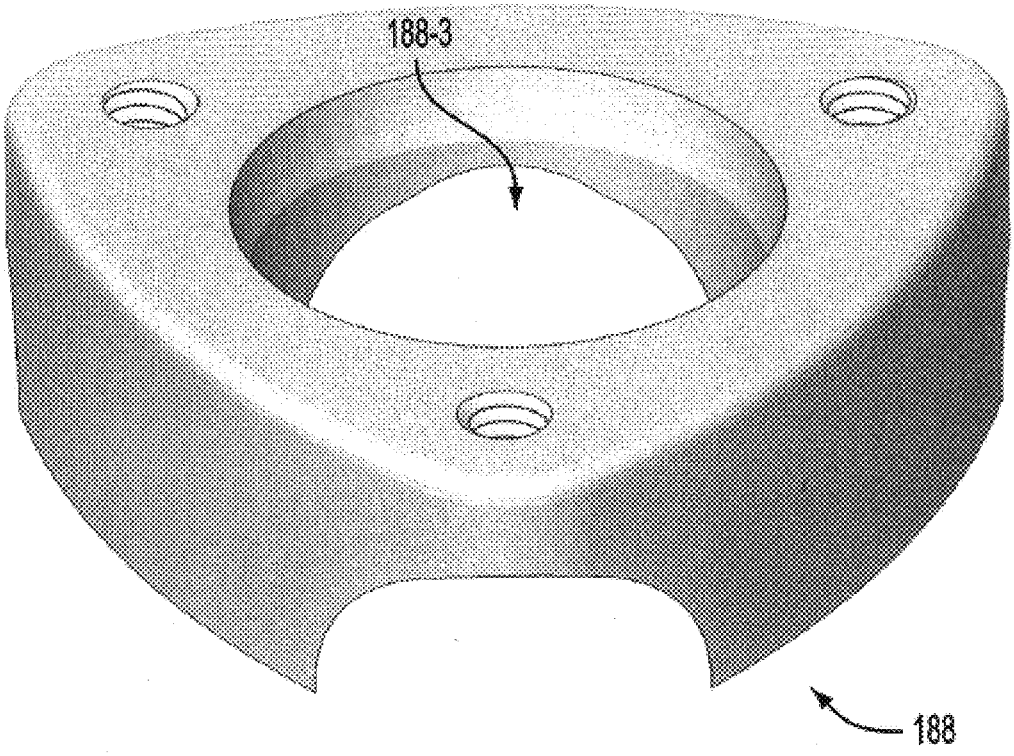
Figure 14A:
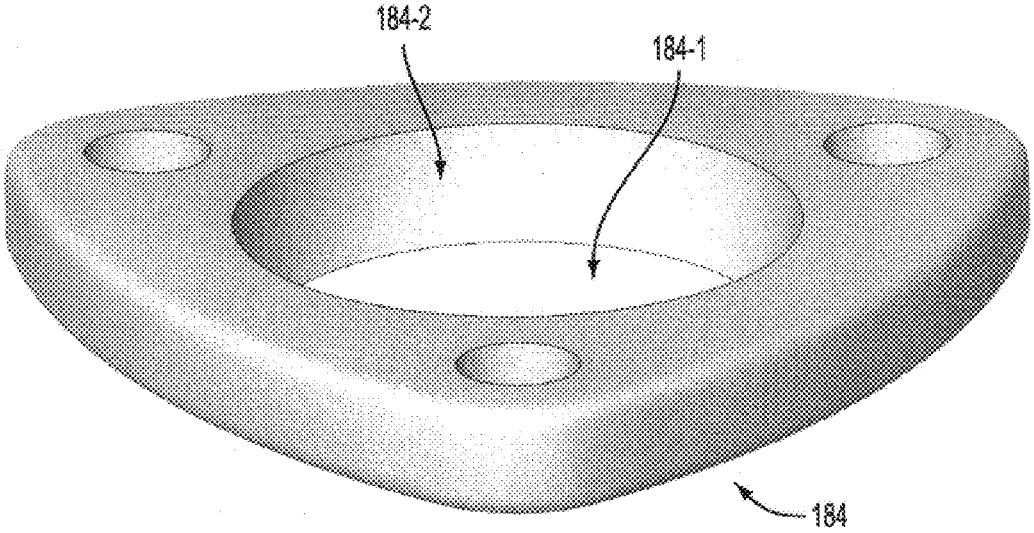
FIGS. 14A and 14B are isometric views of the second half ball mount receiver of the present invention.
Figure 14B:
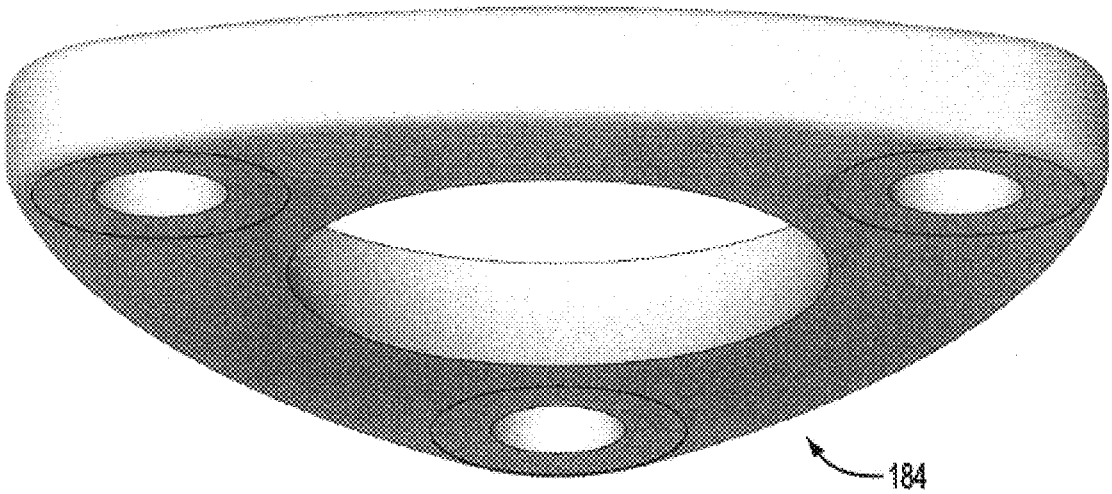

The connection between head array assembly and the connecting assembly 200 includes a ball mount 182 disposed in a ball mount receiver. FIG. 12 is an isometric view of the ball mount of the present invention. FIGS. 13A and 13B are isometric views of the first half ball mount receiver of the present invention. FIGS. 14A and 14B are isometric views of the second half ball mount receiver of the present invention. A ball mount 182 includes a ball portion 182-1 and a support portion 182-2. The ball portion 182-1 is disposed at an end of the support portion 182-2. The support portion 182-2 can be disposed in a translation portions 170-5 of the extension joint 170. A first half ball mount receiver 188 includes a first channel 188-1, a second channel 188-2, a first ball mount void 188-3, and a first ball mount contact surface 188-4. The first ball mount void 188-3 can include an internal thread. A second half ball mount receiver 184 includes a second ball mount void 184-1, and a second ball mount contact surface 184-2. The ball portion 182-1 of the ball mount 182 can be secured between the first ball mount contact surface 188-4 and the second ball mount contact surface 184-2. Fasteners (not shown) are disposed in the first ball mount void 188-3 and the second ball mount void 184-1. As the distance between the first half ball mount receiver 188 and the second half ball mount receiver 184 is decreased due to tightening of the fasteners (not shown), reorientation of the ball mount 182 is substantially prohibited.

In a preferred arrangement of the connector 200, the extension rod 178 is connected to a first extension joint 170 and a second extension joint 170. The extension rod 179 is also connected to the second extension joint 170. The support portion 182-2 of the ball mount 182 is connected to the first extension joint 170. The first and second half ball mount receivers 188 and 184 are attached to the head array assembly.

Wheelchair Mount—First Variation

Figure 38:
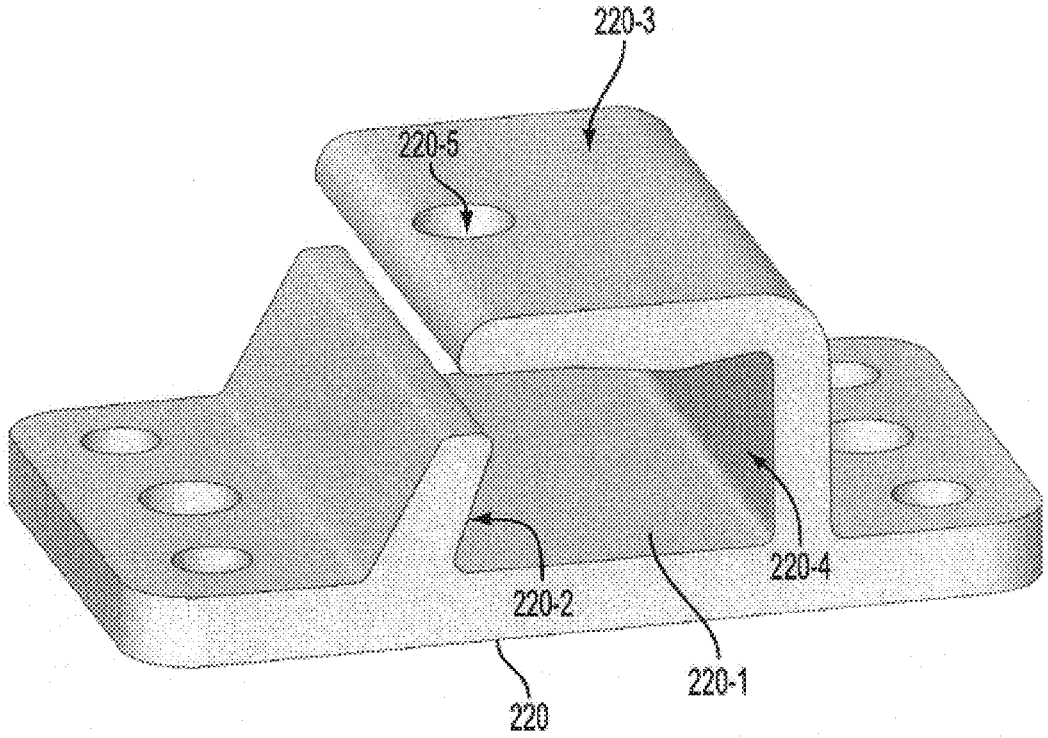
FIG. 38 is an isometric view of the mounting bracket of the present invention.
Figure 39:
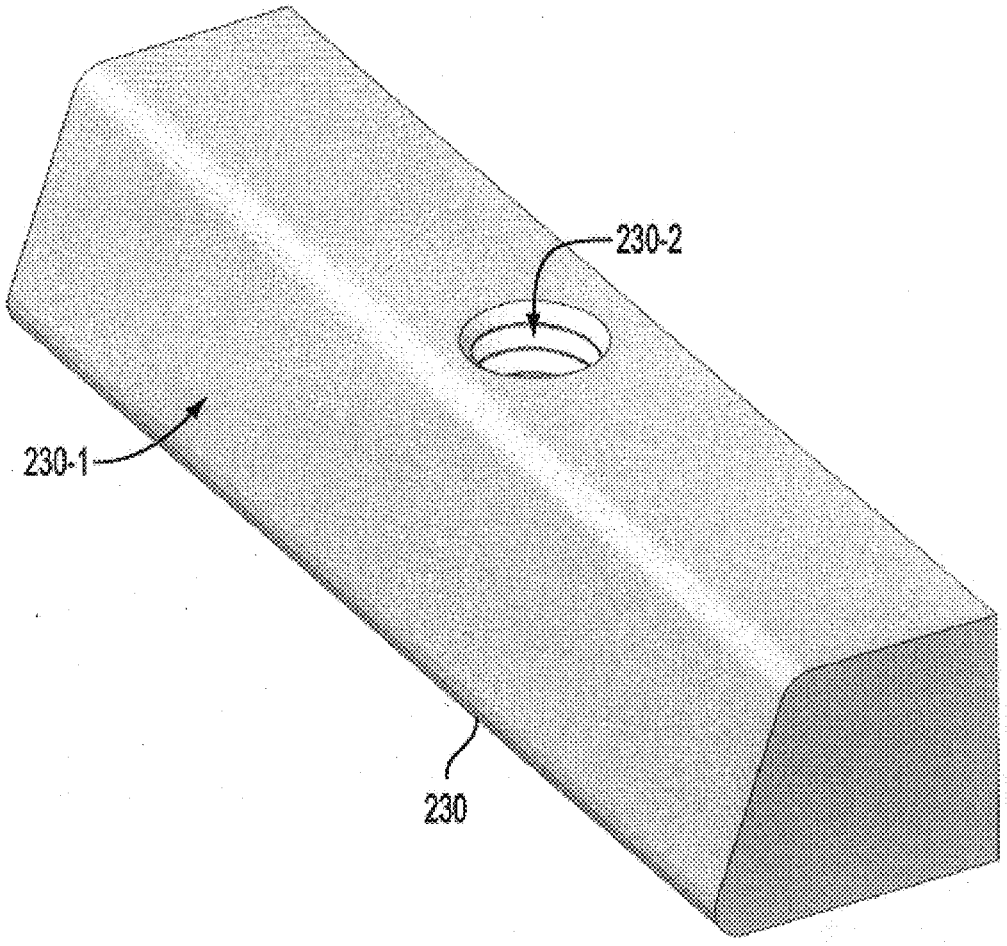
FIG. 39 is an isometric view of the mounting wedge of the present invention.
Figure 40:
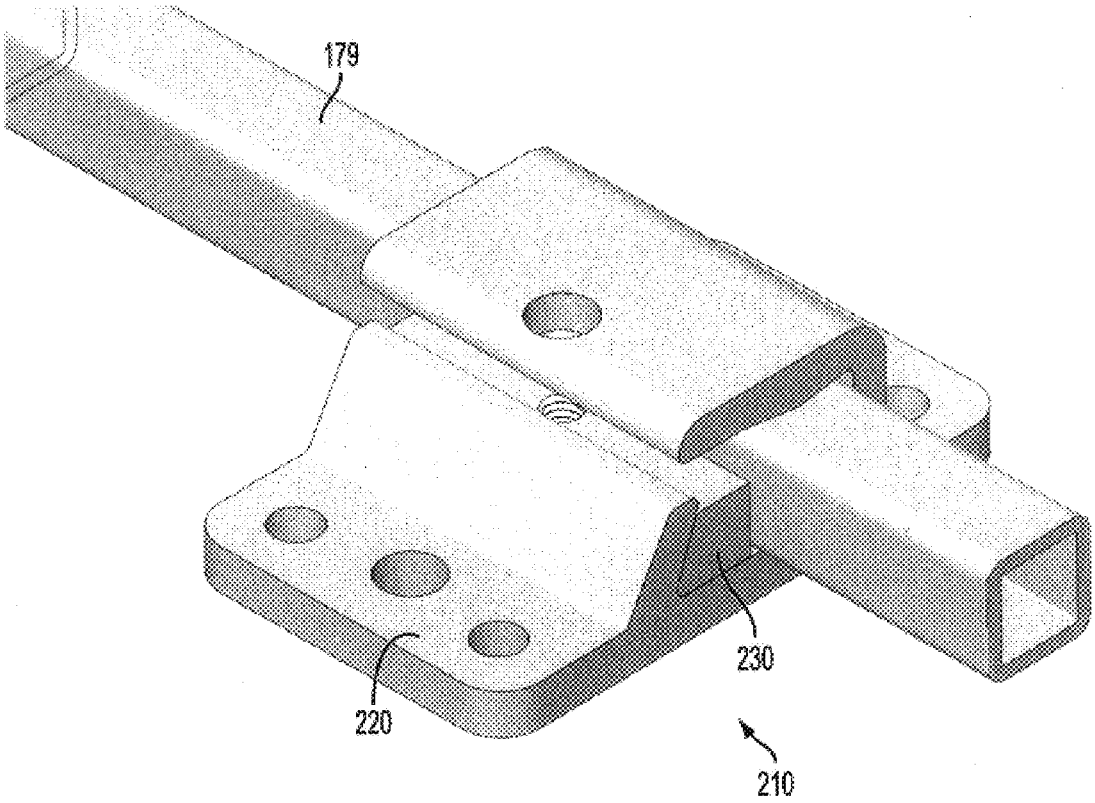
FIG. 40 is an isometric view of the wheelchair mount of the present invention.

The wheelchair mount 210 includes a mounting bracket 220 and mounting wedge 230. FIG. 38 is an isometric view of the mounting bracket of the present invention. FIG. 39 is an isometric view of the mounting wedge of the present invention. FIG. 40 is an isometric view of the wheelchair mount of the present invention. The mounting bracket 220 includes a wheelchair attachment void 220-1. The wheelchair attachment void 220-1 permits the mounting bracket 220 to be secured to the wheelchair (not shown) through the use of wheel chair fasteners.

The mounting bracket 220 further includes a wedge wall 220-2 and an extension stop 220-3. The extension stop 220-3 defines an extension rod channel 220-4. The extension stop 220-3 further includes a wedge fastener void 220-5.

The mounting wedge 230 includes a corresponding wall 230-1 and a mounting wedge fastener void 230-2. The mounting wedge 230 can be disposed in the extension rod channel 220-4 of the mounting bracket 220, such that the corresponding wall 230-1 of the mounting wedge 230 is proximate the wedge wall 220-2 of the mounting bracket 220 and the mounting wedge fastener void 230-2 of the mounting wedge 230 is operatively aligned with the wedge fastener void 220-5 of the mounting bracket 220. The extension rod 179 is also disposed in the extension rod channel 220-4 of the mounting bracket. A fastener (not shown) is disposed in the mounting wedge fastener void 230-2 of the mounting wedge 230 and the wedge fastener void 220-5 of the mounting bracket 220. By this arrangement, the mounting wedge 230 can secure the extension rod 179 within the extension rod channel 220-4 of the mounting bracket 220 when the fastener is tightened. Thus, the extension rod 179 can be substantially secured within the mounting bracket 220.

Wheelchair Mount—Second Variation

Figure 41:
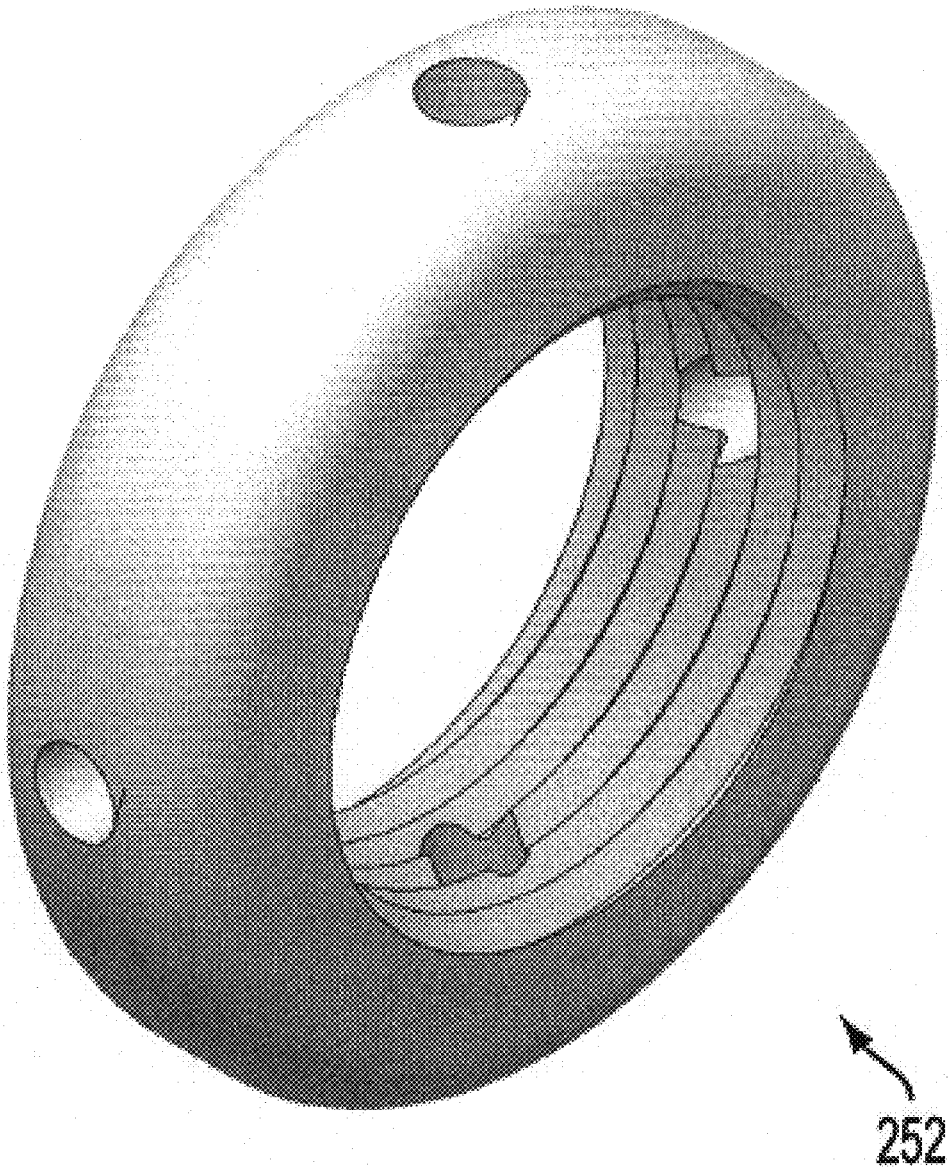
FIG. 41 is an isometric view of the release ring of the present invention.
Figure 42A:
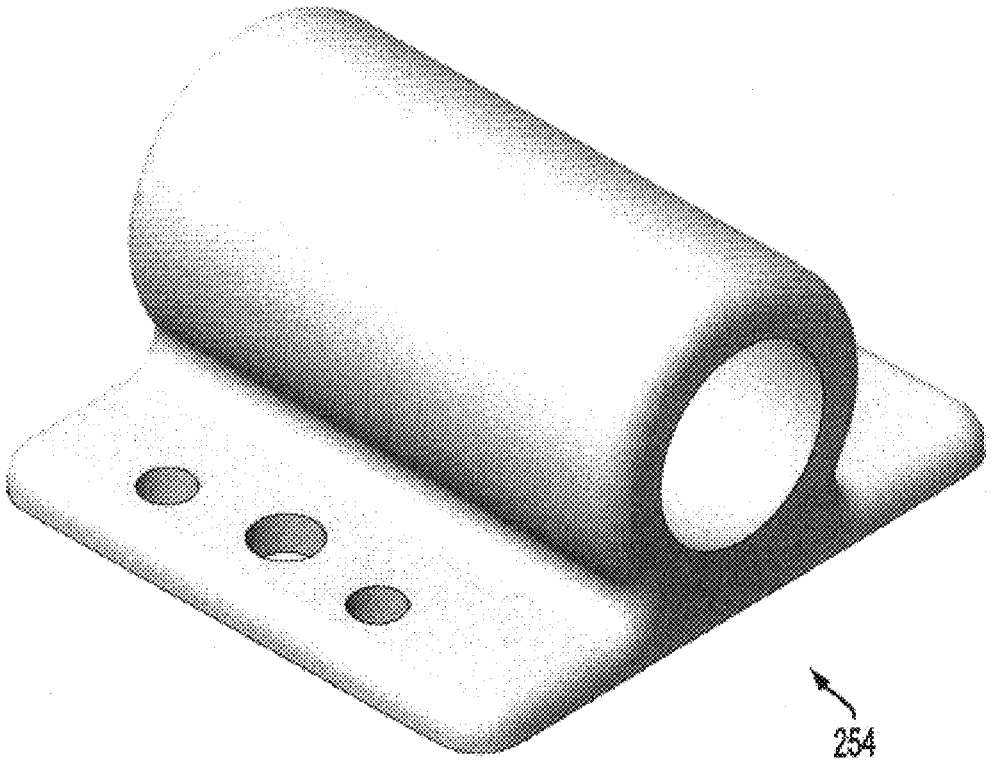
FIGS. 42A and 42B are isometric views of the mounting collet of the present invention.
Figure 42B:
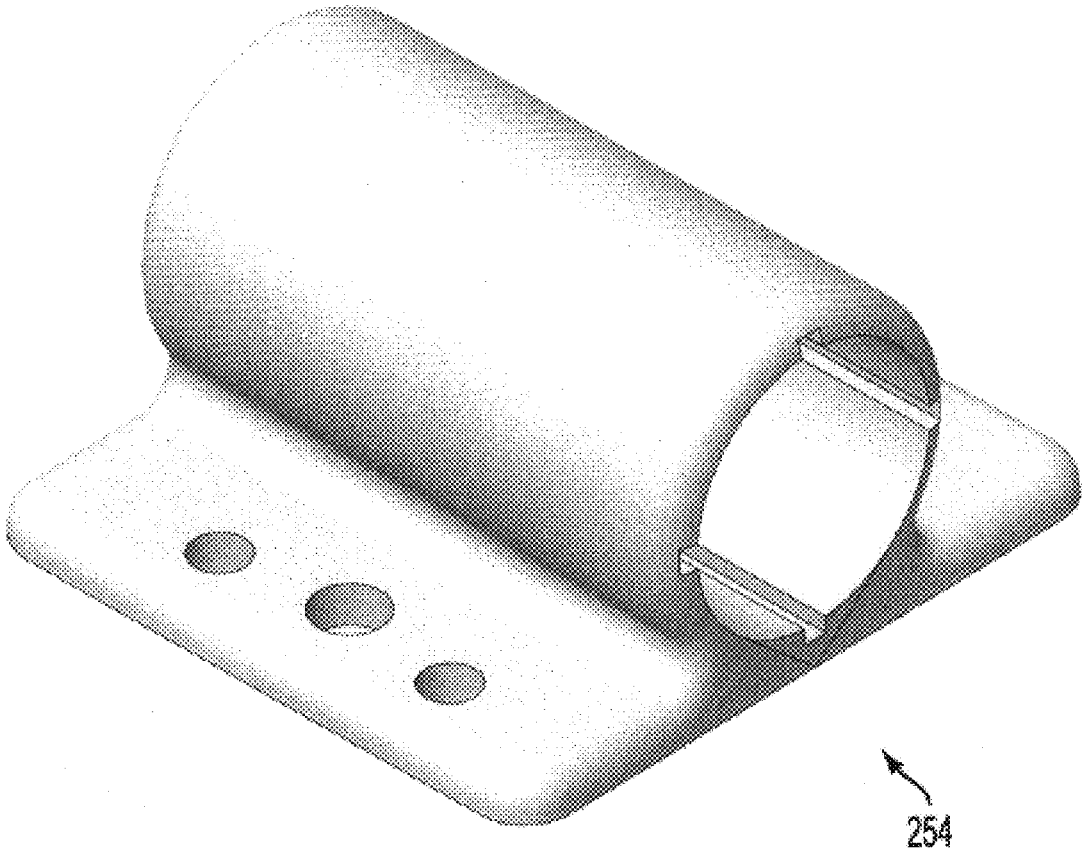
Figure 43A:
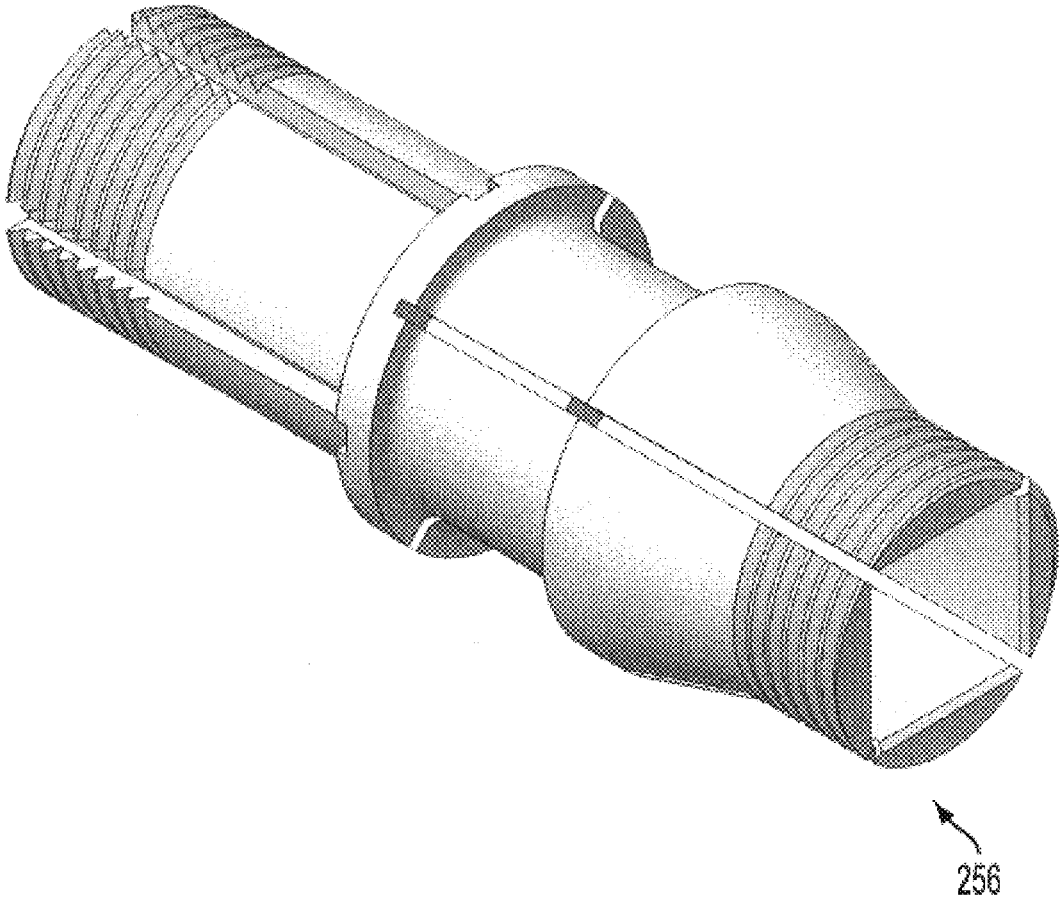
FIGS. 43A and 43B are isometric views of the collet of the present invention.
Figure 43B:
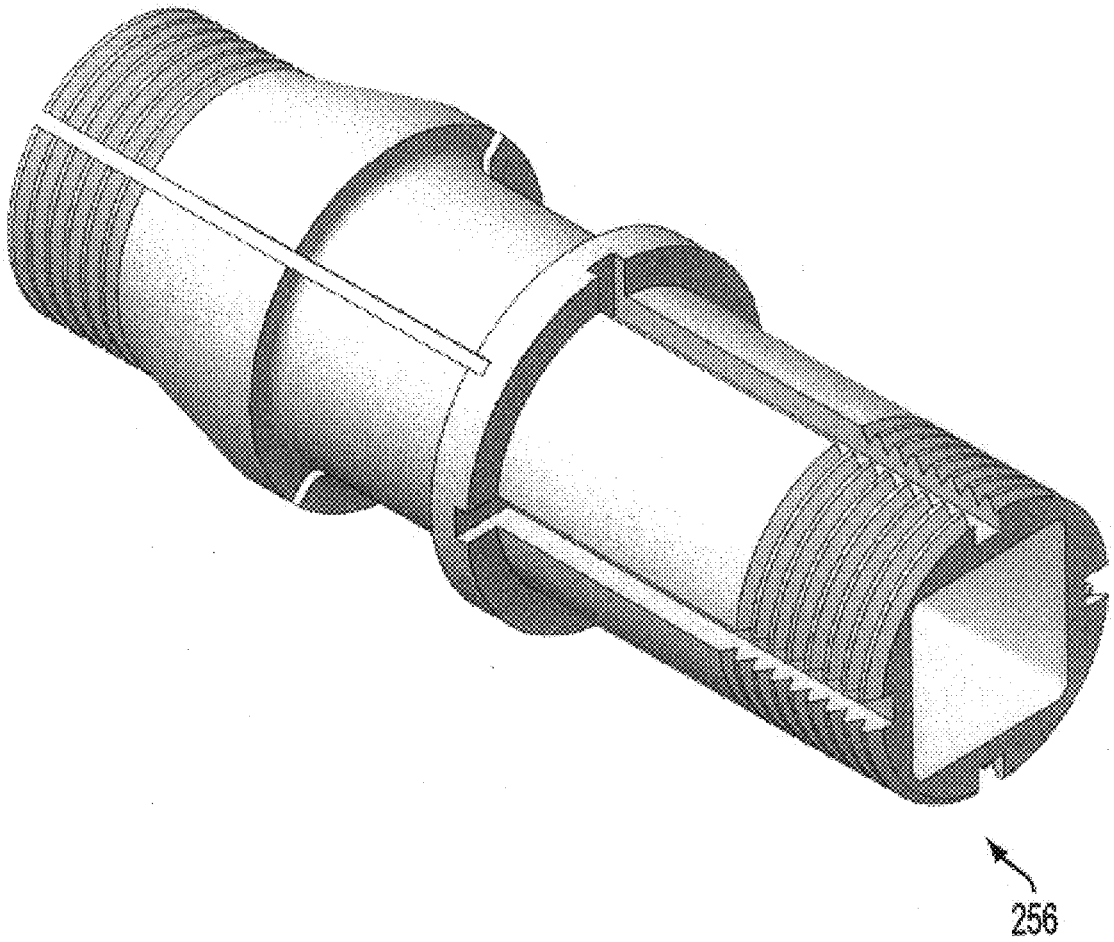
Figure 44:
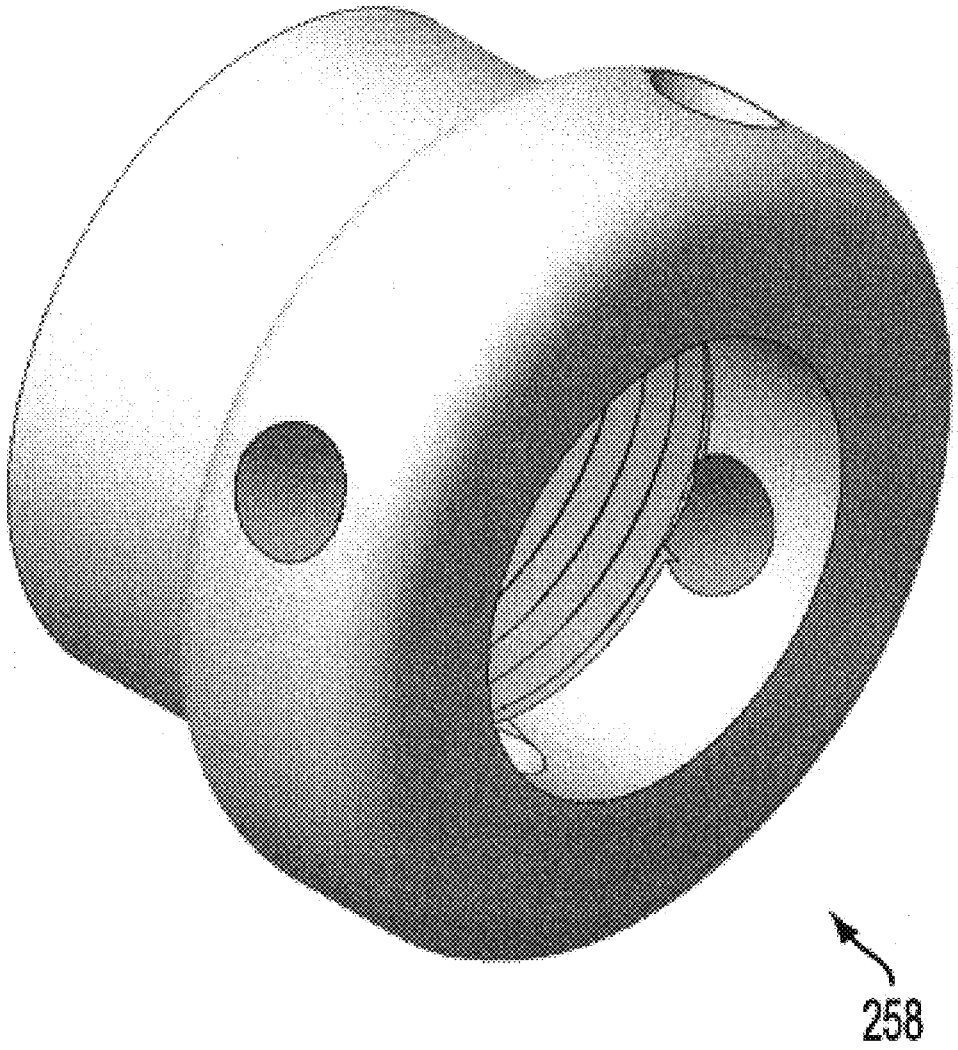
FIG. 44 is an isometric view of the clutch tightening ring of the present invention.
Figure 45:
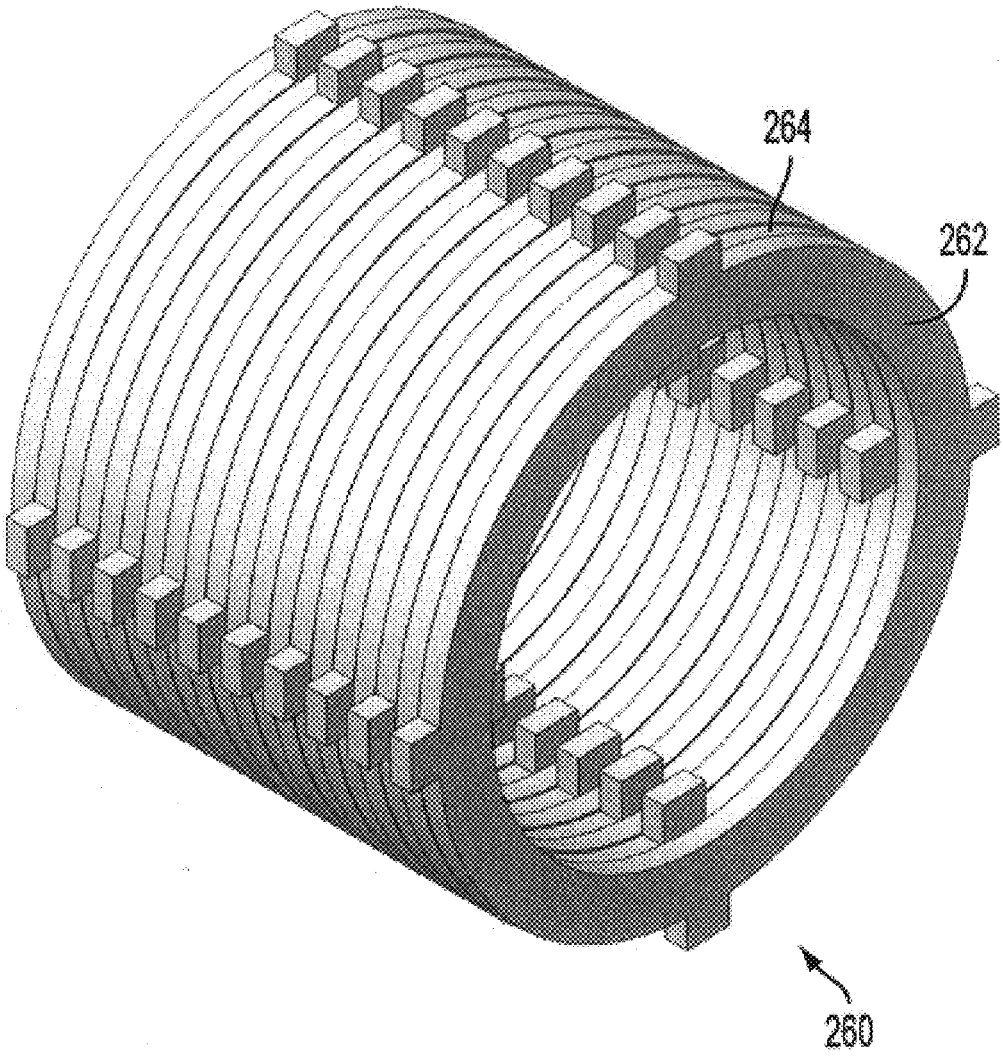
FIG. 45 is an isometric view of the clutch plate assembly of the present invention.
Figure 46:
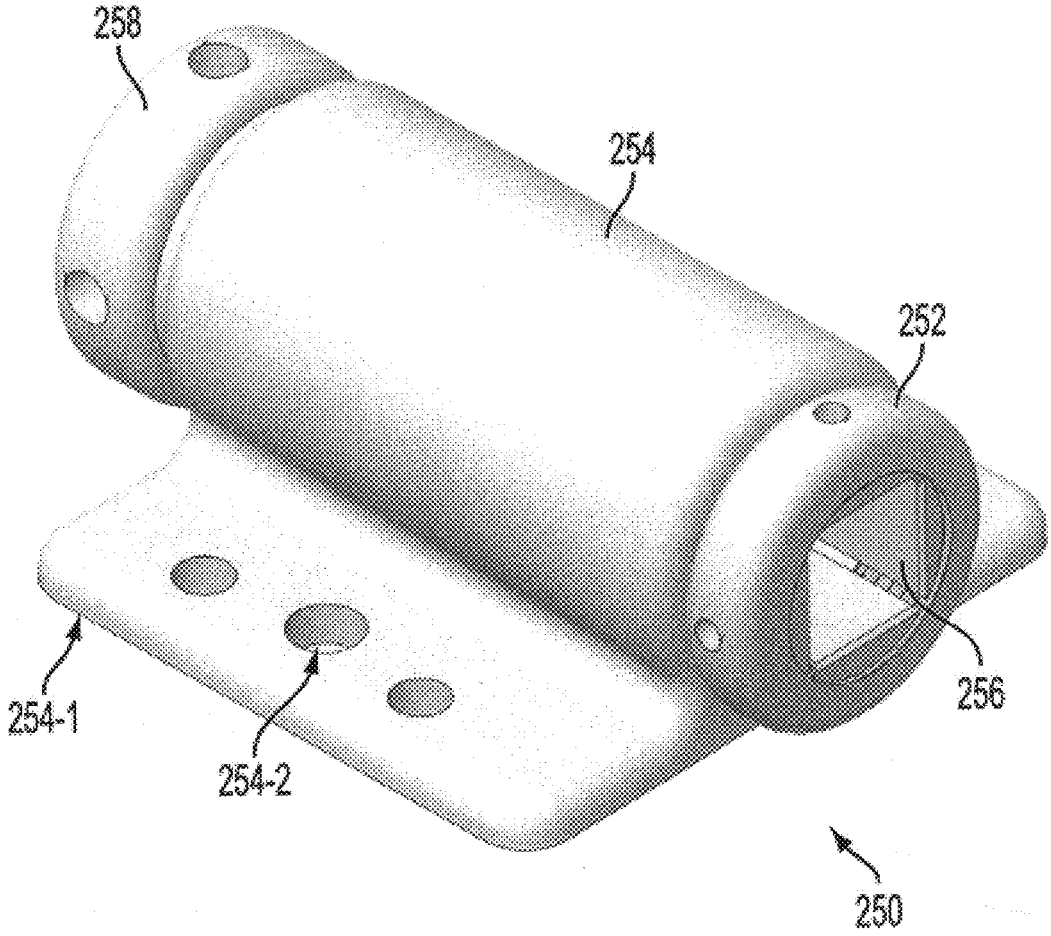
FIG. 46 is an alternate embodiment of the wheelchair mount of the present invention.
Figure 47:
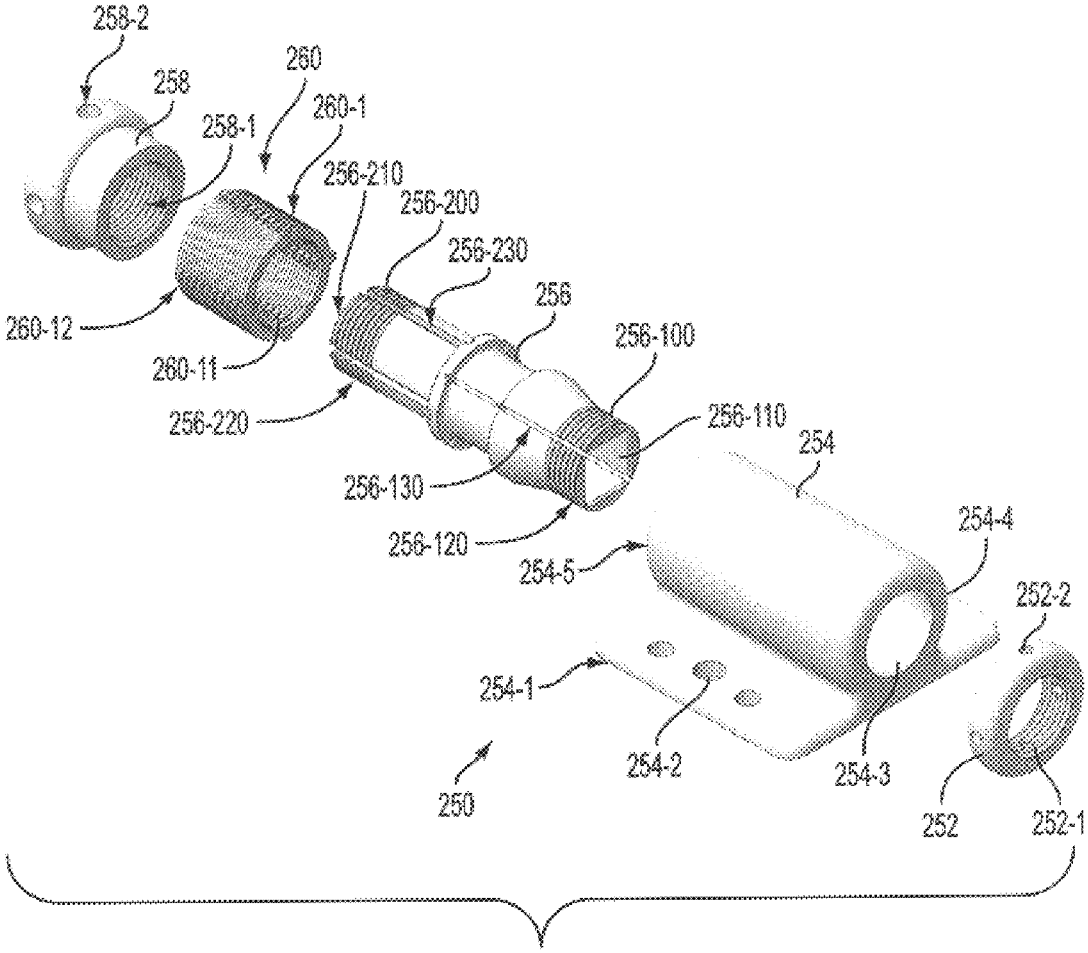
FIG. 47 is an isometric view of the wheelchair mount of FIG. 46.
Figure 48:
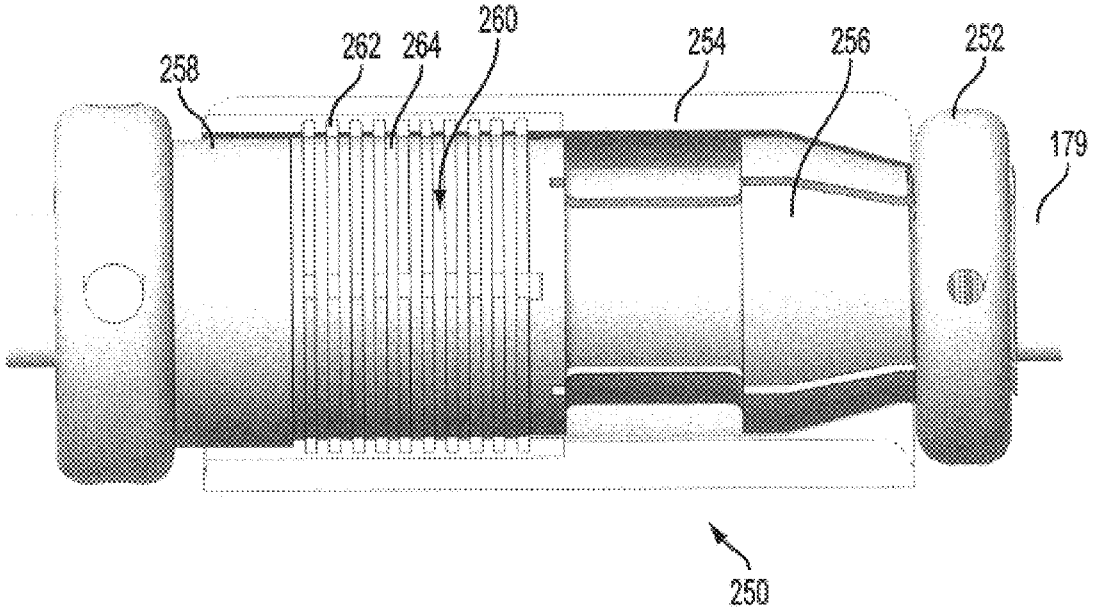
FIG. 48 is a cross-sectional view of the wheelchair mount and the mounting collet of the present invention.
Figure 49:
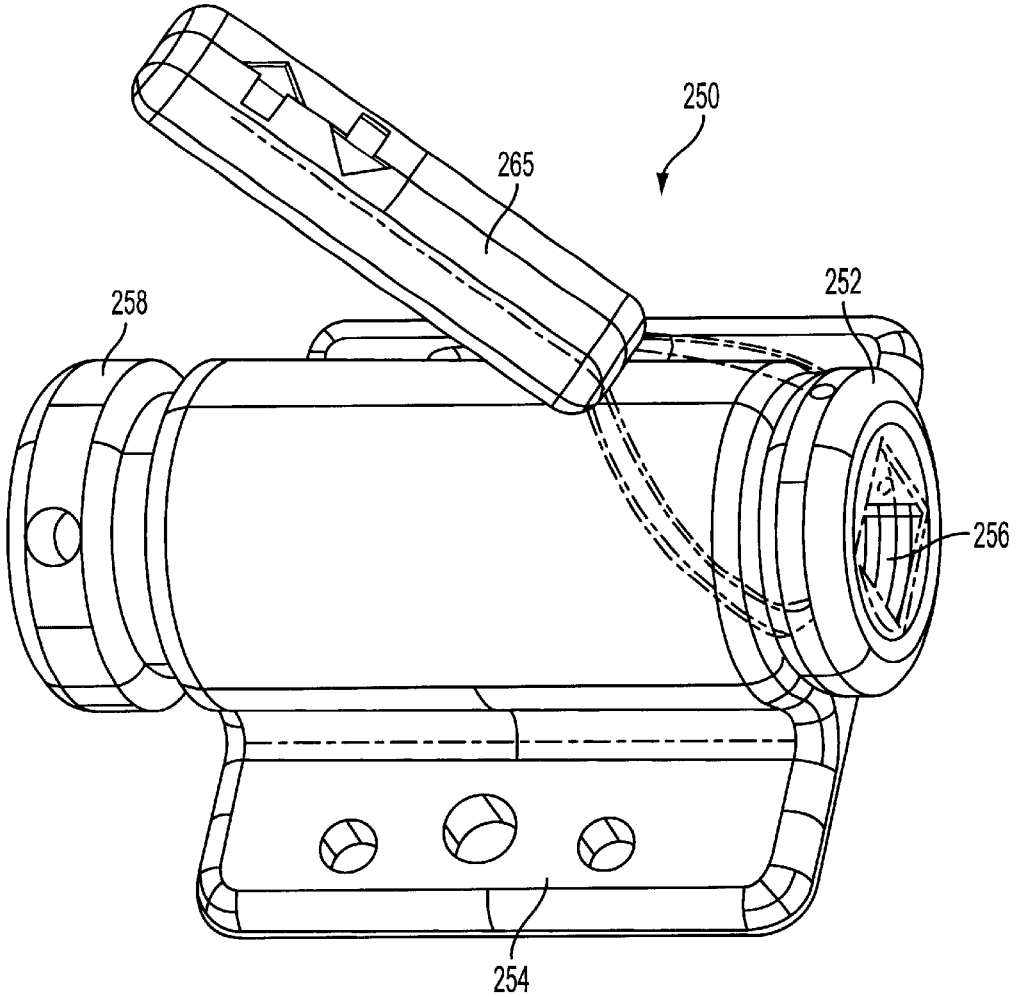
FIG. 49 is an isometric view of the release ring tightener of the present invention.

The wheelchair mount 250 can include release ring 252, mounting collet 254, collet 256, clutch plate assembly 260 and clutch tightening ring 258. FIG. 41 is an isometric view of the release ring of the present invention. FIGS. 42A and 42B are isometric views of the mounting collet of the present invention. FIGS. 43A and 43B are isometric views of the collet of the present invention. FIG. 44 is an isometric view of the clutch tightening ring of the present invention. FIG. 45 is an isometric view of the clutch plate assembly of the present invention. FIG. 46 is an alternate embodiment of the wheelchair mount of the present invention. FIG. 47 is an isometric view of the wheelchair mount of FIG. 46. FIG. 48 is a cross-sectional view of the wheelchair mount and the mounting collet of the present invention. FIG. 49 is an isometric view of the release ring tightener of the present invention.

The release ring 252 includes an internally threaded surface 252-1. The internally threaded surface 252-1 is adapted for removable connection with the collet 256 (to be described in detail later). The release ring 252 also includes a tool void 252-2. The tool void 252-2 is adapted to allow a ring removal tool to remove the release ring 252 (to be described in detail later).

The mounting collet 254 includes a wheelchair mount surface 254-1. The wheelchair mounting surface includes a wheelchair fastener void 254-2 disposed therethrough. The mounting collet can be mounted to a wheelchair (not shown) through the use of fasteners (not shown) disposed in the wheelchair fastener void 254-2 of the mounting collet 254. The mounting collet 254 further includes a collet channel 254-3 and a collet opening 254-5. The collet channel 254-3 is sized and shaped to receive the collet 256, clutch plate assembly 260, and clutch tightening ring 258 (to be described in detail later). The mounting collet 254 further includes clutch grooves 254-4. The clutch grooves 254-4 are sized and shaped to retain and prevent rotation of the clutch plate assembly 260 (to be described in detail later).

The collet 256 includes a first end 256-100 and a second end 256-200. The first end 256-100 defines an extension rod channel 256-110. The extension rod channel 256-110 is sized and shaped to receive the extension rod 178 (to be described in detail later). The first end 256-100 further includes an externally threaded portion 256-120. The externally threaded portion 256-120 is sized and shaped for removable connection with the release ring 252 (to be described later). The first end also includes compression voids 256-130.

The second end 256-200 of the collet 256 includes an extension rod channel 256-210 sized and shaped to receive the extension rod 178 (to be described in detail later). The second end 256-200 includes a externally threaded portion 256-220. The externally threaded portion 256-120 is sized and shaped for removable connection with the clutch tightening ring 258 (to be described later). The second end 256-200 also includes clutch grooves 256-230. The clutch grooves 256-230 are sized and shaped to retain and prevent rotation of the clutch plate assembly 260 (to be described in detail later).

The clutch plate assembly 260 includes a clutch plates 260-1. The clutch plate 260-1 can include an interior protrusion 260-11 and/or an exterior protrusion 260-12. The clutch plate 260-1 will include either an interior protrusion 260-11 or an exterior protrusion 260-12. The clutch plate assembly 260 can include a plurality of clutch plates 260-1.

The clutch tightening ring 258 includes an internally threaded surface 258-1. The internally threaded surface 258-1 is adapted for removable connection with the collet 256 (to be described in detail later). The clutch tightening ring 258 also includes a tool void 258-2. The tool void 258-2 is adapted to allow a ring removal tool to remove the clutch tightening ring 258 (to be described in detail later).

In the wheelchair mount 250, the collet 256 is inserted through the collet opening 254-5 and is disposed within the collet channel 254-3 of the mounting collet 254, such that the second end 256-200 of the collet 256 is proximate the collet opening 254-5 of the mounting collet. The clutch plate assembly 260 is disposed within the collet channel 254-3 of the mounting collet 254, such that the interior protrusions 260-11 of the clutch plate assembly 260 are disposed within the clutch grooves 256-230 of the collet 256 and the exterior protrusions 260-12 of the clutch plate assembly 260 are disposed within the clutch grooves 254-4 of the mounting collet 254. The internally threaded surface 258-1 of the clutch tightening ring 258 removably connects with the externally threaded portion 256-220 of the collet 250. The internally threaded surface 252-1 of the release ring 252 removably connects with the externally threaded portion 256-120 of the collet 250. The clutch tightening ring 258 and/or the release ring 252 can be tightened or loosened with the aid of a ring removal tool. By this arrangement, the extension rod 179 can be variable positioned and tightly secured within the wheelchair mount 250. Further, removal or loosening of the clutch tightening ring 258 is necessary only when disassembling the wheelchair mount 250. Repositioning of the extension rod 179 only requires the loosening and tightening of the release ring 252.

Wheelchair Mount—Third Variation

Figure 50:
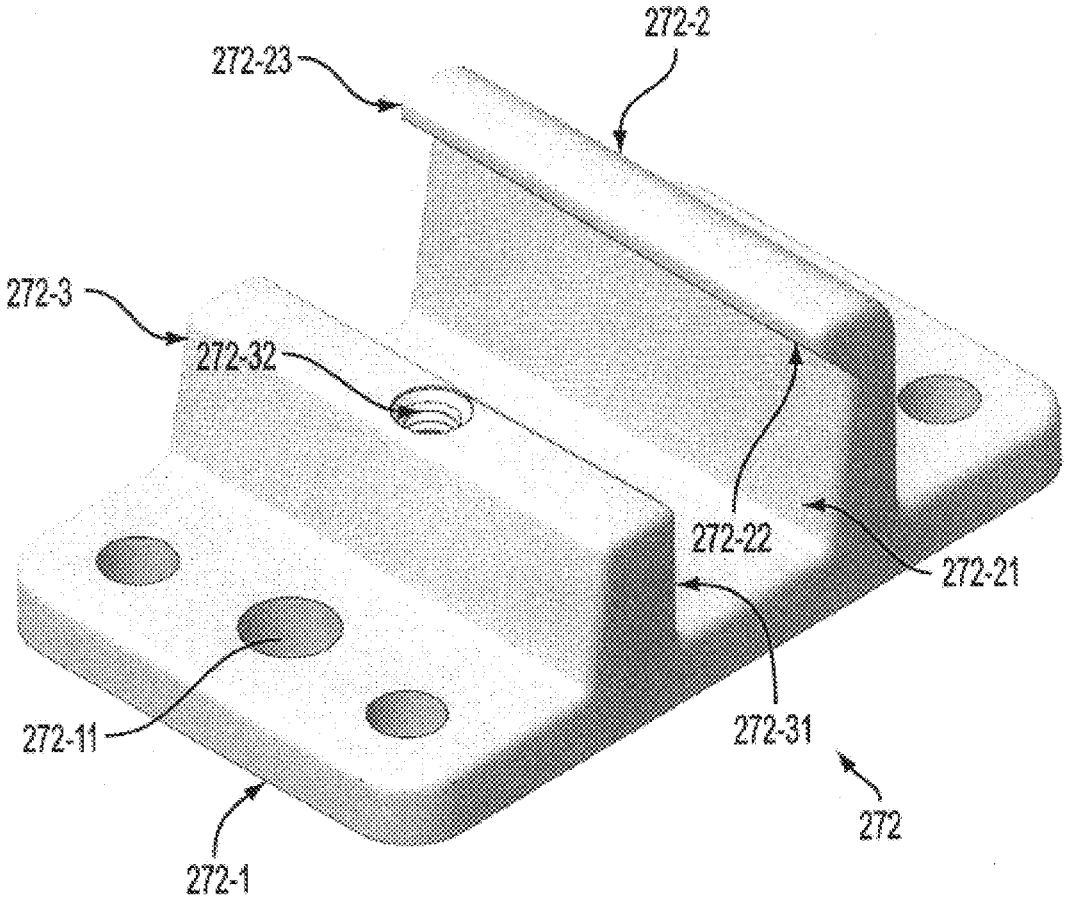
FIG. 50 is an isometric view of an alternate embodiment of the mounting bracket of the present invention.
Figure 51:
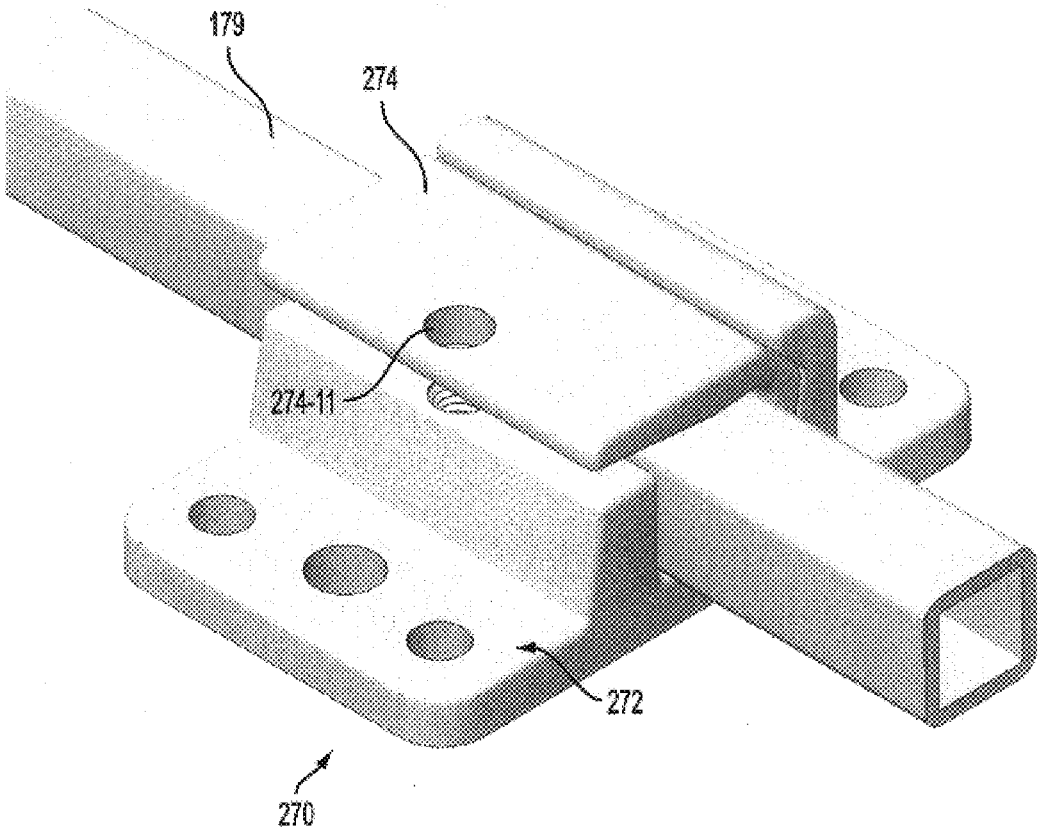
FIG. 51 is an isometric view of the wheelchair mount of the present invention.
Figure 52:
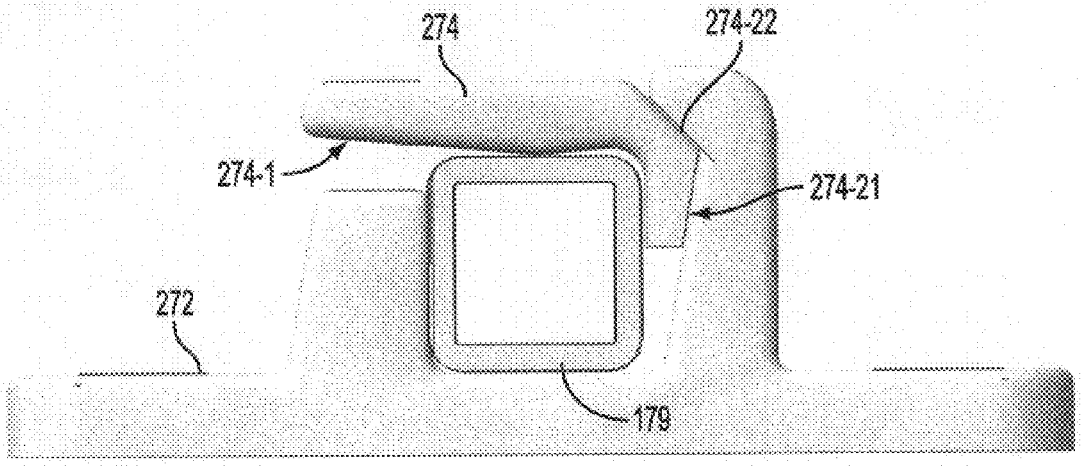
FIG. 52 is a cross-sectional view of the wheelchair mount of FIG. 51.

The third variation of the wheel chair mount 270 includes a mounting bracket 272 and a mounting clip 274. FIG. 50 is an isometric view of an alternate embodiment of the mounting bracket of the present invention. FIG. 51 is a isometric view of the wheelchair mount of the present invention. FIG. 52 is a cross sectional view of the wheelchair mount of FIG. 51.

The mounting bracket 272 includes a wheelchair mounting plate 272-1, a clip wall 272-2, and a fastener wall 272-3. The mounting plate 272-1 includes a wheelchair fastener void 272-11. A fastener (not shown) can be disposed in the wheelchair fastener void 272-11 to secure the mounting bracket 272 to a wheelchair (not shown). The clip wall 272-2 includes a first slanted surface 272-21, a second slanted surface 272-22, and a clip stop 272-23. The fastener wall 272-3 includes an extension bar stop 272-31 and a clip fastener void 272-32.

The mounting clip 274 includes a bar contact surface 274-1, a first slanted contact surface 274-21, and a second slanted contact surface 274-22. The bar contact surface 274-1 includes a fastener void 274-11.

In the wheelchair mount 270, the mounting clip 274 is disposed between the first and second slanted surfaces 272-21, 272-22, and the clip stop 272-23 of the mounting bracket 272, such that the first slanted contact surface 274-21 of the mounting clip 274 is adjacent to the first slanted surface 272-21 of the mounting bracket 272, and the second slanted contact surface 274-22 of the mounting clip 274 is adjacent the second slanted surface 272-22 of the mounting bracket. Further, the fastener void 274-11 of the mounting clip 274 is operatively aligned with the clip fastener void 272-32 of the mounting bracket. By this arrangement, the extension rod 179 can be disposed between the clip and fastener walls 272-2, 272-3 and the mounting clip 274. A fastener can be inserted into the fastener void 274-11 of the mounting clip 274 and the clip fastener void 272-32 of the mounting bracket. As the fastener (not shown) is tightened, the mounting clip 274 and the mounting bracket 272 secure the extension rod 179.

Connecting Assembly—Second Embodiment

A second embodiment of the connecting assembly is connector 500. FIG. 3 is an isometric view of an alternate embodiment of the head array of the present invention which includes structure of the connector 500. The connector 500 includes extension rod 179, an extension joint 170, alternate ball mount 340 and a first and second half ball mount receiver 188 and 184, respectively, and wheelchair mounts 210, 250, or 270.

Ball Mount and First and Second Half Ball Mount Receiver—Second Embodiment

Figure 15:
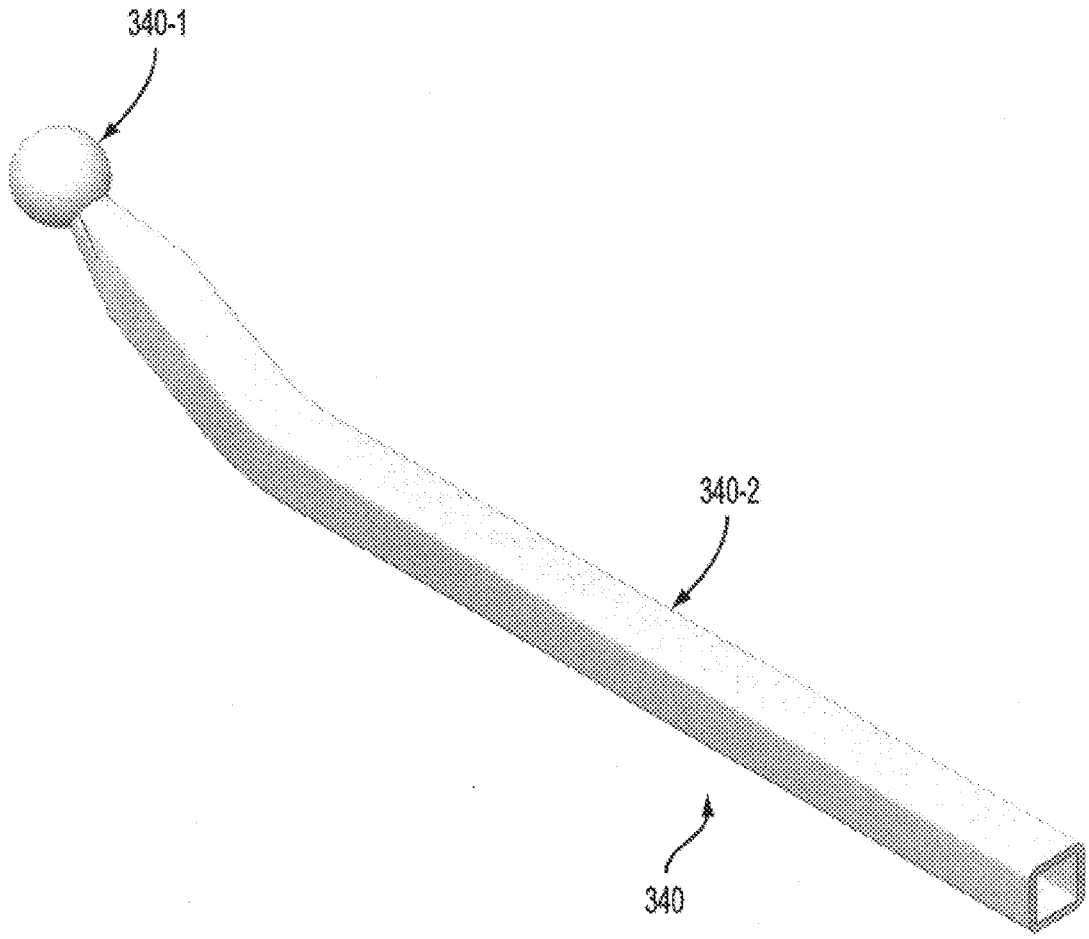
FIG. 15 is an isometric view of an alternate embodiment of the ball mount of the present invention.
Figure 16A:
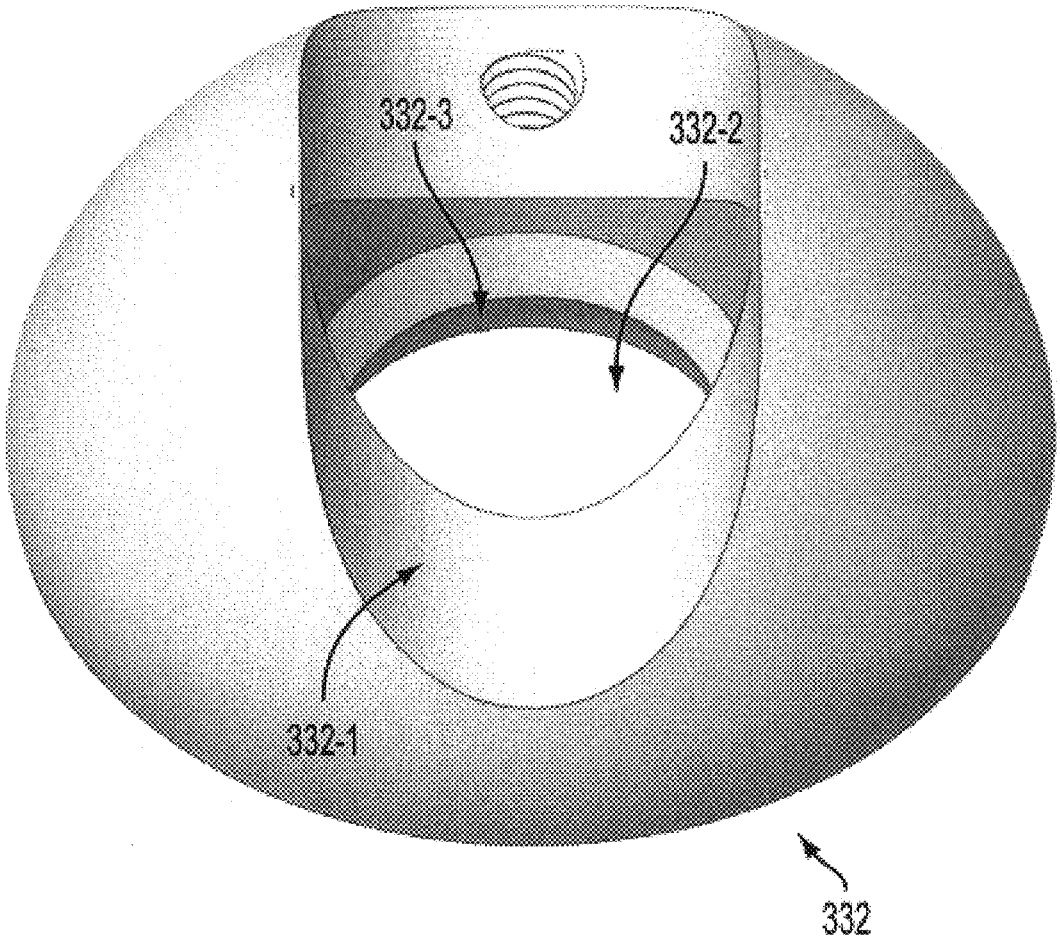
FIGS. 16A and 16B are isometric views of an alternate embodiment of the first half ball mount receiver of the present invention.
Figure 16B:
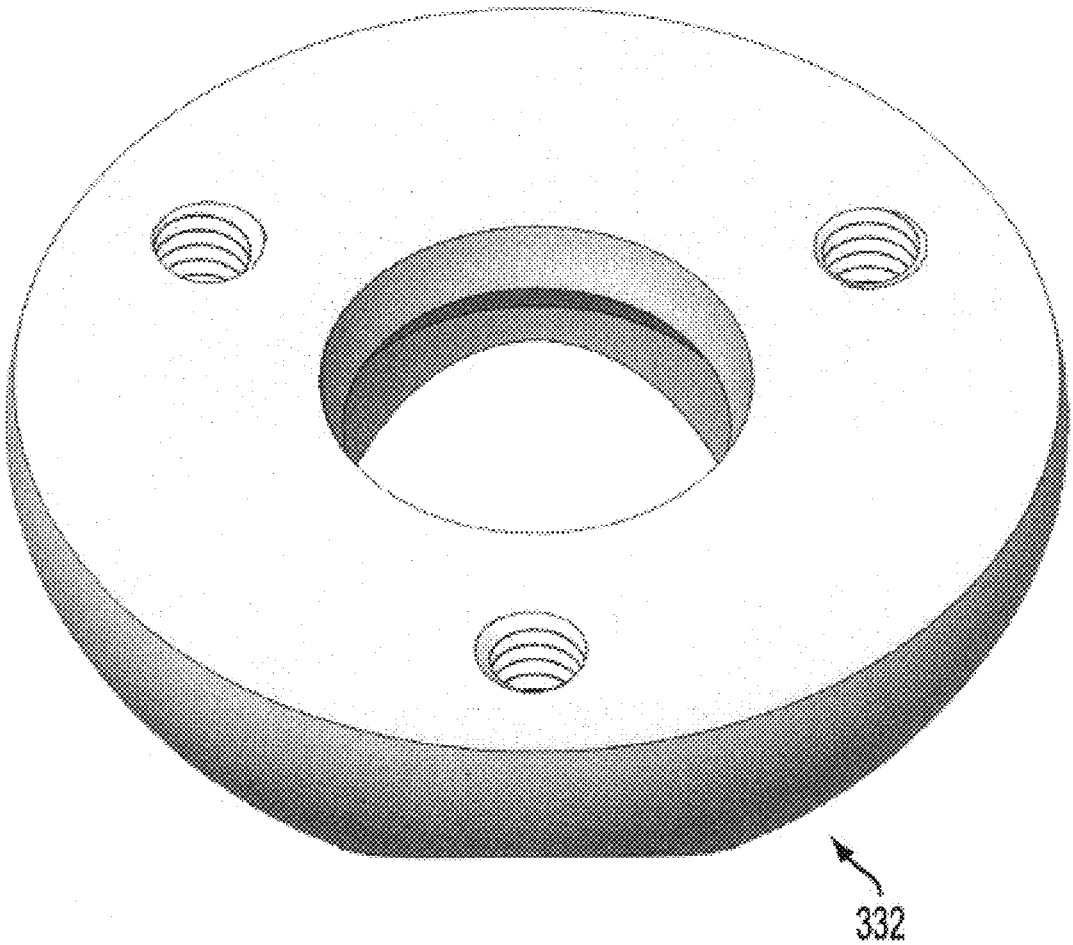

FIG. 15 is an isometric view of an alternate embodiment of the ball mount of the present invention. A ball mount 340 includes a ball portion 340-1 and a support portion 340-2. FIGS. 16A and 16B are isometric views of an alternate embodiment of the first half ball mount receiver of the present invention. An alternate first half ball receiver 332 includes an alternate channel 332-1, an alternate ball mount void 332-2, and an alternate ball mount contact surface 332-3. The alternate first half ball receiver 332 can be used with the second half ball mount receiver 184, as shown in the drawing figures and described above.

Material Selection—Preferred Embodiments

In a preferred embodiment of the present invention, the materials used to fabricate the various components are preferably lightweight materials with corrosion-resistant finishes. Preferably, these finishes are black.

The plates discussed above (e.g., occipital plate 194, etc.) are preferably covered with padding, fabric, and/or other similar material at least on the surfaces that may contact portions of the user's body for comfort.

In general, where components are welded together, the components are preferably made of similar materials (i.e., steel to steel, aluminum to aluminum, etc.) Furthermore, where components experience forced engagement (i.e., compressive joints, threaded joints, etc.), the components are preferably made of dissimilar materials to prevent galling, seizing, etc. The preferred material is specified for the following components.

Temple arms 134 are preferably formed of steel with a high carbon content for spring tempering. This material provides temple arms 134 with elasticity and memory.

Swivel balls 126 and 132 are preferably formed of steel or stainless steel and provided with a corrosion-resistant finish. Swivel rings 122 and 124 are preferably formed of a material dissimilar to swivel balls to prevent galling or seizing. Such materials may include aluminum or soft steel. First swivel rings 122 may be formed of a different material from that of second swivel rings 124 and swivel balls 126 and 132, depending on the material to which a particular swivel rings 124 or 122 is attached. For example, one particular swivel ring 122 is preferably formed of the same material as temple plate 192 so that the two can be welded to one another. Likewise, one particular swivel ring 124 is preferably formed of the same material as swing arm 154 so that these two can be welded to one another.

Swing lock 156 is preferably provided with a slippery coating so that its ramped surface preferably glides on the ramped surface of swing support 152 to prevent galling during the automatic engagement with the locking surfaces of swing support 152 and swing lock 156. Alternately, the slippery coating may be applied to swing support 152 in place of or in addition to the coating applied to swing lock 156.

Ball post 162 is preferably formed of stainless steel or steel with a corrosion-resistant finish.

Swing support 152 is preferably formed of aluminum.

Swing arm 154 is preferably formed of either aluminum, stainless steel, or steel and preferably similar to the material of first swivel ring 124 to which it may be welded.

Channels 164, 168, and 320 are preferably formed of extruded aluminum.

First and second joint shells 174, 172 are preferably formed of aluminum.

Wedge locks 176 are preferably formed of aluminum.

Extension rods 178,179 are preferably formed of stainless steel or steel with a corrosion-resistant coating. The joint portion and the extension portion are formed of the same material preferably welded together.

Ball mount 182 is preferably formed of stainless steel or steel with a corrosion-resistant coating.

The plates (e.g., temple plates 192, occipital plate 194, sub-occipital plates 196, or sub-occipital plate 310) are preferably formed of aluminum, stainless steel, or steel with a corrosion-resistant coating. Alternately, the plates may also be formed of plastic or composite materials depending on manufacturing volume.

First half ball mount receiver 188 is preferably formed of aluminum so that it may be welded to channels 164 or 168. Alternate first half ball mount receiver 332 is preferably formed of aluminum so that it may be welded to channel 320.

Release ring 252 is preferably formed of aluminum. In any event, a friction washer may be disposed between release ring 252 and mounting collet 254. Mounting collet 254 is preferably formed of extruded and machine aluminum although it may be formed of a single machined block of aluminum. Collet 256 is preferably formed of stainless steel or steel with a corrosion-resistant coating. The steel used preferably has sufficient elasticity.

Clutch plates 262, 264 are preferably stamped out of a mild steel and provided with a corrosion-resistant coating.

Clutch tightening ring 258 is preferably formed of aluminum.

It will be apparent to those skilled in the art that various modification and variations can be made in the adjustable head support for connection to a wheelchair of the present invention without departing from the spirit or scope of the invention. Thus, it is intended that the present invention cover the modifications and variations of this invention provided they come within the scope of the appended claims and their equivalents.

I claim:

1. A head array for a wheelchair, comprising:

a temple support including a temple plate, a temple arm, and a swivel joint, the temple plate being operatively connected to the temple arm via the swivel joint;

an occipital support;

a sub-occipital support; and a support structure for adjustably mounting the temple support, the occipital support and the sub-occipital support.

2. The head array for a wheel chair according to claim 1, wherein said swivel joint comprises two swivel rings, said swivel rings having a swivel ball disposed therebetween, said swivel ball operatively connected to said temple plate and said temple arm, whereby tightening of said swivel rings prevents movement of said temple plate relative to said temple arm.

3. The head array for a wheel chair according to claim 1, wherein the sub-occipital support comprises two sub-occipital plates.

4. The head array for a wheel chair according to claim 3, wherein the sub-occipital support structure includes two swivel joints, each sub-occipital plate being attached to one of the swivel joints.

5. The head array for a wheel chair according to claim 1, wherein the occipital support comprises an occipital plate.

6. The head array for a wheel chair according to claim 5, wherein the occipital support structure includes a swivel joint, the occipital plate being attached to the swivel joint of the occipital support structure.

7. The head array for a wheel chair according to claims 6, wherein said swivel joint comprises two swivel rings, said swivel rings having a swivel ball disposed therebetween, said swivel ball operatively connected to said occipital plate and said occipital support structure, whereby tightening of said swivel rings prevents movement of said occipital plate relative to said occipital support structure.

8. The head array for a wheel chair according to claim 1, wherein the sub-occipital support comprises a sub-occipital plate.

9. The head array for a wheel chair according to claim 8, wherein the sub-occipital support structure includes a swivel joint, the sub-occipital plate being attached to the swivel joint of the sub-occipital support structure.

10. The head array for a wheel chair according to claim 9, wherein said swivel joint comprises two swivel rings, said swivel rings having a swivel ball disposed therebetween, said swivel ball operatively connected to said sub-occipital plate and said sub-occipital support structure, whereby tightening of said swivel rings prevents movement of said sub-occipital plate relative to said sub-occipital support structure.

* * * * *